US007851119B2

(12) United States Patent
Toshine et al.

(10) Patent No.: US 7,851,119 B2
(45) Date of Patent: Dec. 14, 2010

(54) ELECTROPHOTOGRAPHIC PHOTOCONDUCTOR, METHOD FOR PRODUCING THE SAME, IMAGE FORMING PROCESS, IMAGE FORMING APPARATUS AND PROCESS CARTRIDGE

(75) Inventors: Tetsuya Toshine, Numazu (JP); Chiaki Tanaka, Izunokuni (JP); Michio Kimura, Numazu (JP); Tomoyuki Shimada, Shizuoka (JP); Nozomu Tamoto, Numazu (JP); Yoshiki Yanagawa, Numazu (JP); Hiromi Tada, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 686 days.

(21) Appl. No.: 11/850,394

(22) Filed: Sep. 5, 2007

(65) Prior Publication Data

US 2008/0063962 A1 Mar. 13, 2008

(30) Foreign Application Priority Data

Sep. 7, 2006 (JP) ..... 2006-243289
Nov. 2, 2006 (JP) ..... 2006-299370
Aug. 6, 2007 (JP) ..... 2007-204763

(51) Int. Cl.
*G03G 7/00* (2006.01)

(52) U.S. Cl. ..... 430/130; 430/127

(58) Field of Classification Search ..... 430/127, 430/130

See application file for complete search history.

(56) References Cited

U.S. PATENT DOCUMENTS 6,861,188 B2 3/2005 Ikegami et al.
6,899,983 B2 5/2005 Tamoto et al.
6,936,388 B2 8/2005 Suzuki et al.
7,018,755 B2 3/2006 Ikegami et al.
7,160,658 B2 1/2007 Suzuki et al.
7,251,437 B2 7/2007 Tamoto et al.
2005/0008957 A1 1/2005 Ikegami et al.
2005/0069797 A1 3/2005 Niimi et al.
2005/0175911 A1 8/2005 Tamoto et al.
2006/0057479 A1 3/2006 Niimi et al.
2006/0177749 A1 8/2006 Tamoto et al.

(Continued)

FOREIGN PATENT DOCUMENTS

JP 7-134435 5/1995

(Continued)

*Primary Examiner*—Mark F Huff
*Assistant Examiner*—Peter L Vajda
(74) *Attorney, Agent, or Firm*—Oblon, Spivak, McClelland, Maier & Neustadt, L.L.P.

(57) ABSTRACT

The present invention provides an electrophotographic photoconductor capable of reducing latent electrostatic image stability defects caused by adhesion/adsorption of an electric discharge product formed by a charger in an image forming process, degradation of charge transportability and cleaning defects caused when removing a residual toner. The electrophotographic photoconductor has a conductive substrate, and a photosensitive layer which contains at least a binder, a charge generating material and a charge transporting material and is formed on the substrate, wherein the photosensitive layer contains an injection material composed of at least any one of one wax selected from paraffin waxes, Fisher-Tropsh waxes, polyolefin waxes and a polyorganosiloxane compound in an area from the surface of the photosensitive layer to 50% of the thickness thereof in the thickness direction of the electrophotographic photoconductor, and the content of the injection material is 3% by mass or more to the content of the binder.

6 Claims, 5 Drawing Sheets

U.S. PATENT DOCUMENTS

2006/0197823 A1 9/2006 Ohta et al.

FOREIGN PATENT DOCUMENTS

| | | |
|---|---|---|
| JP | 3273258 | 2/2002 |
| JP | 2002-138216 | 5/2002 |
| JP | 2002-356627 | 12/2002 |
| JP | 2003-186226 | 7/2003 |
| JP | 2003-202686 | 7/2003 |
| JP | 2006-3454 | 1/2006 |

ELECTROPHOTOGRAPHIC PHOTOCONDUCTOR, METHOD FOR PRODUCING THE SAME, IMAGE FORMING PROCESS, IMAGE FORMING APPARATUS AND PROCESS CARTRIDGE

BACKGROUND OF THE INVENTION

1. Field of the Invention

The present invention relates to an electrophotographic photoconductor used for copiers, laser printers, regular facsimile machines, etc. and a method for producing the electrophotographic photoconductor, a process cartridge used for image forming apparatus using the electrophotographic photoconductor, an image forming apparatus using the electrophotographic photoconductor and an image forming process using the electrophotographic photoconductor.

2. Description of the Related Art

Recently, from the perspective of office space-saving and expansion of business opportunities and the like, down-sizing and colorization of electrophotographic devices and further high-quality picture technologies are increasingly demanded, and reduction in size of electrophotographic device and image-colorization technologies in electrophotographic devices are increasingly promoted.

For example, in terms of image-colorization in electrophotographic devices, tandem-type color electrophotographic devices are presently used as the mainstream. In a tandem-type color electrophotographic device, a plurality of process cartridges used for each color need to be placed in a limited space, and thus developments on technologies for space-saving of charging units, developing units, cleaning units and the like are actively promoted.

In the meanwhile, charging uniformity, transferring property, toner removing ability and latent image forming stability of electrophotographic photoconductors are more required by the colorization than ever, and down-sizing of respective process units as well as enhancements of functions thereof are urgent needs.

Performance of respective process units have surely improved, however, in the meanwhile, problems with electrophotographic photoconductors caused by electrical factors and mechanical factors tend to become significant.

For example, Japanese Patent Application Laid-Open (JP-A) No. 2007-33905 describes that in technique of a superimposed charge roller of alternating/direct current as a charging method of which charge uniformity is relatively high, problems caused by electric factors affecting electrophotographic photoconductors are remarkably significant as compared to conventional scorotoron charging methods and direct current charge rollers, and the problem could cause deterioration of surface layers of conventionally used organic photoconductors (OPC).

In this case, deteriorated parts of the surface layer are composed of a relatively low-molecular weight oxide and thus the deteriorated parts increase the surface energy of the photoconductor.

Further, as a method of removing a residual toner remaining on the surface of an electrophotographic photoconductor after transferring a toner image, there is a method in which a cleaning blade typically composed of an elastic resin is made to physically come into contact with an electrophotographic photoconductor (blade cleaning method). Since the method can exhibit a large amount of effect of removing a residual toner in a small space, it is presently the mainstream of cleaning method of photoconductor surface.

However, the method still has a problem that toner slipping is easily caused by vibrations of an electrophotographic photoconductor and the cleaning blade and cleaning defect of streaky toner deposits easily occurs on the photoconductor surface because of a high frictional coefficient between the electrophotographic photoconductor that the surface energy is increased by charging and the cleaning blade.

Such toner slipping and cleaning defect of streaky toner deposits lead to contamination of respective process units and cause a charge in the subsequent process, resulting in interference with writing to memory and re-transferring in the subsequent process. Therefore, toner slipping and cleaning defect of streaky toner deposits are significant issues in achieving highly fine images and high quality images.

It has been also known that an electric discharge product formed by the above-noted charging unit has an impact on stability of a latent electrostatic image to be formed on the electrophotographic photoconductor.

In the above-noted charging unit, ozone and nitrogen oxides are formed from nitrogen and oxygen in the air by the electric discharge phenomenon. The electric discharge product formed in the charging unit generally has high reactivity, i.e., the electric discharge product is reactive to a charge transporting material contained in an organic photoconductor and adsorbs the charge transporting material, resulting in reduction in charge transporting property of the organic photoconductor. The electric discharge product is deposited on the surface of a photoconductor even when the photoconductor is an inorganic photoconductor, and further moisture in the air is taken into the layers of the photoconductor to cause degradation of surface resistance, consequently causing image defects (see KONICA Technology Report (2000)).

Particularly when a surface layer (hereinafter, may be called "crosslinked surface layer") formed by making a radically polymerizable compound and the like crosslinked is formed on the surface of an electrophotographic photoconductor, an electric discharge product and moisture easily get into the inside of the surface layer due to its high permeability to gas, and there is a tendency that the latent electrostatic image stability is degraded and charge transporting property is degraded. This becomes a significant problem when a crosslinked surface layer is laminated on a photoconductor surface.

Various improved techniques on electrophotographic photoconductors have been reported to solve problems derived from image forming process itself.

For example, for an improvement in blade cleaning ability, a method of increasing a transfer rate of toner is exemplified.

Specifically, as disclosed in Japanese Patent Application Laid-Open (JP-A) No. 2004-258336, a layer composed of a binder resin and a polysiloxane resin is formed as a surface layer of an electrophotographic photoconductor. With this configuration, a transfer rate of toner is expected to increase due to reduced surface energy of the electrophotographic photoconductor. However, generally, a resin like siloxane is not so soluble in polycarbonates described in JP-A No. 2004-258336 and is easily unevenly distributed in the vicinity of the photoconductor surface when forming the surface layer. For this reason, it was difficult to obtain effects such as latent electrostatic image stability over a long period of time.

Besides the electrophotographic photoconductor, Japanese Patent Application Laid-Open (JP-A) No. 6-095413 describes adding a fluorine resin fine particle composed of a polymer or a copolymer of an olefin fluoride compound or a carbon fluoride to an electrophotographic photoconductor surface.

By adding the fluorine resin fine particle to an electrophotographic photoconductor surface, part of the electrophotographic photoconductor surface can have low-surface energy sites, and thus the transfer rate of a toner is expected to be increased.

Unlike the electrophotographic photoconductor containing a polysiloxane resin on the surface layer thereof as described in JP-A No. 2004-258336, the electrophotographic photoconductor described in JP-A No. 6-095413 has less uneven distribution of a material capable of exhibiting low-surface energy, rarely cause toner bleed-out, and thus an effect of maintaining latent electrostatic image stability for a long term can be expected.

However, in the electrophotographic photoconductor described in JP-A No. 6-095413, it is necessary to evenly disperse the fluorine resin fine particle in a coating solution when forming the surface layer, and there are problems that a dispersing agent used at the formation of the surface layer may degrade properties of the electrophotographic photoconductor and a relatively large domain having no charge transporting property is formed in the surface layer, which may lead to degradation of charge transporting property of the electrophotographic photoconductor.

In the meanwhile, separately from the methods of increasing the transfer rate stated above, a method of decreasing a frictional coefficient between an electrophotographic photoconductor and a cleaning blade is exemplified. The effect of maintaining latent electrostatic image stability for a long term can be expected with the use of any one of the above-mentioned two examples, however, besides the above-mentioned two examples, Japanese Patent Application Laid-Open (JP-A) Nos. 2001-109181 and 2002-196646 respectively describe that a frictional coefficient between an electrophotographic photoconductor and a cleaning blade can be reduced by forming fine convexoconcaves, i.e., irregularities on the surface of an electrophotographic photoconductor.

JP-A Nos. 2001-109181 and 2002-196646 respectively describe that by reducing a contact area between an electrophotographic photoconductor and a cleaning blade due to the convexoconcaves, i.e, irregularities formed on the surface of the photoconductor, a frictional resistance between both materials used for the electrophotographic photoconductor and for the cleaning blade can be reduced by the reduced contact area, thereby the cleaning ability of the electrophotographic photoconductor can be improved.

However, the convexoconcaves formed on the electrophotographic photoconductor surface abrade away soon and the surface is flattened in a short time, and thus it is difficult to maintain the cleaning ability for a long time.

To solve the problems with defective latent electrostatic image stability and degradation of charge transporting property that are caused by an electric discharge product formed by a charging unit, a technique for reducing a free volume of the inside of a photoconductor and a technique for rendering the electric discharge product harmless using an antioxidant have been reported.

It is conceivable that as a means of the former, the former has an effect of reducing gas permeability by placing a low-molecular component between molecules of a binder to thereby reduce the free volume of the inside of the photoconductor.

However, a remarkable effect of reducing gas permeability is hardly obtained. This is conceivable because it is possible to reduce the free volume of a surface layer that is formed by applying a coating solution but is not yet crosslinked, however, the effect of reducing gas permeability cannot be exhibited for a free volume formed by the subsequent crosslinking reaction.

As a means of the latter, Japanese Patent Application Laid-Open (JP-A) Nos. 2002-258505 and 2003-66641 respectively disclose a technique of adding an antioxidant into a crosslinked surface layer of a photoconductor. The technique has a large effect of quenching an acidic gas that is infiltrating in the crosslinked surface layer, however, at the same time, the technique has problems that the effect hardly persist for a long time and the properties of the photoconductor is easily degraded by adding an antioxidant.

As described above, occurrence of image defects derived from an electric discharge product formed by a charging unit and improvement in blade cleaning ability have become recognized as major issues to down-sizing, colorization and formation of highly fine images, and a large number of studies for improving functions and performance of electrophotographic photoconductors have been provided, however, it is still difficult to obtain sufficient effects.

The current situation is that a largely effective measure has not yet been taken for an electrophotographic photoconductor having a crosslinked surface layer which will need the above-noted effects for a long period of time.

BRIEF SUMMARY OF THE INVENTION

The objects of the present invention are therefore to solve the conventional problems and achieve the following objects. Specifically, the present invention aims to provide an electrophotographic photoconductor capable of reducing adhesion of an electric discharge product formed by a charging unit in an image forming process, defects of latent electrostatic image stability and degradation of charge transporting function caused from adsorption of electric discharge product and cleaning defects, a method for producing the electrophotographic photoconductor and an image forming process, an image forming apparatus and a process cartridge each of which is is capable of maintaining cleaning ability for a long period of time and forming images with stability.

As a result of studies and investigations for solving the above-noted problems, the present inventors found that it is possible to produce an electrophotographic photoconductor that has a photosensitive layer containing at least a binder, a charge generating material and a charge transporting material on at least a conductive substrate and is capable of reducing gas permeability thereof for a long time and keeping the surface energy low for a long time by injecting a silicone resin or waxes into the photosensitive layer.

The present invention is based on the findings of the present inventors and the means to solve the above-noted problems are as follows.

Specifically, the method for producing an electrophotographic photoconductor of the present invention includes making an electrophotographic photoconductor contact with a supercritical fluid or a subcritical fluid containing an injection material composed of at least any one of one wax selected from paraffin waxes, Fisher-Tropsh waxes, polyolefin waxes and a polyorganosiloxane at 0.5 g/L to less than 4.0 g/L to thereby inject the injection material into the electrophotographic photoconductor, wherein the electrophotographic photoconductor has a conductive substrate, and a photosensitive layer which contains at least a binder, a charge generating material and a charge transporting material and is formed on the substrate.

The electrophotographic photoconductor of the present invention has a conductive substrate and a photosensitive layer which contains at least a binder, a charge generating material and a charge transporting material and is formed on the substrate, wherein the photosensitive layer contains an injection material composed of at least any one of one wax selected from paraffin waxes, Fisher-Tropsh waxes, polyolefin waxes and a polyorganosiloxane compound in an area from the surface of the photosensitive layer to 50% of the thickness of the photosensitive layer in the thickness direction of the electrophotographic photoconductor, and the content of the injection material is 3% by mass or more to the content of the binder.

The electrophotographic photoconductor of the present invention has a conductive substrate and at least a photosensitive layer containing at least a binder, a charge generating material and a charge transporting material as the constituents and a surface layer that is crosslinked through the use of any one of heat, light and ionizing radiation being formed in this order on the conductive substrate, wherein the electrophotographic photoconductor is made contact with a supercritical fluid or a subcritical fluid containing at least a polyorganosiloxane at 0.5/L or more to thereby inject the polyorganosiloxane into the photosensitive layer, and the content of the polyorganosiloxane in an area from the surface of the photosensitive layer to 50% of the thickness of the surface layer in the thickness direction of the surface layer is 3% by mass or more to the content of the binder.

The electrophotographic photoconductor of the present invention has a conductive substrate and at least a photosensitive layer containing at least a binder, a charge generating material and a charge transporting material as the constituents, wherein the electrophotographic photoconductor is made contact with a supercritical fluid or a subcritical fluid containing at least one wax selected from paraffin waxes, Fisher-Tropsh waxes and polyolefin waxes at 0.5 g/L or more to thereby inject the wax into the electrophotographic photoconductor, and the moisture content of the electrophotographic photoconductor after being left intact under the condition of a temperature of 30° C. and a relative humidity of 90% for 48 hours is 3.0 $\mu m/mm^3$.

The electrophotographic photoconductor of the present invention has a conductive substrate and at least a photosensitive layer containing at least a binder, a charge generating material and a charge transporting material as the constituents and a surface layer that is crosslinked through the use of any one of heat, light and ionizing radiation being formed in this order on the conductive substrate, wherein the electrophotographic photoconductor is made contact with a supercritical fluid or a subcritical fluid containing at least one wax selected from paraffin waxes, Fisher-Tropsh waxes and polyolefin waxes at 0.5 g/L or more to thereby inject the wax into the electrophotographic photoconductor, and the moisture content of the electrophotographic photoconductor after being left intact under the condition of a temperature of 30° C. and a relative humidity of 90% for 48 hours is 3.0 $\mu g/mm^3$.

The image forming process of the present invention includes charging an electrophotographic photoconductor, forming a latent electrostatic image on the electrophotographic photoconductor surface charged by the charging step, developing the latent electrostatic image formed by the latent electrostatic image forming step to make a toner adhere on the latent electrostatic image, transferring a toner image formed by the developing step onto an image transfer member and after the transferring step, cleaning the electrophotographic photoconductor surface by removing a residual toner remaining on the electrophotographic photoconductor surface from the electrophotographic photoconductor surface, wherein the electrophotographic photoconductor has a conductive substrate and a photosensitive layer containing at least a binder, a charge generating material and a charge transporting material, wherein the photosensitive layer contains an injection material composed of any one of one wax selected from paraffin waxes, Fisher-Tropsh waxes and polyolefin waxes and a polyorganosiloxane compound in an area from the surface of the photosensitive layer to 50% of the thickness of the photosensitive layer in the thickness direction of the electrophotographic photoconductor is 3% by mass or more to the content of the binder.

The image forming apparatus of the present invention has at least an electrophotographic photoconductor, a charging unit configured to charge the electrophotographic photoconductor, a latent electrostatic image forming unit configured to form a latent electrostatic image on the electrophotographic photoconductor surface charged by the charging unit, a developing unit configured to develop the latent electrostatic image formed by the latent electrostatic image forming unit to make a toner adhere on the latent electrostatic image, an image transferring unit configured to transfer a toner image formed by the developing unit onto an image transfer member and a cleaning unit configured to clean the electrophotographic photoconductor surface by removing a residual toner remaining on the electrophotographic photoconductor surface from the electrophotographic photoconductor surface, wherein the electrophotographic photoconductor has a conductive substrate and a photosensitive layer containing at least a binder, a charge generating material and a charge transporting material, wherein the photosensitive layer contains an injection material composed of any one of one wax selected from paraffin waxes, Fisher-Tropsh waxes and polyolefin waxes and a polyorganosiloxane compound in an area from the surface of the photosensitive layer to 50% of the thickness of the photosensitive layer in the thickness direction of the electrophotographic photoconductor is 3% by mass or more to the content of the binder.

The process cartridge of the present invention is equipped with an electrophotographic photoconductor and at least one unit selected from a charging unit, an exposing unit, a developing unit and a cleaning unit, wherein the electrophotographic photoconductor and at least one unit are integrally combined into one piece and detachably mounted to a body of an image forming apparatus, wherein the electrophotographic photoconductor has a conductive substrate and a photosensitive layer containing at least a binder, a charge generating material and a charge transporting material, wherein the photosensitive layer contains an injection material composed of any one of one wax selected from paraffin waxes, Fisher-Tropsh waxes and polyolefin waxes and a polyorganosiloxane compound in an area from the surface of the photosensitive layer to 50% of the thickness of the photosensitive layer in the thickness direction of the electrophotographic photoconductor is 3% by mass or more to the content of the binder.

DETAILED DESCRIPTION OF THE INVENTION

Figure 1:
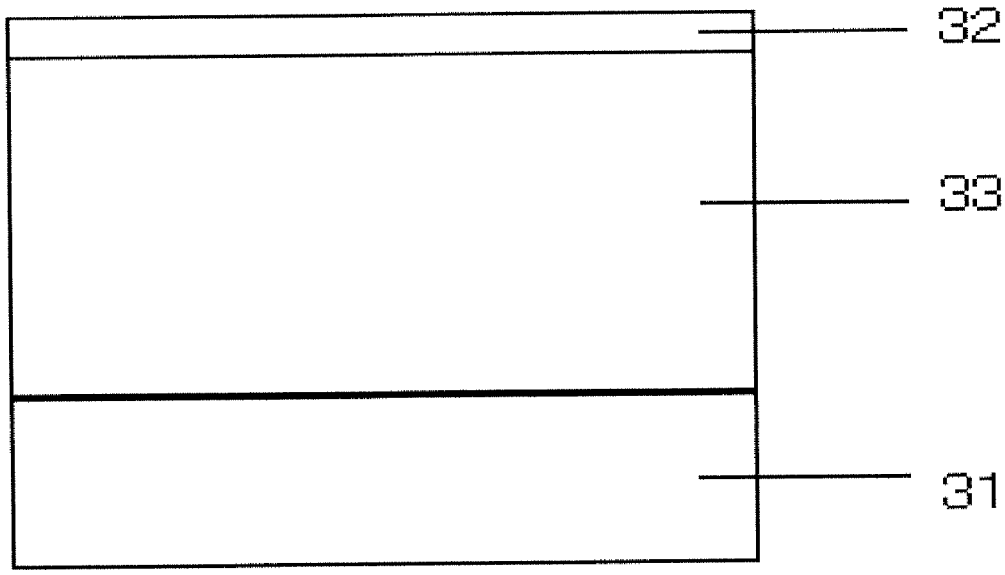
FIG. 1 is a cross-sectional view exemplarily showing a layer configuration according to one embodiment of the electrophotographic photoconductor of the present invention.

An embodiment of the electrophotographic photoconductor of the present invention will be described in detail with reference to drawings.

(Electrophotographic Photoconductor)

The electrophotographic photoconductor of the present invention has at least a photosensitive layer on a conductive substrate. The photosensitive layer may be formed in a single-layer structure or a multi-layer structure having two or more layers as long as the photosensitive layer has a charge generating function and a charge transporting function.

<Conductive Substrate>

For the conductive substrate, a substrate capable of exhibiting conductive property of a volume resistance of $10^{10}$ Ω·cm or less can be used, for example, a film or cylindrical plastic substrate prepared by depositing or sputtering a metal oxide or a paper sheet coated with such a metal oxide such as aluminum, nickel, chrome, NICHROME, copper, gold, silver and platinum; or a plate such as aluminum, aluminum alloy, nickel and stainless steel, and a tube prepared by extruding such a plate composed of aluminum, aluminum alloy, nickel and stainless steel and forming the plate into a tube by drawing process and subjecting it to a surface treatment such as cutting, superfinishing and polishing can be used. Further, an endless nickel belt and an endless stainless-steel belt disclosed in Japanese Patent Application Laid-Open (JP-A) No. 52-36016 can also be used as the conductive substrate.

Besides those mentioned above, the substrate coated with a dispersion in which a conductive powder dispersed in an appropriate binder resin can also be used as the conductive substrate in the present invention.

Examples of the conductive powder include carbon black, acetylene black; metal powder composed of aluminum, nickel, iron, NICHROME, copper, zinc, silver and the like; or metal oxide powder such as conductive tin oxide and ITO.

Examples of the binder resin used in combination with the conductive powder include thermoplastic resins, thermo-crosslinkable resins and photo-crosslinkable resins such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyacrylate resin, phenoxy resin, polycarbonate, cellulose acetate resin, ethyl cellulose resin, polyvinyl butyral, polyvinyl formal, polyvinyl toluene, poly-N-vinyl carbazole, acrylic resin, silicone resin, epoxy resin, melamine resin, urethane resin, phenol resin and alkyd resin.

Such a conductive layer can be formed by dispersing the conductive powder and the binder resin in an appropriate solvent such as tetrahydrofuran, dichloromethane, methylethylketone and toluene to prepare a coating solution and applying the coating solution over a surface of a substrate.

Further, a proper cylindrical base provided with a conductive layer on the surface thereof using a heat shrinkable tube in which the conductive powder is contained in a material such as polyvinyl chloride, polypropylene, polyester, polystyrene, polyvinylidene chloride, polyethylene, chlorinated rubber and polytetrafluoroethylene fluorine resin can also be preferably used as the conductive substrate.

<Photosensitive Layer>

Figure 2:
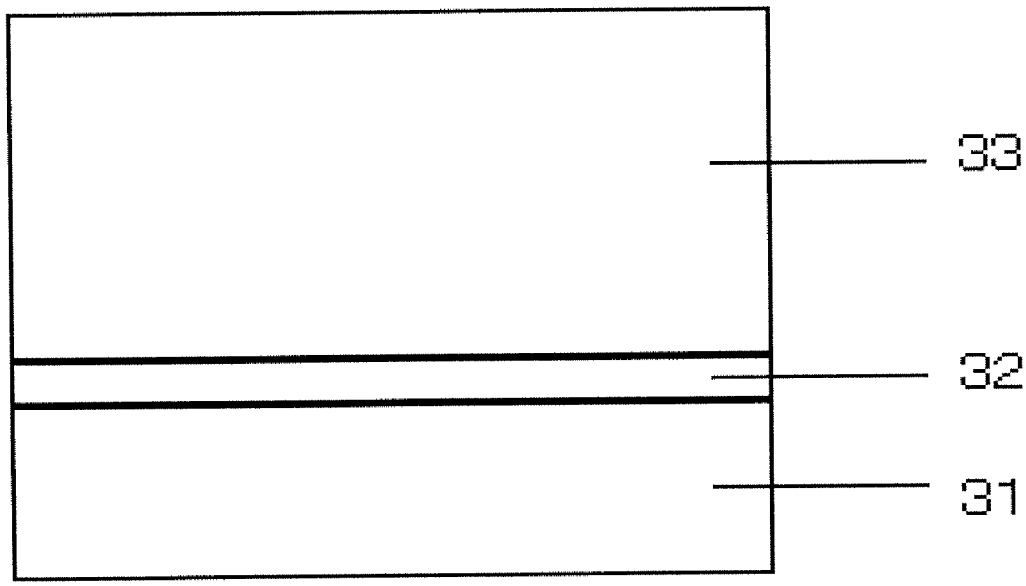
FIG. 2 is a cross-sectional view exemplarily showing a layer configuration according to another embodiment of the electrophotographic photoconductor of the present invention.
Figure 3:
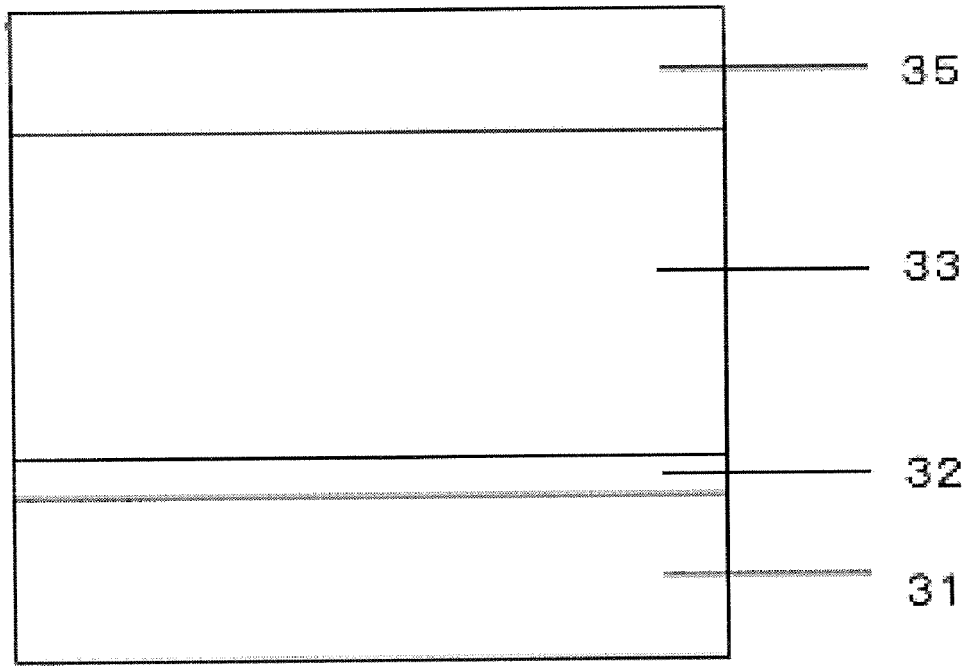
FIG. 3 is a cross-sectional view exemplarily showing a layer configuration according to still another embodiment of the electrophotographic photoconductor of the present invention.
Figure 4:
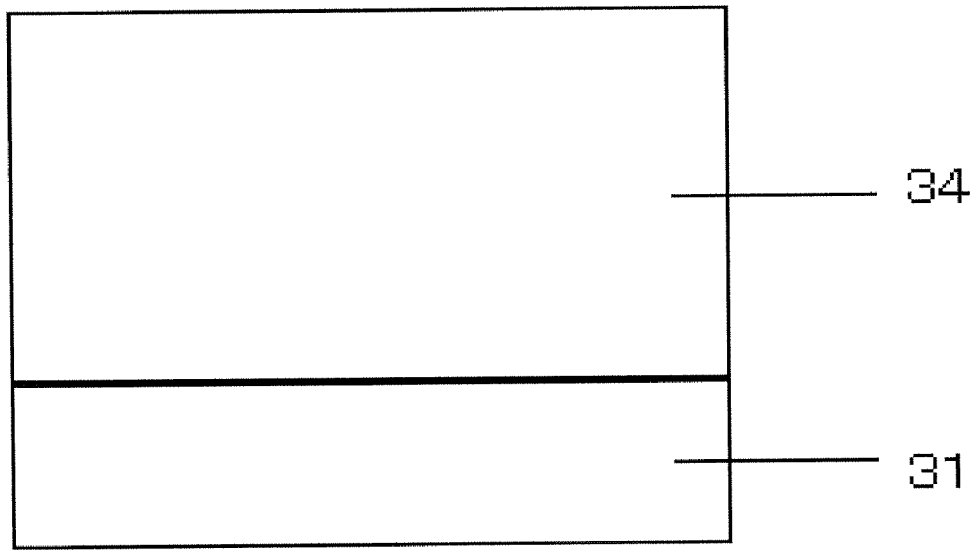
FIG. 4 is a cross-sectional view exemplarily showing a layer configuration according to still yet another embodiment of the electrophotographic photoconductor of the present invention.

FIGS. 1 to 4 are respectively a cross-sectional view showing a layer configuration of the electrophotographic photoconductor of the present invention. Specifically, FIGS. 1 to 3 respectively show a layer configuration of an electrophotographic photoconductor having a photosensitive layer formed with a plurality of functionally separated layers. FIG. 4 shows a layer configuration of an electrophotographic photoconductor having a photosensitive layer formed with a single layer.

<<Photosensitive Layer Formed in Laminate Structure>>

As shown in FIGS. 1 and 2, on a conductive substrate 31, a charge generating layer 32 containing a charge generating material having a charge generating function and a charge transporting layer 33 containing a charge transporting material having a charge transporting function are formed. When the photosensitive layer is formed into a laminate structure, the laminating order of the charge generating layer and the charge transporting layer to be laminated on the conductive substrate is not particularly limited and may be suitably selected in accordance with the intended use.

The individual layers independently assume the charge generating function and the charge transporting function and the layer configuration of the photosensitive layer takes a configuration in which at least a charge generating layer and a charge transporting layer are formed in a laminate structure on a conductive substrate. The laminating order is not particularly limited, however, most of charge generating materials are poor in chemical stability and when exposed to an acidic gas like an electric discharge product in the vicinity of a charger in an electrophotographic image process, charge generating efficiency is often degraded. For this reason, the charge transporting layer is preferably laminated on the charge generating layer.

[Charge Generating Layer]

The charge generating layer contains a charge generating material having a charge generating function and further contains a binder resin in accordance with necessity. For the charge generating material, an inorganic material and an organic material can be used.

Examples of the inorganic material include crystalline selenium, amorphous selenium, selenium-tellurium, selenium-tellurium-halogen, selenium-arsenic compound and amorphous silicon.

For the amorphous silicon, it is preferable to use an amorphous silicon that a dangling-bond is terminated with a hydrogen atom and/or a halogen atom or an amorphous silicon doped with a boron atom, a phosphorous atom, or the like.

In the meanwhile, for the organic material, conventional organic materials can be used. Examples thereof include phthalocyanine pigments such as metal phthalocyanine and metal-free phthalocyanine, azulenium salt pigments, squaric acid methyne pigments, azo pigments having a carbazole skeleton, azo pigments having a triarylamine skeleton, azo pigments having a diphenylamine skeleton, azo pigments having a fluorenone skeleton, azo pigments having an oxadiazole skeleton, azo pigments having a bisstilbene skeleton, azo pigments having a distyryl oxadiazole skeleton, azo pigments having a distyryl carbazole skeleton, perylene pigments, anthraquinone or polycyclic quinone pigments, quinone imine pigments, diphenylmethane and triphenylmethane pigments, benzoquinone and naphthoquinone pigments, cyanine and azomethine pigments, indigoid pigments and bisbenzimidazole pigments. Each of these charge generating materials may be used alone or in combination with two or more.

Examples of the binder resin include polyamide, polyurethane, epoxy resin, polyketone, polycarbonate, silicone resin, acrylic resin, polyvinyl butyral, polyvinyl formal, polyvinyl ketone, polystyrene, poly-N-vinylcarbazole, polyacrylamide, polyvinylbenzal, polyester, phenoxy resin, vinylchloride-vinylacetate copolymer, polyvinyl acetate, polyphenylene oxide, polyvinyl pyridine, cellulose resin, casein, polyvinyl alcohol and polyvinyl pyrrolidone. Each of these binder resins may be used alone or in combination with two or more.

The content of the binder resin is preferably 0 parts by mass to 500 parts by mass and more preferably 10 parts by mass to 300 parts by mass to 100 parts by mass of the charge generating material. The binder resin may be added before or after the dispersing process.

Methods for forming the charge generating layer can be broadly divided into vacuum thin-layer forming method and casting method using a solution dispersion.

For the vacuum thin-layer forming method, any one of vacuum evaporation method, glow discharge decomposition method, ion-plating method, sputtering method, reactive sputtering method and CVD method and the like is used, and by the vacuum thin-layer forming method, the organic materials and organic materials stated above can be preferably formed.

In the casting method, the inorganic or organic charge generating material is dispersed using a solvent such as tetrahydrofuran, dioxane, dioxolan, toluene, dichloromethane, monochlorobenzene, dichloroethane, cyclohexanone, cyclopentanon, anisole, xylene, methylethylketone, acetone, ethyl acetate and butyl acetate together with the binder resin when necessary in a ball mill, an attritor, a sand mill or a bead mill, the dispersion is appropriately diluted, and the dilution is applied over the surface of a conductive substrate or a charge transporting layer, thereby the charge generating layer can be formed.

Further, a leveling agent such as dimethyl silicone oil and methylphenyl silicone oil can be added in accordance with necessity. The coating may be carried out by immersion coating method, spray-coating method, bead coating method or ring coating method.

The layer thickness of the thus formed charge generating layer is typically around 0.01 μm to 5 μm and preferably 0.05 μm to 2 μm.

[Charge Transporting Layer]

The charge transporting layer is a layer having a charge transporting function and containing a charge transporting material and a binder.

The charge transporting material is divided into electron hole transporting materials and electron transporting materials.

Examples of the charge transporting material include electron hole transporting materials and electron transporting materials used for the surface layer of the electrophotographic photoconductor.

For the charge transporting material used for the surface layer, a compound having the charge transporting structure and having no polymerizable functional group can be primarily used. Further, a charge transporting material having a polymerizable functional group may be used in combination with the compound to improve adhesion property between the surface layer and the photosensitive layer.

For the charge transporting material used for the charge transporting layer, the compound having no polymerizable functional group may be used alone or may be used in combination with any one of another compound having no polymerizable functional group and a compound having a polymerizable compound.

Examples of the binder resin include thermoplastic or thermosetting resins such as polystyrene, styrene-acrylonitrile copolymer, styrene-butadiene copolymer, styrene-maleic anhydride copolymer, polyester, polyvinyl chloride, vinylchloride-vinyl acetate copolymer, polyvinyl acetate, polyvinylidene chloride, polyarylate resin, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenol resin and alkyl resin.

For the binder resin, it is possible to use a polymer charge transporting material having a charge transporting function, for example, polycarbonate having arylamine skeleton, a benzidine skeleton, a hydrozone skeleton, a carbazole skeleton, a stilbene skeleton or a pyrazoline skeleton; a polymer material such as polyester, polyurethane, polyether, polysiloxane and acrylic resin; and a polymer material having a polysilane skeleton, and these materials are useful.

The content of the charge transporting material is preferably 20 parts by mass to 300 parts by mass and more preferably 40 parts by mass to 150 parts by mass to 100 parts by mass of the binder. However, when a polymer charge transporting material is used, it may be used alone or in combination with a binder.

A solvent used for forming the charge transporting layer, tetrahydrofuran, dioxane, toluene, dichloromethane, monochlorobenzene, dichloroethane, cyclohexanon, methylethylketone and acetone and the like can be used. Each of these solvents may be used alone or in combination with two or more.

Further, a plasticizer and a leveling agent can also be added in accordance with necessity. For the plasticizer, those used as a plasticizer for typical resins such as dibutylphthalate and dioctylphthalate can be directly used and the used amount of the plasticizer is preferably around 0 parts by mass to 30 parts by mass to 100 parts by mass of the binder resin.

For the leveling agent, silicone oils such as dimethyl silicone oil, methyl phenyl silicone oil, a polymer or an oligomer having a perfluoroalkyl group on the side chains thereof can be used and the used amount thereof is preferably around 0 parts by mass to 1 part by mass to 100 parts by mass of the binder.

The thickness of the charge transporting layer is preferably 30 μm or less and more preferably 25 μm or less from the perspective of resolution and responsiveness. The lower limit value of the thickness of the charge transporting layer varies depending on the used system, particularly depending on charge potential, however, it is preferably 5 μm or more.

<<Photosensitive Layer Formed in Single Layer>>

As shown in FIG. 4, on a conductive substrate 31, a photosensitive layer 34 containing a charge generating material and a charge transporting material is formed.

A photosensitive layer formed in a single layer is a layer having a charge generating function as well as a charge transporting function. The photosensitive layer can be formed by dispersing a charge generating material, a charge transporting material and a binder in an appropriate solvent to prepare a coating solution, applying the coating solution over a surface of a conductive substrate and drying the applied coating solution. Further, a plasticizer, a leveling agent, an antioxidant and the like can be added in accordance with necessity.

For the binder, besides the binders described above for the charge transporting layer, any of the binders exemplified in the description for the charge generating layer may be mixed for use. The polymer charge transporting materials mentioned above can also be preferably used.

The content of the charge generating material is preferably 5 parts by mass to 40 parts by mass to 100 parts by mass of the binder.

The content of the charge transporting material is preferably 0 parts by mass to 190 parts by mass and more preferably 50 parts by mass to 150 parts by mass to 100 parts by mass of the binder.

The photosensitive layer can be formed by applying a coating solution in which the charge generating material and the binder resin are dispersed together with the charge transporting material in a solvent such as tetrahydrofuran, dioxane, dichloroethane and cyclohexane using a dispersing device over a surface of a conductive substrate by immersion coating method, spray coating method, bead coating method or ring coating method. The thickness of the photosensitive layer is preferably around 5 μm to 25 μm.

<Under-Coating Layer>

In the electrophotographic photoconductor of the present invention, an undercoat layer may be formed in between the conductive substrate and the photosensitive layer.

The undercoat layer generally contains a resin as the main component, however, in consideration that the undercoat layer is coated with the photosensitive layer using a solvent, it is preferable to use a resin having high resistance to typically used organic solvents.

Examples of such a resin include water-soluble resins such as polyvinyl alcohol, casein and sodium polyacrylate; alcohol soluble resins such as nylon copolymer and methoxymethylated nylon; and curable resins capable of forming a three-dimensional network structure such as polyurethane, melamine resin, phenol resin, alkyl-melamine resin and epoxy resin.

Further, to the undercoat layer, a fine powder pigment of a metal oxide exemplified by titanium oxide, silica, alumina, zirconium oxide, tin oxide and indium oxide can be added to prevent occurrence of moiré and reduce the residual potential, etc.

The undercoat layer can be formed by using an appropriating solvent and coating method as described in the photosensitive layer.

Further, for the undercoat layer used in the present invention, a silane coupling agent, a titanium coupling agent, a chrome coupling agent etc. can be used.

Besides the above, for the undercoat layer used in the present invention, it is preferable to use a layer formed by anodically-oxidizing $Al_2O_3$ or a layer formed using an organic material such as polyparaxylylene (parylene) and an inorganic material such as $SiO_2$, $SnO_2$, $TiO_2$, ITO and $CeO_2$ by vacuum thin-layer forming method. Besides the material described above, conventional undercoat layers can be used. The thickness of the undercoat layer is preferably 0 μm to 5 μm.

<Other Additives>

In the present invention, an antioxidant may be added to respective layers of the surface layer, a bonding layer, the photosensitive layer (in the case of a photosensitive layer formed in a laminate structure, at least the charge generating layer and the charge transporting layer), the undercoat layer and an intermediate layer for the purpose of improving resistance to environment, in particular, for the purpose of preventing reduction in photosensitivity and increase in residual potential.

For the antioxidant, the following are exemplified.

[Phenol Compound]

For phenol compounds, 2,6-di-t-butyl-p-cresol, butylated hydroxyanisol, 2,6-di-t-butyl-4-ethylphenol, stearyl-β-(3,5-di-t-butyl-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl) propionate]methane, bis[3,3'-bis(4'-hydroxy-3'-t-butylphenyl)butylic acid]glycol ester and tocopherols.

[Paraphenylene Diamines]

For paraphenylene diamines, N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine and N,N'-dimethyl-N,N'-di-t-butyl-p-phenylenediamine are exemplified.

[Hydroquinone]

For hydroquinones, 2,5-di-t-octylhydroquinone, 2,6-di-dodecylhydroquinone, 2-dodecylhydroquinone, 2-dodecyl-5-chlorohydroquinone, 2-t-octyl-5-methylhydroquinone and 2-(2-octadecenyl)-5-methylhydroquinone are exemplified.

[Organic Sulfur Compound]

For organic sulfur compounds, dilauryl-3,3'-thiodipropyonate, distearyl-3,3'-thiodipropyonate, ditetradecyl-3,3'-thiodipropyonate are exemplified.

[Organic Phosphorous Compound]

For organic phosphorous compounds, triphenyl phosphine, tri(nonylphenyl)phosphine, tri(dinonylphenyl)phosphine, tricresyl phosphine and tri(2,4-dibutylphenoxy)phosphine are exemplified.

These compounds are known as antioxidants for rubbers, plastics, fats and fatty oils and commercial products thereof are easily available.

In the present invention, the added amount of the antioxidant is 0.01 parts by mass to 10 parts by mass to the total mass of the layers to be added with the antioxidant.

<Surface Layer>

FIG. 3 is a cross-sectional view exemplarily showing a layer configuration according to still another embodiment of the electrophotographic photoconductor of the present invention.

As shown in FIG. 3, in the electrophotographic photoconductor of the present invention, a surface layer may be formed for the purpose of prolonging durable time of the electrophotographic photoconductor. For the surface layer, it is preferably formed of an organic material having a crosslinkable functional group that easily adheres to the photosensitive layer the photosensitive layer (hereinafter, the surface layer may be called "crosslinked surface layer").

For the organic material, radically polymerizable compounds having no charge transporting structure and radically polymerizable compounds having a charge transporting structure are exemplified.

<<Radically Polymerizable Compound Having No Charge Transporting Structure>>

The radically polymerizable compound having no charge transporting structure indicates a compound that has no electron hole transporting structure such as triarylamine, hydrazone, pyrazoline and carbazole and has no electron transporting structure such as condensation polycyclic quinone, diphenoquinone and electron aspirating aromatic ring having a cyano group or a nitro group, but has a radically polymerizable functional group. The radically polymerizable functional group is not particularly limited as long as it is a radically polymerizable group having a carbon-carbon double bond.

For the radically polymerizable functional group, for example, the following 1-substituted ethylene functional group and 1,1-substituted ethylene functional group are exemplified.

(1) For the 1-substituted ethylene functional group, for example, functional groups represented by the following General Formula (1) are exemplified.

$$CH_2{=}CH{-}X_1{-} \qquad \text{General Formula (1)}$$

[In the General Formula (1), $X_1$ represents a phenylene group that may have a substituent group, an allylene group such as a naphthylene group, an alkenylene group that may have a substituent, —CO— group, —COO— group, —CON($R_{10}$)— group ($R_{10}$ represents a hydrogen atom, an alkyl group such as a methyl group and an ethyl group, an aralkyl group such as a benzyl group, a naphthylmethyl group and a phenethyl group and an aryl group such as a phenyl group and a naphthyl group) or —S— group.]

Specific examples of the substituent group include vinyl group, styryl group, 2-methyl-1,3-butadienyl group, vinyl carbonyl group, acryloyloxy group, acryloylamide group and vinylthioether group.

(2) For the 1,1-substituted ethylene functional group, for example, functional groups represented by the following General Formula (2) are exemplified.

$$CH_2{=}C(Y){-}X_2{-} \qquad \text{General Formula (2)}$$

[In the General Formula (2), Y represents an alkyl group that may have a substituent group, an aralkyl group that may have a substituent group, a phenyl group that may have a substituent group, an aryl group such as a naphthyl group, a halogen atom, an alkoxy group such as a cyano group, a nitro group, a methoxy group or an ethoxy group, —$COOR_{11}$ group ($R_{11}$ represents an alkyl group such as a methyl group or an ethyl group that may have a substituent group, an aralkyl group such as a benzyl group and a phenethyl group that may have a substituent group, or an aryl group such as a phenyl group and a naphthyl group that may have a substituent group) or —$CONR_{12}R_{13}$ ($R_{12}$ and $R_{13}$ respectively represent a hydrogen atom, an alkyl group such as a methyl group or an ethyl group that may have a substituent group, an aralkyl group such as a benzyl group, a naphthyl group or a phenethyl group that may have a substituent group or an aryl group such as a phenyl group or a naphthyl group that may have a substituent group and $R_{12}$ and $R_{13}$ may be the same to each other or different from each other). Further, $X_2$ represents a substituent group that is the same substituent group the $X_1$ in the General Formula (1) has. However, at least any one of Y and $X_2$ is an oxycarbonyl group, a cyano group, an alkenylene group and an aromatic ring.]

Specific examples of these substituent groups include α-acryloyloxy chloride groups, methacryloyloxy groups, α-cyano ethylene groups, α-cyanoacryloyloxy groups, α-cyanophenylene groups and methacryloylamino groups.

For substituent groups that are further substituted by the substituent groups of $X_1$, $X_2$ and Y, for example, a halogen atom, alkyl groups such as nitro group, cyano group, methyl group and ethyl group, alkoxy groups such as methoxy group and ethoxy group, aryloxy groups such as phenoxy group, aryl groups such as phenyl group and naphthyl group and aralkyl groups such as benzyl group and phenethyl group.

Among these radically polymerizable functional groups, acryloyloxy group and methacryloyloxy group are particularly useful.

In the present invention, the number of functional groups of the radically polymerizable monomer is not particularly limited, however, to make the surface layer have frictional resistance, it is preferable to use a radically polymerizable monomer having at least one type or more and three or more radically polymerizable functional groups. When only a monofunctional and a bifunctional radically polymerizable monomer is used, a crosslinking bond in the crosslinked surface layer is sparse and a significant improvement in frictional resistance may be hardly achieved.

However, when only a trifunctional or more radically polymerizable monomer is used, reduction in surface smoothness caused by increased viscosity of the coating solution and defects such as occurrence of cracks caused by volume shrinkage at the time of curing reaction of the coating solution may occur. For the purpose of adjusting the viscosity of the coating solution, keeping the surface smoothness of the surface layer, preventing occurrence of cracks caused by crosslinking shrinkage and reducing the surface free energy, one or more monofunctional to bifunctional radically polymerizable monomers and radically polymerizable oligomers may be used in combination.

Examples of the radically polymerizable monomers include 2-ethylhexyl acrylate, 2-hydroxyethyl acrylate, 2-hydroxypropyl acrylate, tetrahydrofulfuryl acrylate, 2-ethylhexyl Carbitol acrylate, 3-methoxybutyl acrylate, benzyl acrylate, cyclohexyl acrylate, isoamyl acrylate, isobutyl acrylate, methoxytriethylene glycol acrylate, phenoxytetraethylene glycol acrylate, cetyl acrylate, isostearyl acrylate, stearyl acrylate, styrene monomer, 1,3-butanediol diacrylate, 1,4-butandiol diacrylate, 1,4-butandiol dimethacrylate, 1,6-hexanediol diacrylate, 1,6-hexanediol dimethacrylate, diethylene glycol diacrylate, neopentyl glycol diacrylate, EO-modified bisphenol a diacrylate, EO-modified bisphenol F diacrylate, neopentyl glycol diacrylate, trimethylol propane triacrylate (TMPTA), trimethylol propane trimethacrylate, trimethylol propane alkylene-modified triacrylate, trimethylol propane ethyleneoxy-modified (hereinafter may be referred to as "EO-modified") triacrylate, trimethylol propane propyleneoxy-modified (hereinafter may be referred to as "PO-modified") triacrylate, trimethylol propane caprolactone-modified triacrylate, trimethylol propane alkylene-modified trimethacrylate, pentaerythritol triacrylate, pentaerythritol tetraacrylate (PETTA), glycerol triacrylate, glycerol epichlorohydrin-modified (ECH-modified) triacrylate, glycerol EO-modified triacrylate, glycerol PO-modified triacrylate, glycerol EO-modified triacrylate, glycerol PO-modified triacrylate, tris(acryloxyethyl)isocyanurate, dipentaerythritol hexaacrylate (DPHA), dipentaerythritol caprolactone-modified hexaacrylate, dipentaerythritol hydroxypentaacrylate, alkylated dipentaerythritol pentaacrylate, alkylated dipentaerythritol tetraacrylate, alkylated dipentaerythritol triacrylate, dimethylol propane tetraacrylate (DTMPTA), pentaerythritolethoxy tetraacrylate, phosphoric acid EO-modified triacrylate and 2,2,5,5-tetrahydroxymethyl cyclopentanon tetraacrylate. In the present invention, the radically polymerizable monomers are not limited to the compounds described above.

<<Radically Polymerizable Compound Having Charge Transporting Structure>>

The radically polymerizable compound having a charge transporting structure indicates a compound having an electron hole transporting structure such as triarylamine, hydrozone, pyrazoline and carbazole or a charge transporting structure such as condensation polycyclic quinone, diphenoquinone and an electron aspirating aromatic ring having a cyano group or a nitro group and having a radically polymerizable functional group. The radically polymerizable functional group is not particularly limited as long as it is a radically polymerizable group having a carbon-carbon double bond.

For the radically polymerizable functional group, for example, the following 1-substituted ethylene functional group and 1,1-substituted ethylene functional group are exemplified.

For the 1-substituted ethylene functional group, for example, functional groups represented by the following General Formula (3) are exemplified.

$CH_2{=}CH{-}X_1{-}$ General Formula (3)

[In the General Formula (3), $X_1$ represents a phenylene group that may have a substituent group, an allylene group such as a naphthylene group, an alkenylene group that may have a substituent, —CO— group, —COO— group, —CON($R_{10}$)— group ($R_{10}$ represents a hydrogen atom, an alkyl group such as a methyl group and an ethyl group, an aralkyl group such as a benzyl group, a naphthylmethyl group and a phenethyl group and an aryl group such as a phenyl group and a naphthyl group) or —S— group.]

Specific examples of the substituent group include vinyl group, styryl group, 2-methyl-1,3-butadienyl group, vinyl carbonyl group, acryloyloxy group, acryloylamide group and vinylthioether group.

For the 1,1-substituted ethylene functional group, for example, functional groups represented by the following General Formula (2) are exemplified.

$CH_2{=}C(Y){-}X_2{-}$ General Formula (4)

[In the General Formula (4), Y represents an alkyl group that may have a substituent group, an aralkyl group that may have a substituent group, a phenyl group that may have a substituent group, an aryl group such as a naphthyl group, a halogen atom, an alkoxy group such as a cyano group, a nitro group, a methoxy group or an ethoxy group, —$COOR_{11}$ group ($R_{11}$ represents an alkyl group such as a methyl group or an ethyl group that may have a substituent group, an aralkyl group such as a benzyl group and a phenethyl group that may have a substituent group, or an aryl group such as a phenyl group and a naphthyl group that may have a substituent group) or —$CONR_{12}R_{13}$ ($R_{12}$ and $R_{13}$ respectively represent a hydrogen atom, an alkyl group such as a methyl group or an ethyl group that may have a substituent group, an aralkyl group such as a benzyl group, a naphthyl group or a phenethyl group that may have a substituent group or an aryl group such as a phenyl group or a naphthyl group that may have a substituent group and $R_{12}$ and $R_{13}$ may be the same to each other or different from each other). Further, $X_2$ represents a substituent group that is the same substituent group the $X_1$ in the General Formula (3) has. However, at least any one of Y and $X_2$ is an oxycarbonyl group, a cyano group, an alkenylene group and an aromatic ring.]

Specific examples of these substituent groups include α-acryloyloxy chloride groups, methacryloyloxy groups, α-cyano ethylene groups, α-cyanoacryloyloxy groups, α-cyanophenylene groups and methacryloylamino groups.

For substituent groups that are further substituted by the substituent groups of $X_1$, $X_2$ and Y, for example, a halogen atom, alkyl groups such as nitro group, cyano group, methyl group and ethyl group, alkoxy groups such as methoxy group and ethoxy group, aryloxy groups such as phenoxy group, aryl groups such as phenyl group and naphthyl group and aralkyl groups such as benzyl group and phenethyl group.

Among these radically polymerizable functional groups, acryloyloxy group and methacryloyloxy group are particularly useful. Further, to make the electrophotographic photoconductor have favorable electric properties for a long time, the number of functional groups of the radically polymerizable functional group is preferably 1 (one). When a bifunctional or more charge transporting compound is used as the main component, sites having a charge transporting structure are fixed by a plurality of bonds in the crosslinked structure, and thus the intermediate structure (cation radical) during transportation of charge cannot be stably held, thereby sensitivity degradation caused by charge trapping and an increase in residual potential easily occur. Degradation of electric properties may emerge as phenomena such as degradation of image density and thinned characters or letters.

For the charge transporting structure, effect of a triarylamine structure is high. When a compound represented by any one of the following General Formula (5) and General Formula (6) is used, electric properties such as sensitivity and residual potential can be favorably maintained.

General Formula (5)

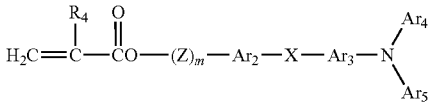

General Formula (6)

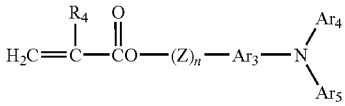

[In the General Formulas (5) and (6), $R_4$ represents a hydrogen atom, a halogen atom, an alkyl group that may have a substituent group, an aralkyl group that may have a substituent group, an aryl group that may have a substituent group, a cyano group, a nitro group, an alkoxy group or —$COOR_5$ ($R_5$ represents a hydrogen atom, an alkyl group that may have a substituent group, an aralkyl group that may have a substituent group or an aryl group that may have a substituent group), a halogenated carbonyl group or $CONR_6R_7$ ($R_6$ and $R_7$ respectively represents a hydrogen atom, a halogen atom, an alkyl group that may have a substituent group, an aralkyl group that may have a substituent group or an aryl group that may have a substituent group and $R_6$ and $R_7$ may be the same to each other or different from each other); $Ar_2$ and $Ar_3$ respectively represent a substituted or an unsubstituted allylene group and may be the same to each other or different from each other; $Ar_4$ and $Ar_5$ respectively represent a substituted or an unsubstituted aryl group and may be the same to each other or different from each other; X represents a single bond, substituted or an unsubstituted alkylene group, a substituted or an unsubstituted cycloalkylene group, a substituted or an unsubstituted alkylene ether group, an oxygen atom, a sulfur atom, or a vinylene group; Z represents a substituted or an unsubstituted alkylene group, a substituted or an unsubstituted alkylene ether group or alkylene oxycarbonyl group; and "m" and "n" are respectively an integer of 0 to 3.]

Specific examples of the substituent groups in the General Formulas (5) and (6) are as follows.

In the substituent groups of $R_4$ in the General Formulas (5) and (6), examples of alkyl group include methyl group, ethyl group, propyl group and butyl group, examples of aryl group include phenyl group and naphthyl group, and examples of aralkyl group include benzyl group, phenethyl group and naphthylmethyl group, examples of alkoxy group include methoxy group, ethoxy group and propoxy group. Note that each of these substituent groups may be substituted by a halogen atom, an alkyl group such as nitro group, cyano group, methyl group and ethyl group, an alkoxy group such as methoxy group and ethoxy group, an aryloxy group such as phenoxy group, an aryl group such as phenyl group and naphthyl group or an aralkyl group such as benzyl group and phenethyl group.

Among the substituent groups of $R_4$, a hydrogen atom and a methyl group are particularly preferable.

The substituted or unsubstituted $Ar_4$ and $Ar_5$ respectively an aryl group and examples of the aryl group include condensation polycyclic hydrocarbon groups, uncondensed cyclic hydrocarbon groups and heterocyclic groups are exemplified.

For the condensation polycyclic hydrocarbon group, it is preferable that the number of carbon atoms forming a ring is 18 or less, for example, pentanyl group, indenyl group, naphthyl group, azurenyl group, heptalenyl group, biphenylenyl group, as-indacenyl group, s-indacenyl group, fluorenyl group, acenaphthylenyl group, pleiadenyl group, acenaphthenyl group, phenalenyl group, phenanthoryl group, anthryl group, fluoranthenyl group, acephenanthrylenyl group, aceanthrylenyl group, triphenylenyl group, pyrenyl group, chrysenyl group and naphthacenyl group.

Examples of the uncondensed cyclic hydrocarbon group include monovalent groups of monocyclic hydrocarbon compounds such as benzene, diphenyl ether, polyethylenediphenyl ether, diphenylthioether and diphenyl sulfone, or monovalent groups of uncondensed polycyclic hydrocarbon compounds such as biphenyl, polyphenyl, diphenylalkane, diphenylalkene, diphenylalkyne, triphenyl methane, distyrylbenzene, 1,1-diphenylcycloalkane, polyphenylalkane and polyphenylalkene, or monovalent groups of ring aggregated hydrocarbon compounds such as 9,9-diphenyl fluorene.

Examples of the heterocyclic group include monovalent groups of carbazole, dibenzofuran, dibenzothiophene, oxadiazole and thiadiazole.

The aryl groups represented by the $Ar_4$ or $Ar_5$ may have the following substituent groups, for example.

(1) halogen atom, cyano group, nitro group, etc.

(2) alkyl group

The alkyl group is preferably a straight chain or branched alkyl group having $C_1$ to $C_{12}$ carbon atoms, more preferably a straight chain or branched alkyl group having $C_1$ to $C_8$ carbon atoms and still more preferably a straight chain or branched alkyl group having $C_1$ to $C_4$ carbon atoms. These alkyl groups may have a phenyl group that is further substituted by a fluorine atom, a hydroxyl group, a cyano group, an alkoxy group having $C_1$ to $C_4$ carbon atoms, a phenyl group or a halogen atom, an alkyl group having $C_1$ to $C_4$ carbon atoms or an alkoxy group having $C_1$ to $C_4$ carbon atoms.

Specific examples of the alkyl group include methyl group, ethyl group, n-butyl group, i-propyl group, t-butyl group, s-butyl group, n-propyl group, trifluoromethyl group, 2-hydroxyethyl group, 2-ethoxyethyl group, 2-cyanoethyl group, 2-methoxyethyl group, benzyl group, 4-chlorobenzyl group, 4-methylbenzyl group and 4-phenylbenzyl group.

(3) alkoxy group (—$OR_8$)

(in the formula stated above, $R_8$ represents any one of alkyl groups defined in (2) above.

Specific examples of the alkoxy group include methoxy group, ethoxy group, n-propoxy group, i-propoxy group, t-buthoxy group, n-buthoxy group, s-buthoxy group, i-buthoxy group, 2-hydroxyethoxy group, benzyloxy group and trifluoromethoxy group.

(4) aryloxy group

Examples of the aryl group include phenyl group and naphthyl group. The aryl group may contain an alkoxy group having $C_1$ to $C_4$ carbon atoms, an alkyl group having $C_1$ to $C_4$ carbon atoms or a halogen atom as a substituent group. Specific examples of the aryl group include phenoxy group, 1-naphthyloxy group, 2-naphthyloxy group, 4-methoxyphenoxy group and 4-methylphenoxy group.

(5) alkylmercapto group or arylmercapto group

Specific examples of the alkylmercapto group or arylmercapto group include methylthio group, ethylthio group, phenylthio group and p-methylphenylthio group.

(6) substituent groups represented by the following formula

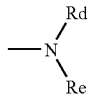

(In the formula, Rd and Re individually represent a hydrogen atom, an alkyl group or an aryl group defined in (2) above. Examples of the aryl group include phenyl group, biphenyl group or naphthyl group and each of these groups may contain an alkoxy group having $C_1$ to $C_4$ carbon atoms, an alkyl group having $C_1$ to $C_4$ carbon atoms or a halogen atom as a substituent group. Rd and Re may form a ring together.)

Specific examples thereof include amino group, diethylamino group, N-methyl-N-phenylamino group, N,N-diphenylamino group, N,N-di(tolyl)amino group, dibenzylamino group, piperidino group, morpholine group and pyrrolidino group.

(7) methylenedioxy group or alkylenedioxy group such as methylenedithio group or alkylenedithio group (8) substituted or unsubstituted styryl group, substituted or unsubstituted P-phenylstyryl group, diphenylaminophenyl group and ditolylaminophenyl group Examples of the allylene group represented by the $Ar_2$ or $Ar_3$ include divalent groups induced by the aryl group represented by $Ar_4$ or $Ar_5$.

The "X" represents a single bond, a substituted or an unsubstituted alkylene group, a substituted or an substituted cycloalkylene group, a substituted or an unsubstituted alkylene ether group, an oxygen atom, a sulfur atom or a vinylene group.

The substituted or unsubstituted alkylene group is a straight chain or branched alkylene group having $C_1$ to $C_{12}$ carbon atoms, preferably a straight chain or branched alkylene group having $C_1$ to $C_8$ carbon atoms and still more preferably a straight chain or branched alkylene group having $C_1$ to $C_4$ carbon atoms. These alkylene groups may have a phenyl group that is further substituted by a fluorine atom, a hydroxyl group, a cyano group, an alkoxy group having $C_1$ to $C_4$ carbon atoms, a phenyl group or a halogen atom, an alkyl group having $C_1$ to $C_4$ carbon atoms or an alkoxy group having $C_1$ to $C_4$ carbon atoms. Specific examples of the alkylene group include methyl group, ethyl group, n-butylene group, i-propylene group, t-butylene group, s-butylene group, n-propylene group, trifluoromethylene group, 2-hydroxyethylene group, 2-ethoxyethylene group, 2-cyanoethylene group, 2-methoxyethylene group, benzylidene group, phenylethylene group, 4-chlorophenylethylene group, 4-methylphenyethylene group and 4-biphenylethylene group.

The substituted or unsubstituted cycloalkylene group is a cyclic alkylene group having $C_5$ to $C_7$ carbon atoms and the cyclic alkylene group may have a fluorine atom, a hydroxyl group, an alkyl group having $C_1$ to $C_4$ carbon atoms or an alkoxy group having $C_1$ to $C_4$ carbon atoms. Specific examples thereof include cyclohexylidene group, cyclohexylidene group, cyclohexylene group and 3,3-dimethylcyclohexylidene group.

Examples of the substituted or unsubstituted alkylene ether group include alkyleneoxy groups such as ethyleneoxy group and propyleneoxy group, alkylenedioxy groups induced by ethyleneglycol and propylene glycol, di(oxyalkylene)oxy groups or poly(oxyalkylene)oxy groups induced by diethylene glycol, tetraethylene glycol or tripropylene glycol. The alkylene group of the alkylene ether group may have a substituent group such as hydroxy group, methyl group and ethyl group.

Examples of the vinylene group include substituent groups represented by the following general formula.

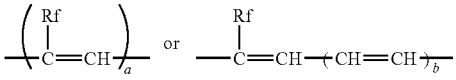

[In the above formulas, Rf represents a hydrogen atom, an alkyl group that is the same as the alkyl group defined in the alkyl group in (2) above or an aryl group that is the same as the aryl group represented by the $Ar_7$ or $Ar_8$; "a" is an integer of 1 or 2 and "b" is an integer of 1 to 3.]

The "Z" represents a substituted or an unsubstituted alkylene group, a substituted or an unsubstituted alkylene ether group or an alkylene oxycarbonyl group.

For the substituted or unsubstituted alkylene group, those similar to the alkylene groups described in the "X" are exemplified.

For the substituted or unsubstituted alkylene ether group, those similar to the alkylene ether group descried in the "X" are exemplified.

For the alkylene oxycarbonyl group, caprolactone-modified groups are exemplified.

Further, preferred examples of the radically polymerizable compound having a monofunctional charge transporting structure include compounds having a structure represented by the following General Formula (7).

General Formula (7)

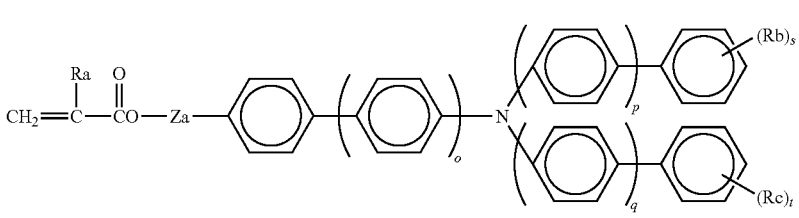

(In the General Formula (7), "o", "p" and "q" are respectively an integer of 0 or 1; Ra represents a hydrogen atom or a methyl group, Rb and Rc are respectively a substituent group other than hydrogen atom and represent an alkyl group having 1 to 6 carbon atoms, and when two or more alkyl groups reside, the alkyl groups may be different from each other, "s" and "t" are respectively an integer of 0 to 3; and Za represents a single bond, a methylene group or an ethylene group.)

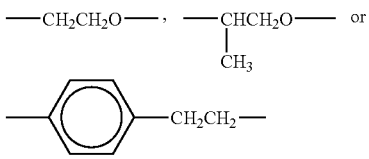

For the compound represented by the General Formula (7), a compound having a methyl group and an ethyl group as substituent groups of Rb and Rc is particularly preferable.

Since the radically polymerizable compound having a monofunctional charge transporting structure represented by the General Formula (5), General Formula (6) or in particular by the General Formula (7) used in the present invention is polymerized in a state where a carbon-carbon double bond is opened up at the both sides, the radically polymerizable compound having a monofunctional charge transporting structure does not have an end structure and is incorporated in to a linked polymer. In a polymer crosslink-formed by polymerization with a radically polymerizable monomer having no charge transporting structure, the radically polymerizable compound having a monofunctional charge transporting structure exists in the main chain of the polymer and exists in the crosslinked chain between the main chains (crosslinked chain includes an intermolecular crosslinked chain between a polymer and another polymer and an intramolecular crosslinked chain wherein a portion having a folded main chain in a polymer molecule and another portion originally from the monomer, which is polymerized with a position apart therefrom in the main chain are polymerized). Even when the compound is present in a main chain or a crosslinked chain, a triarylamine structure suspending from the chain sites has at least three aryl groups radially located from a nitrogen atom, it is not directly bonded with the chain and suspends through a carbonyl group or the like. This becomes sterically and flexibly fixed, although bulky. The triarylamine structures can be spatially located so as to be moderately adjacent to one another in a polymer, and have less structural distortion in a molecule. Therefore, it is presumed that the radically polymerizable compound having a monofunctional charge transporting structure used in a surface layer of an electrophotographic photoreceptor can have an intramolecular structure to prevent blocking of a charge transport route.

Specific examples of the radically polymerizable compound having a monofunctional charge transporting structure of the present invention are described below, however, the radically polymerizable compound having a monofunctional charge transporting structure is not limited to the compounds having any of these structures.

No. 1

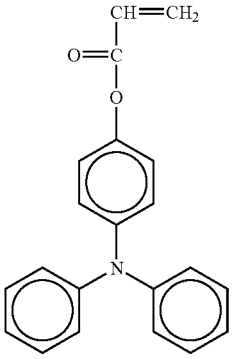

No. 2

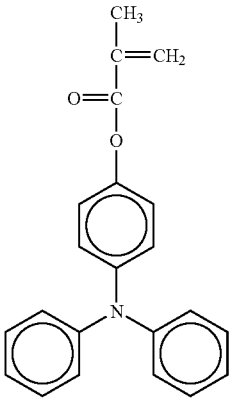

No. 3

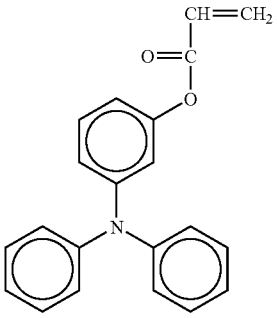

-continued

No. 4

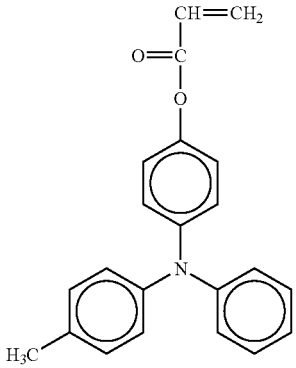

No.5

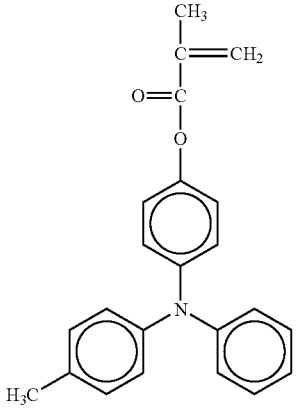

No. 6

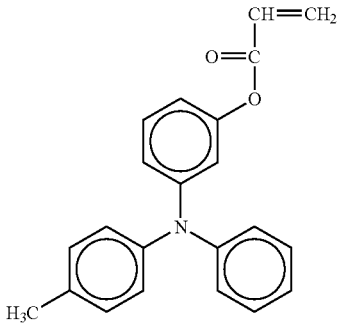

No. 7

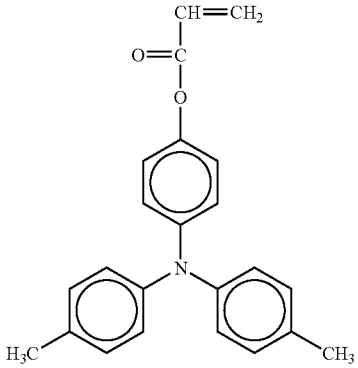

-continued
No. 8
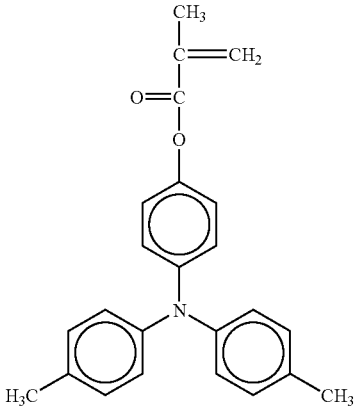
No. 9
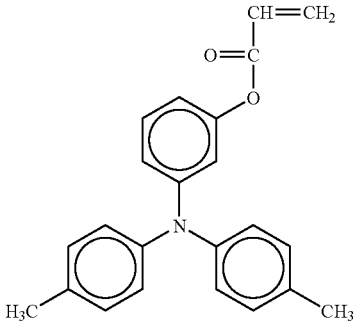
No. 10
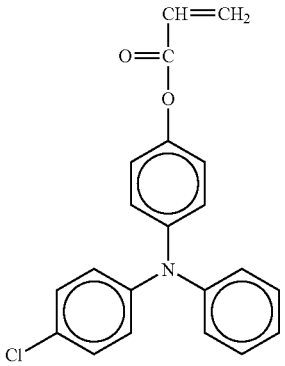
No. 11
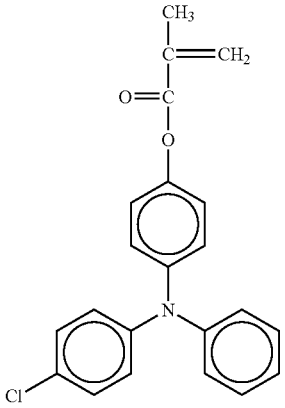
-continued
No. 12
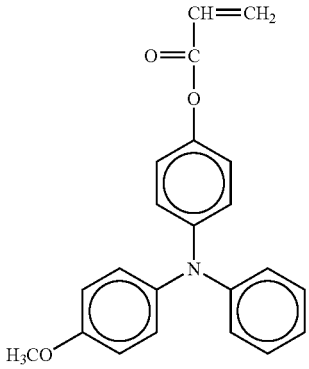
No. 13
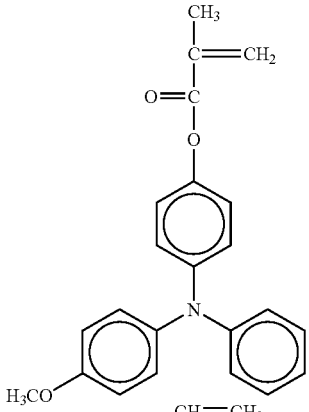
No. 14
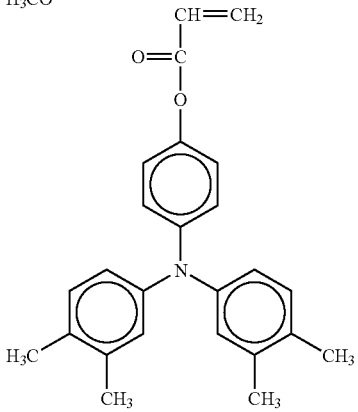
No. 15
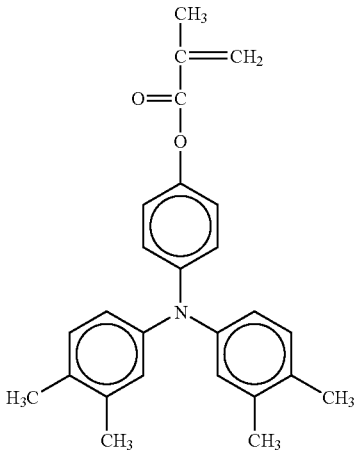

-continued
No. 16
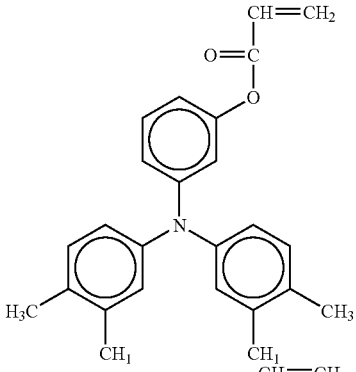
No. 17
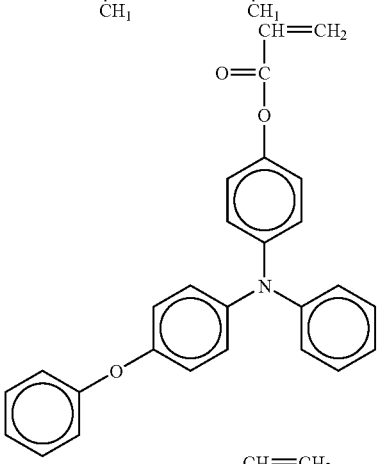
No. 18
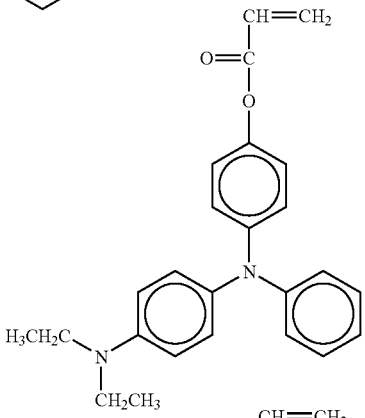
No. 19
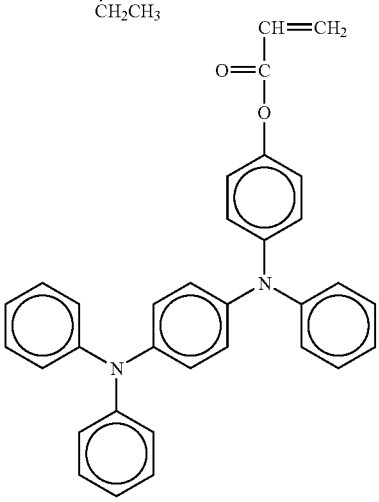
-continued
No. 20
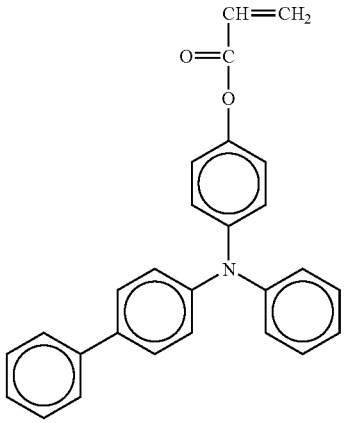
No. 21
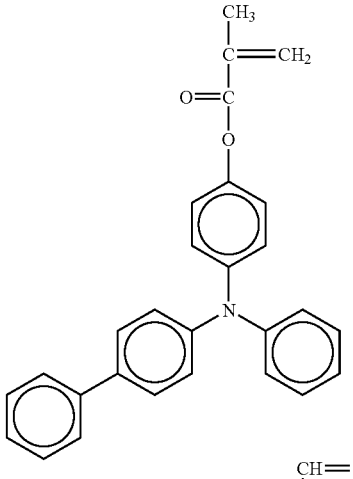
No. 22
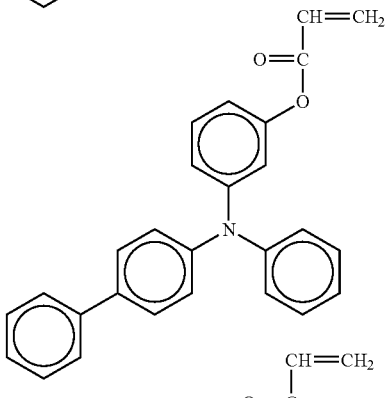
No. 23
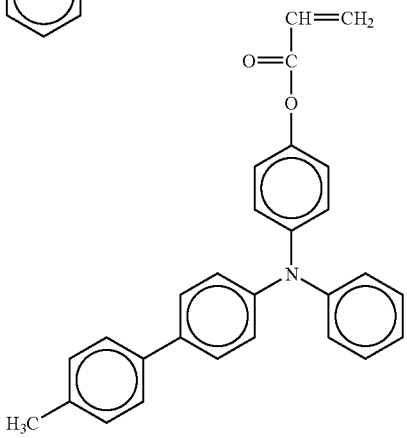

-continued
No. 24
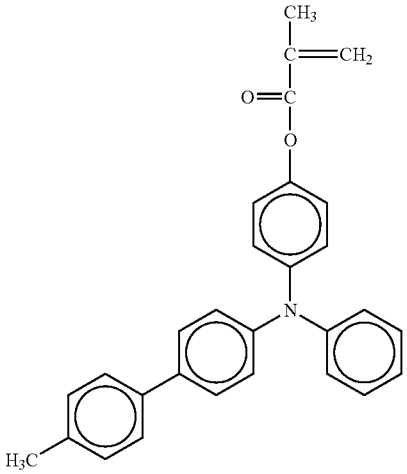
No. 25
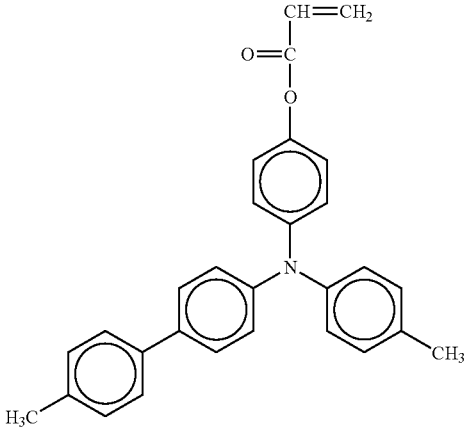
No. 26
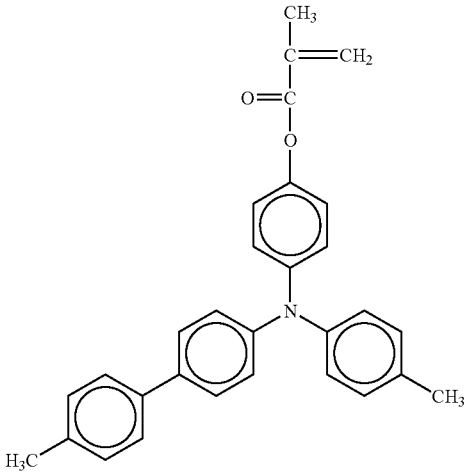
-continued
No. 27
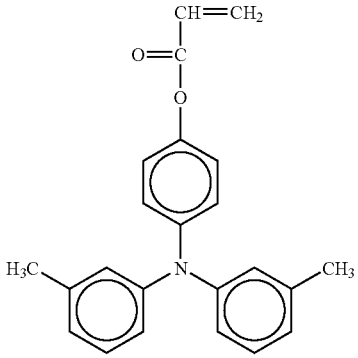
No. 28
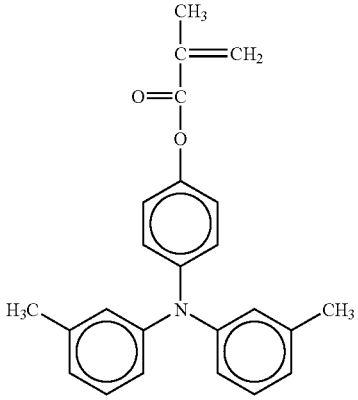
No. 29
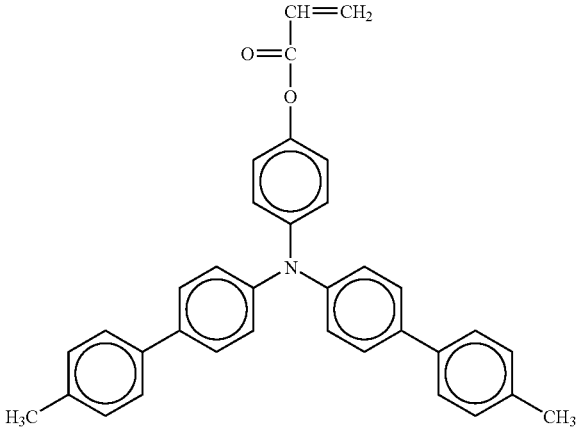
No. 30
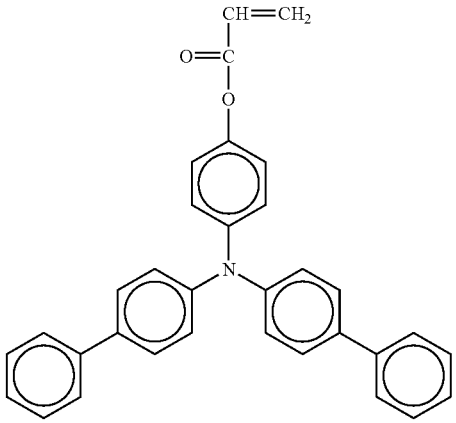

-continued
No. 31
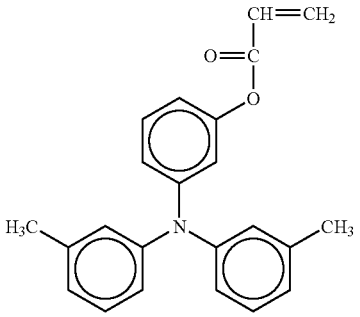
No. 32
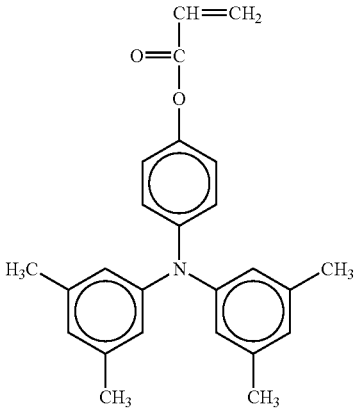
No. 33
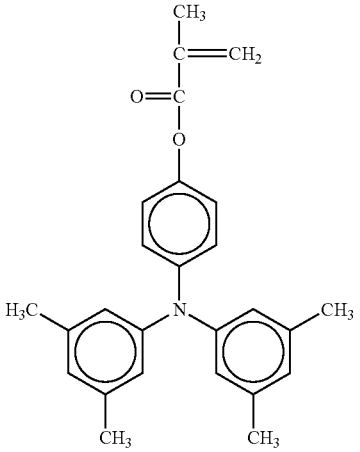
No. 34
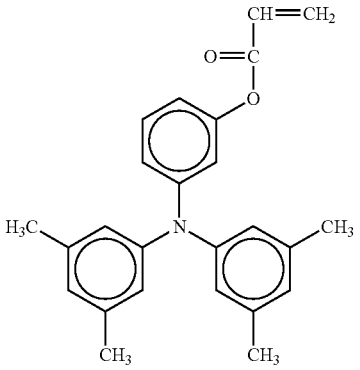
-continued
No. 35
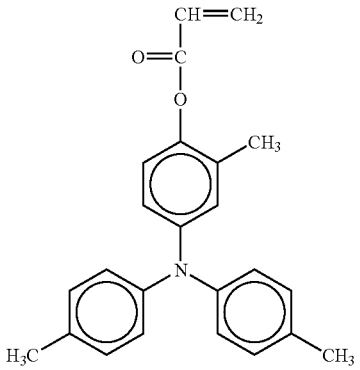
No. 36
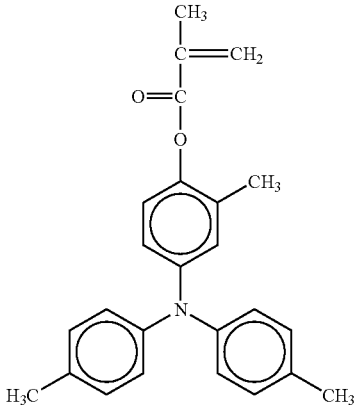
No. 37
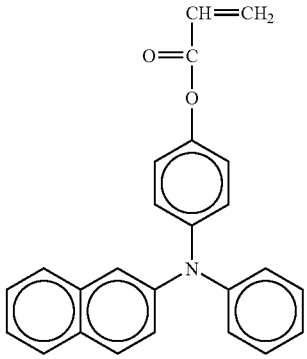
No. 38
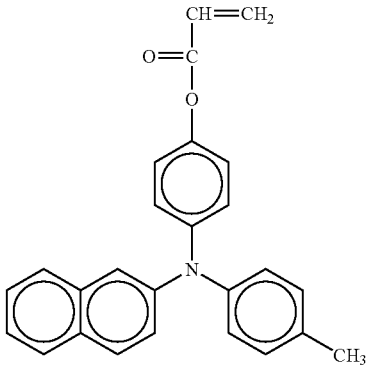

-continued
No. 39
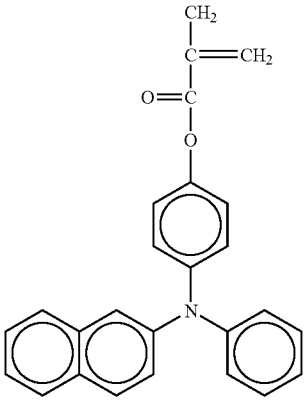
No. 40
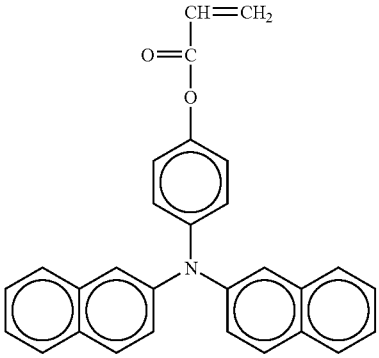
No. 41
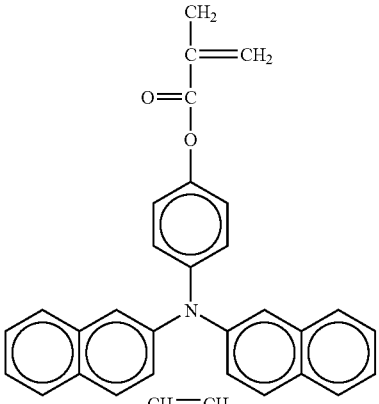
No. 42
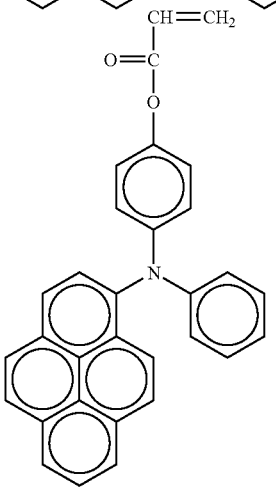
-continued
No. 43
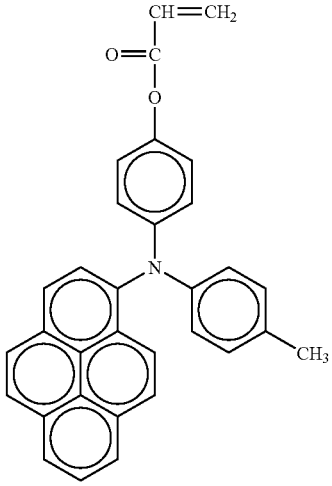
No. 44
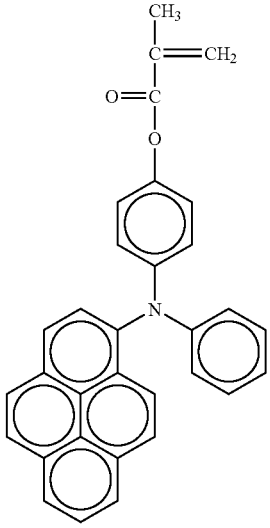
No. 45
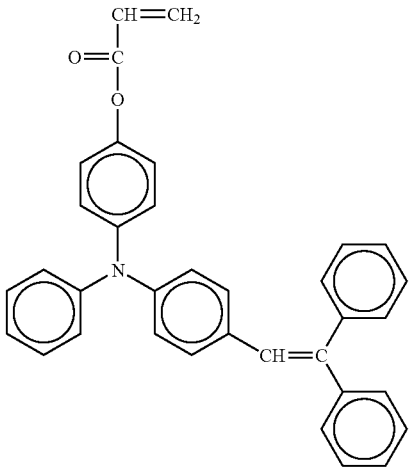

-continued
No. 46
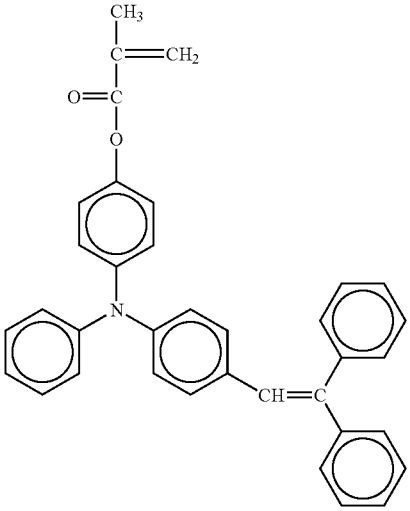
No. 47
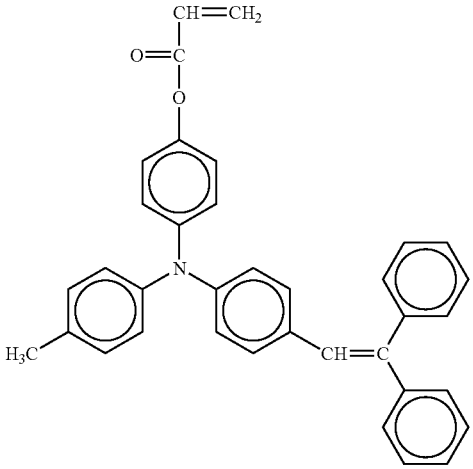
No. 48
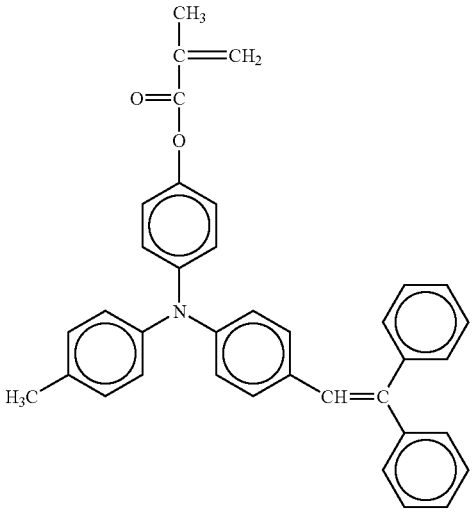
-continued
No. 49
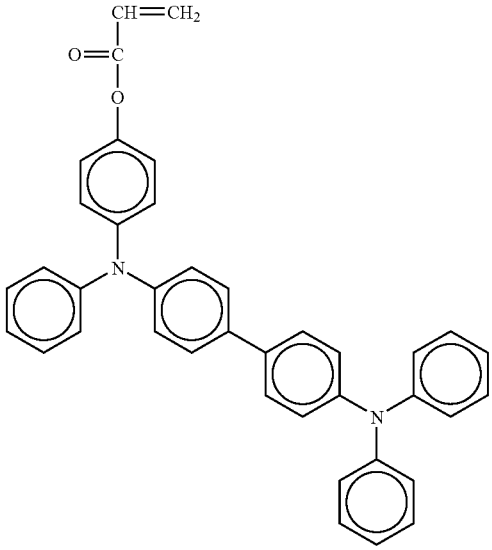
No. 50
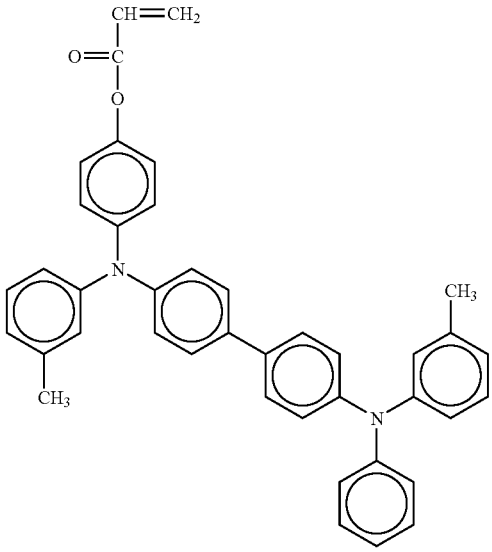
No. 51
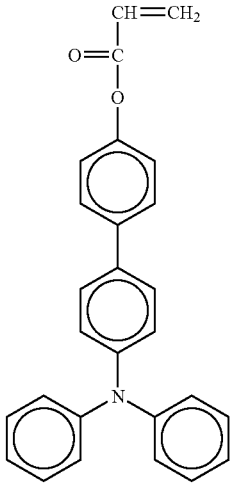

-continued
No. 52
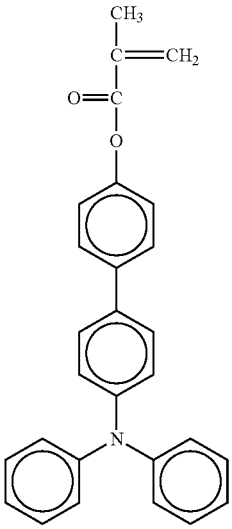
No. 53
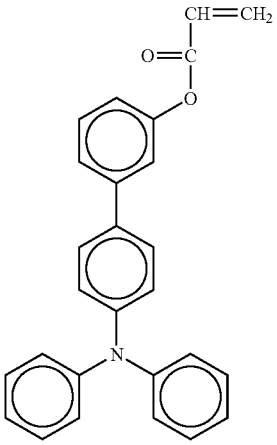
No. 54
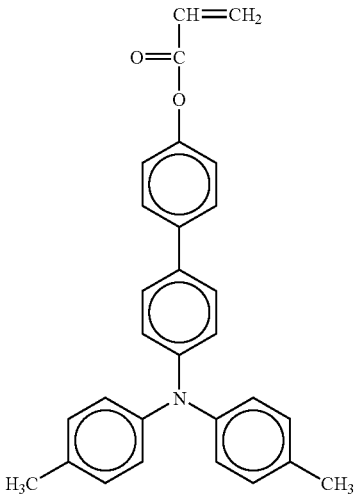
-continued
No. 55
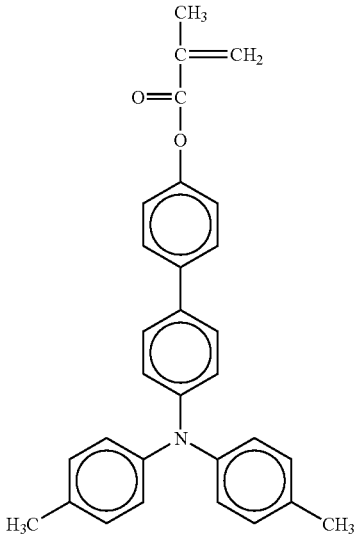
No. 56
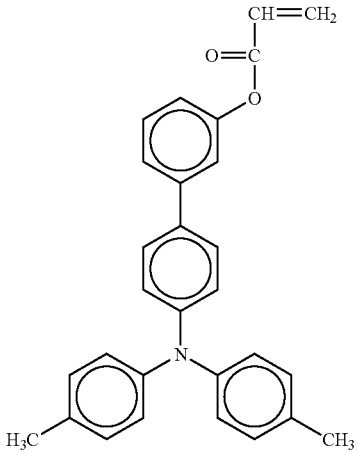
No. 57
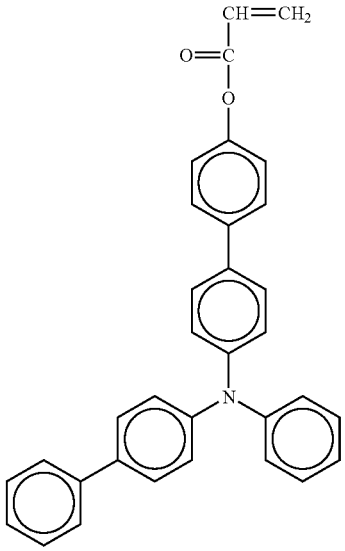

-continued
No. 58
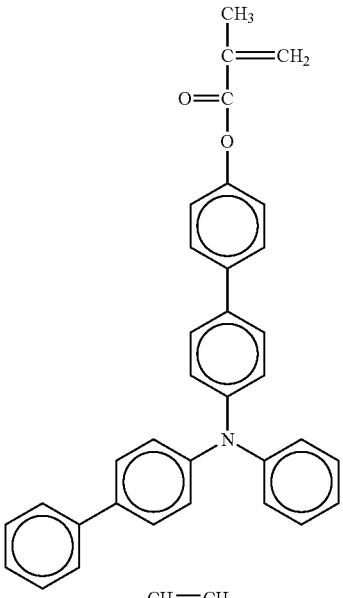
No. 59
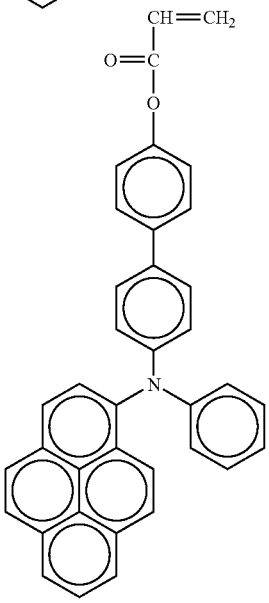
No. 60
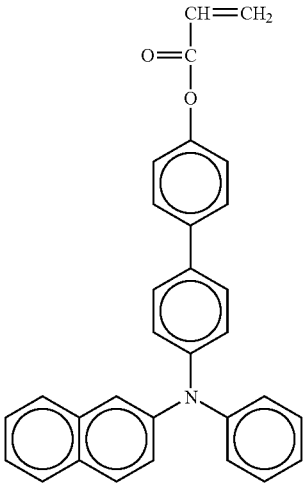
-continued
No. 61
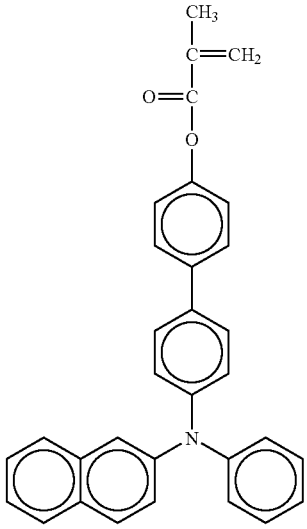
No. 62
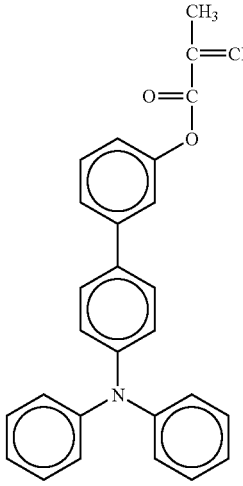
No. 63
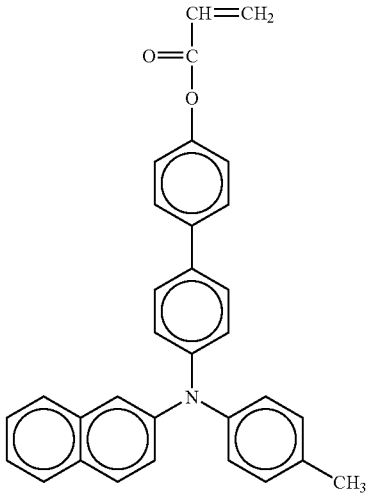

-continued
No. 64
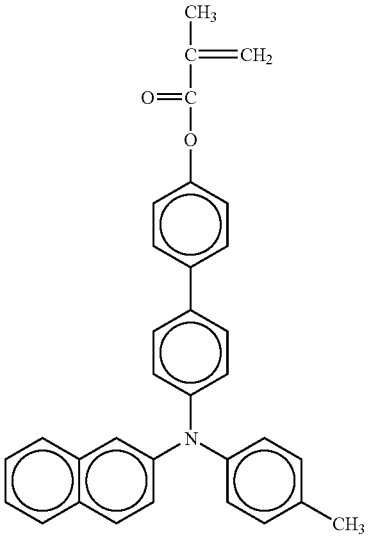
No. 65
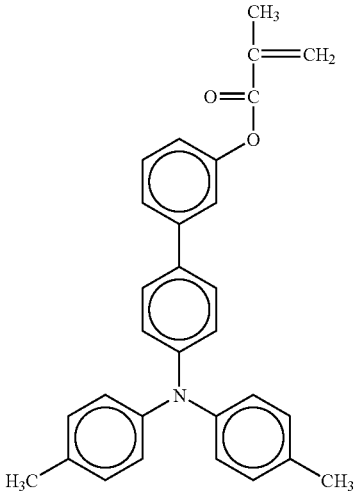
No. 66
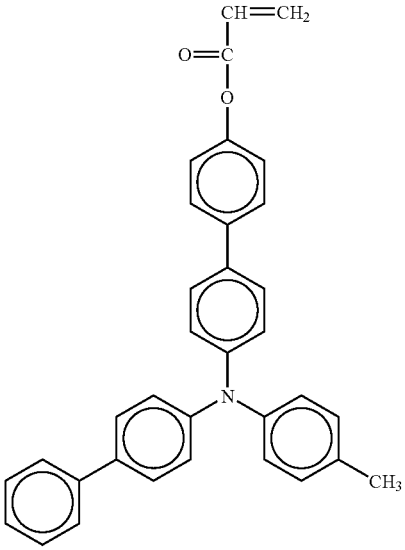
-continued
No. 67
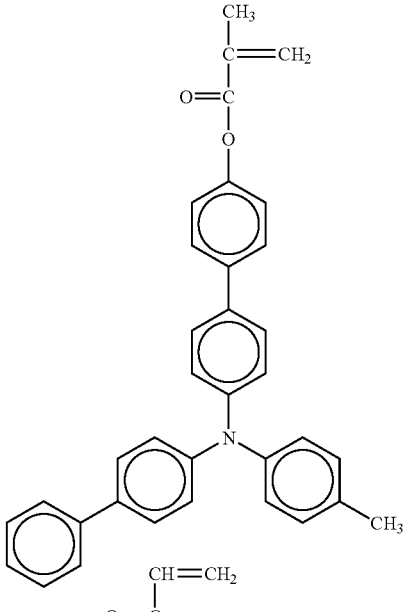
No. 68
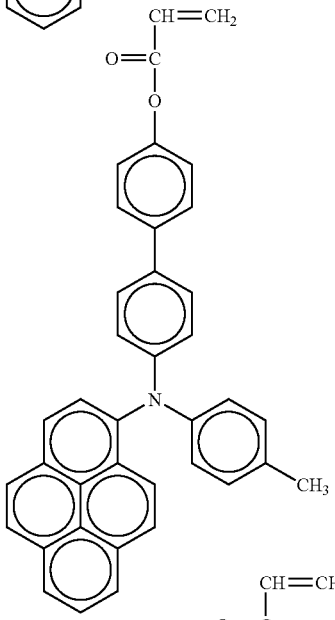
No. 69
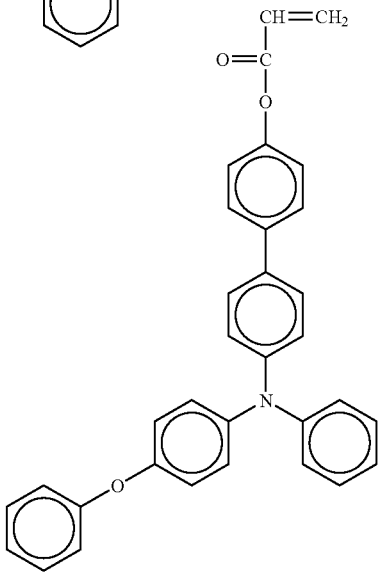

-continued
No. 70
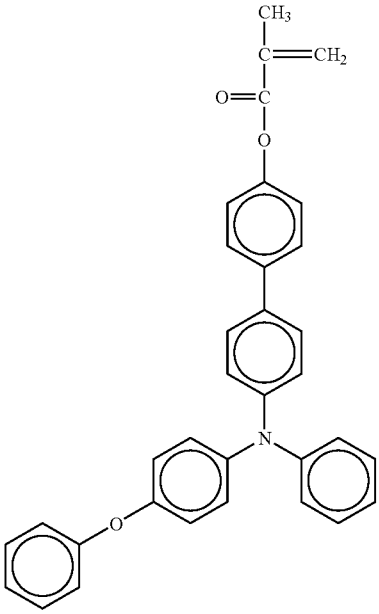
No. 71
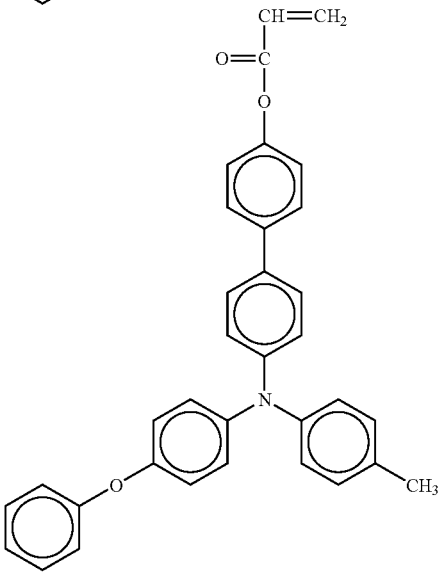
No. 72
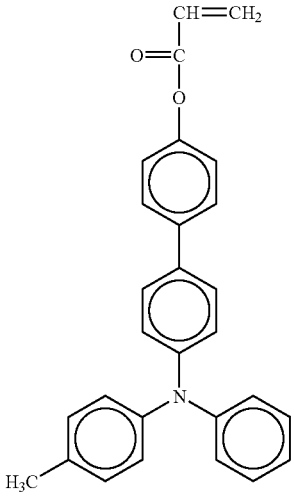
-continued
No. 73
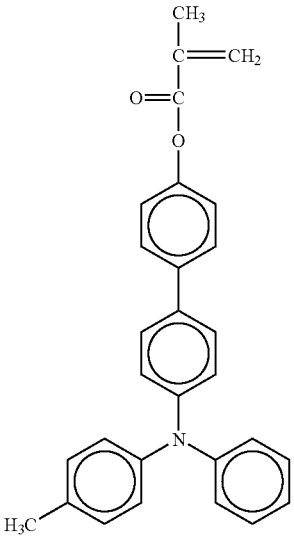
No. 74
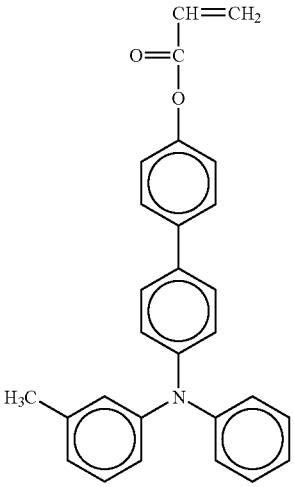
No. 75
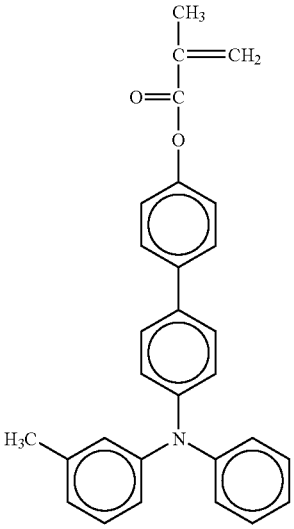

-continued
No. 76
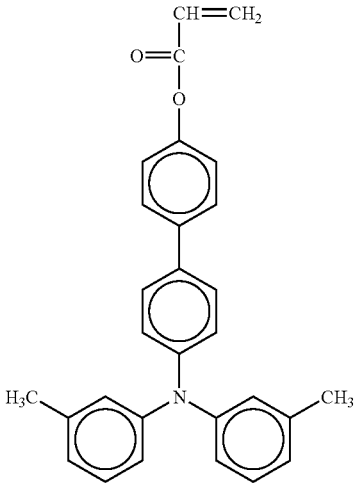
No. 77
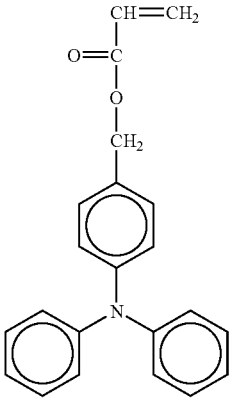
No. 78
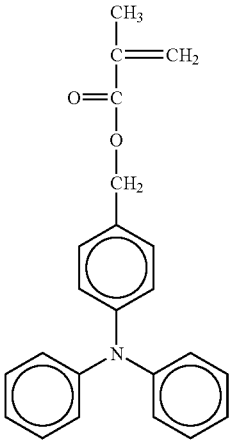
-continued
No. 79
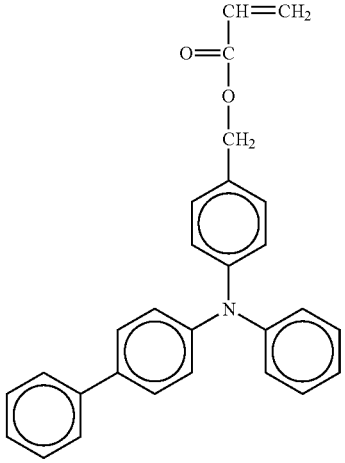
No. 80
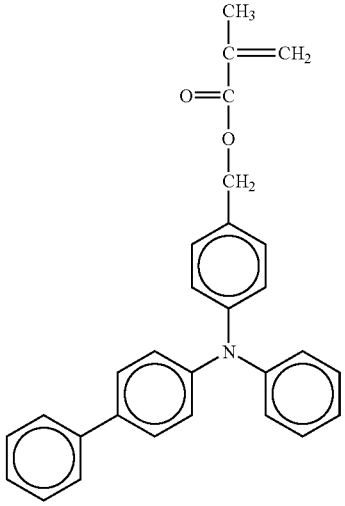
No. 81
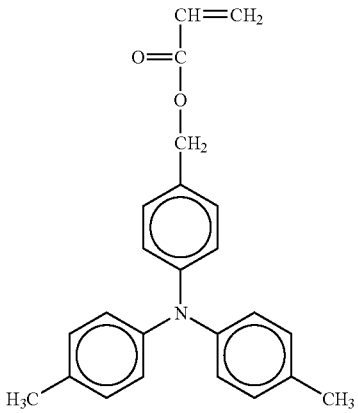

-continued
No. 82
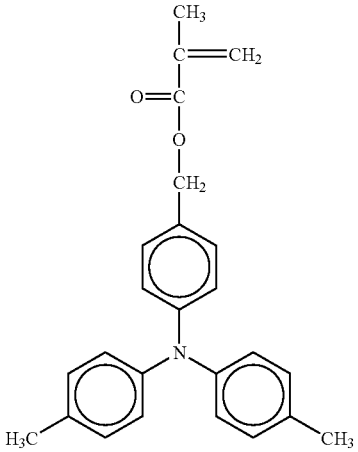
No. 83
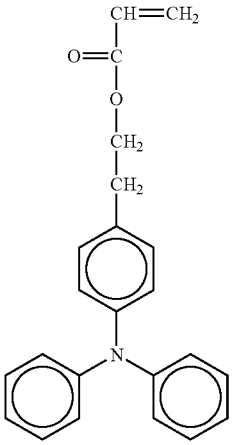
No. 84
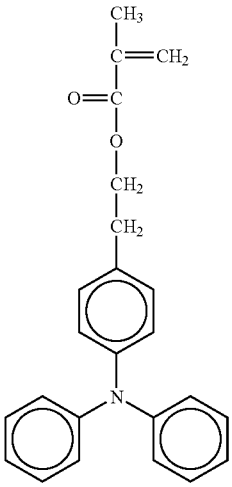
-continued
No. 85
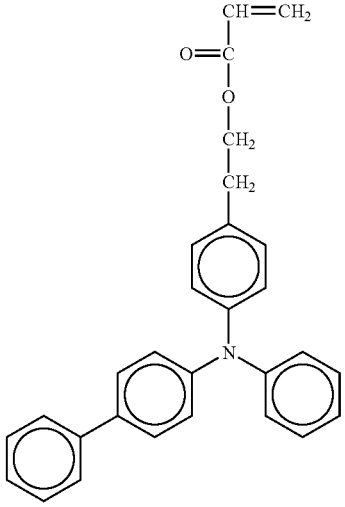
No. 86
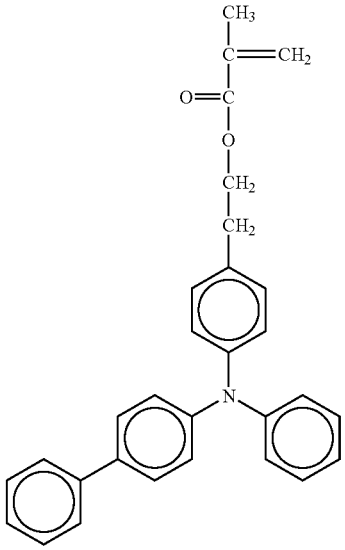
No. 87
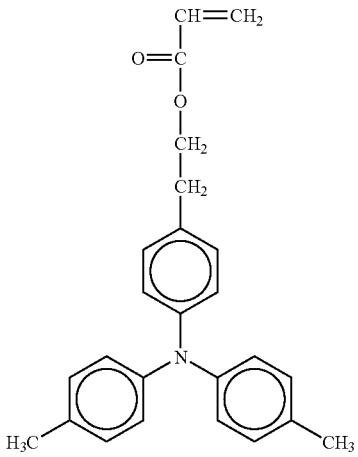

-continued
No. 88
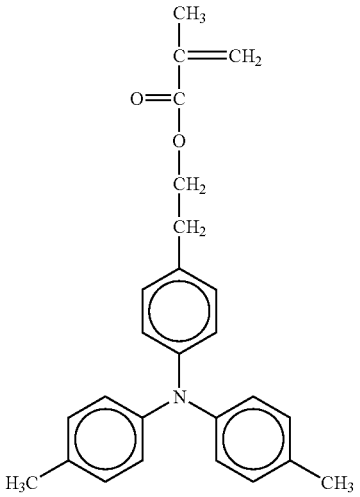
No. 89
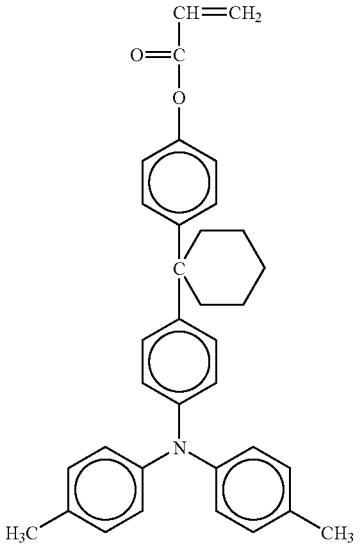
No. 90
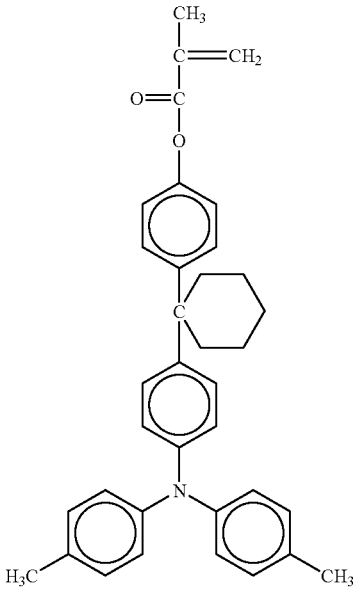
-continued
No. 91
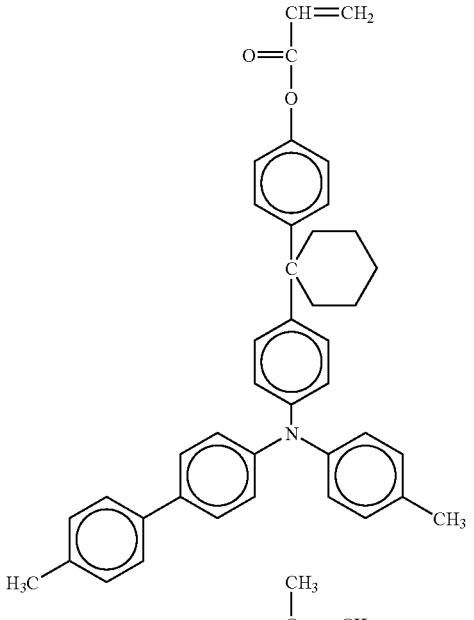
No. 92
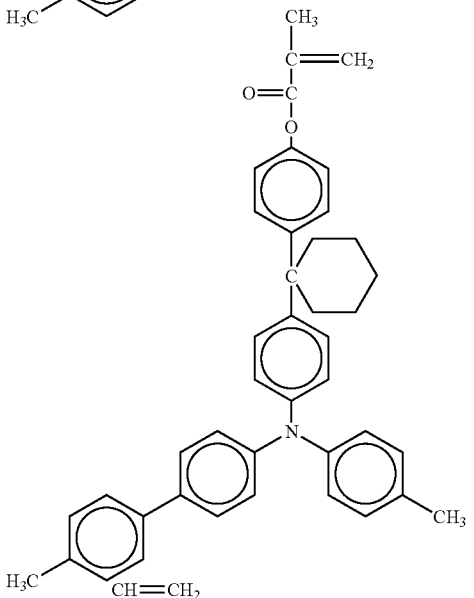
No. 93
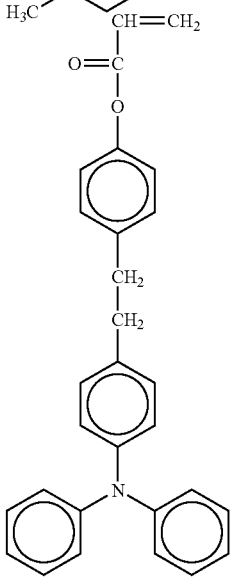

-continued
No. 94
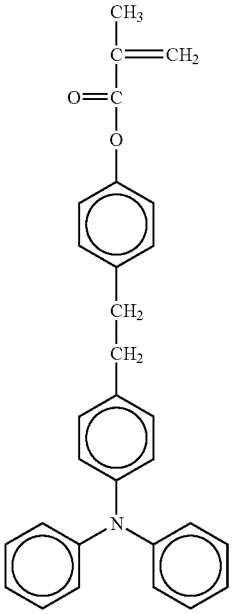
No. 95
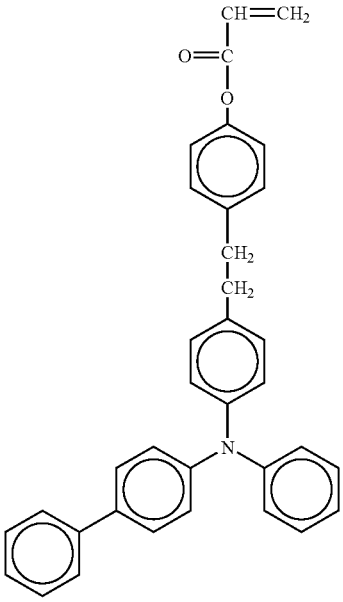
-continued
No. 96
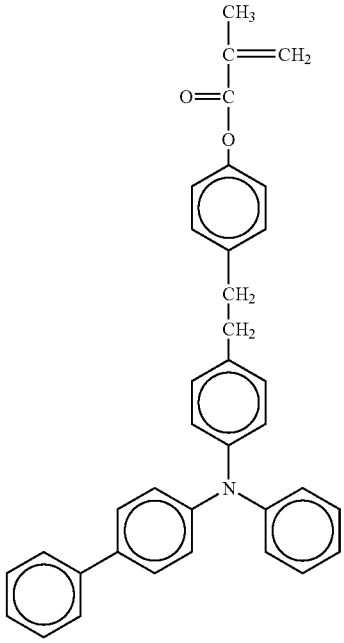
No. 97
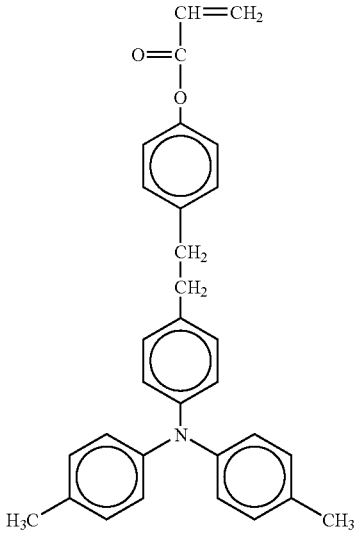

-continued
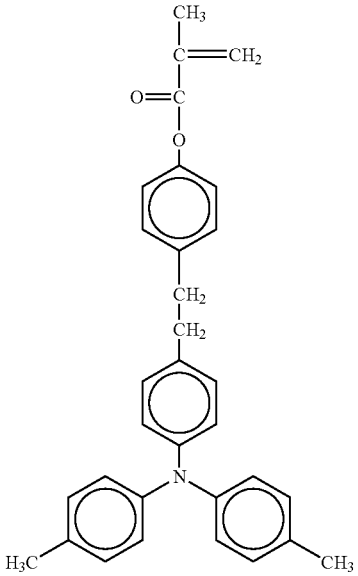
No. 99
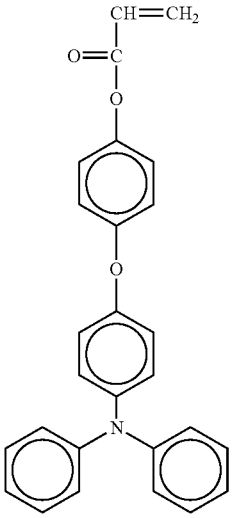
No. 100
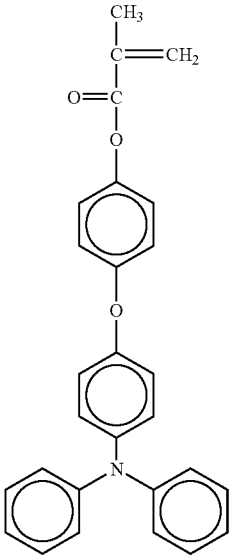
-continued
No. 101
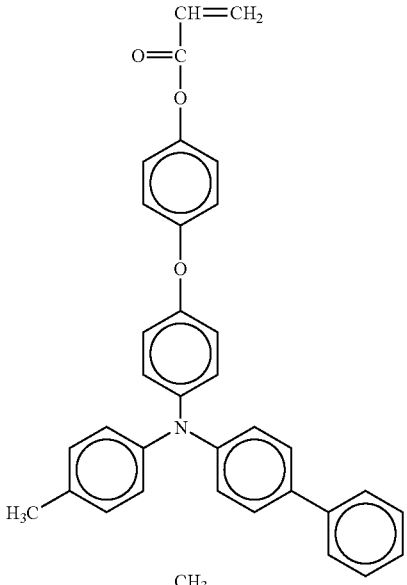
No. 102
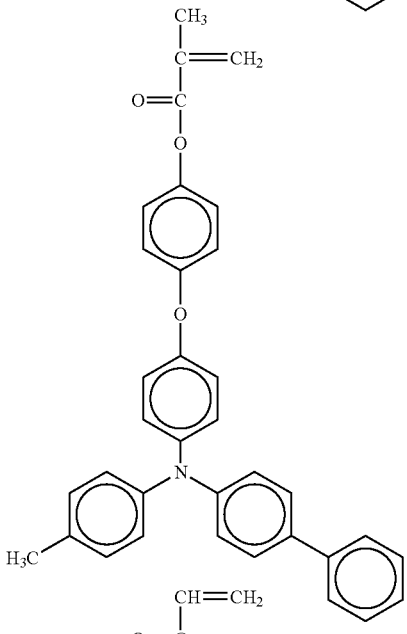
No. 103
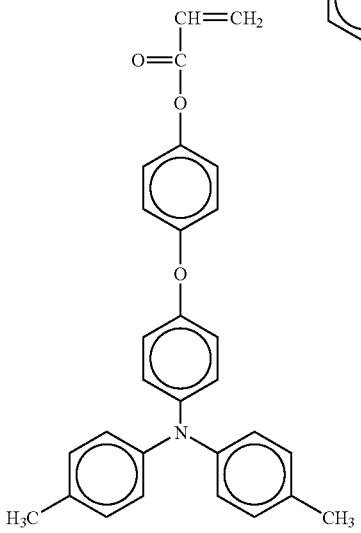

-continued
No. 104
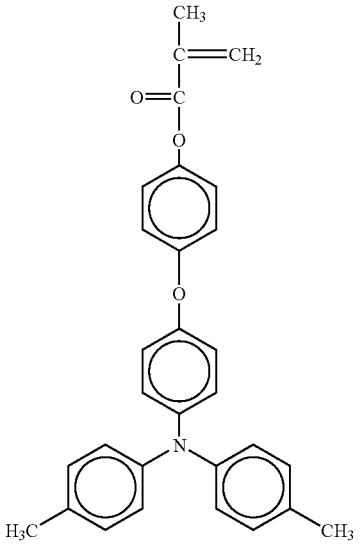
No. 105
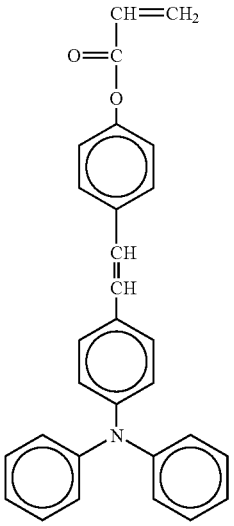
No. 106
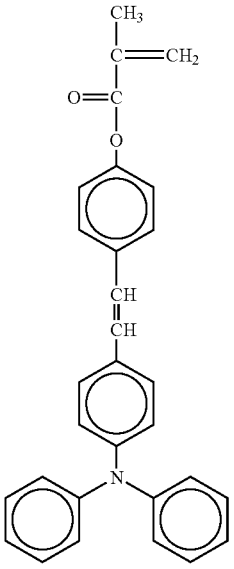
-continued
No. 107
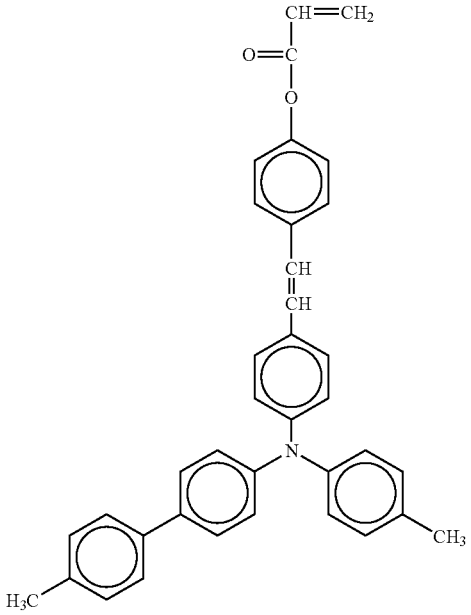
No. 108
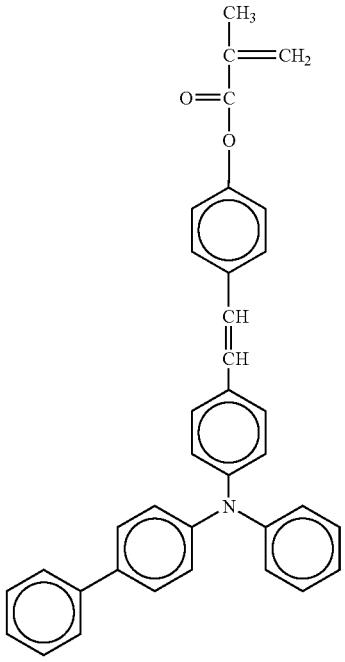

-continued
No. 109
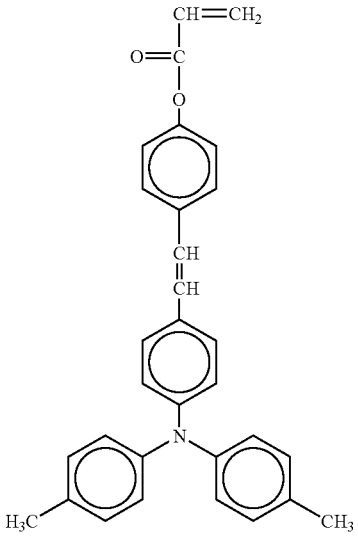
No. 110
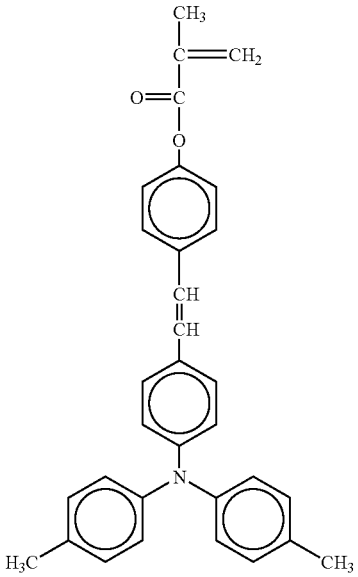
No. 111
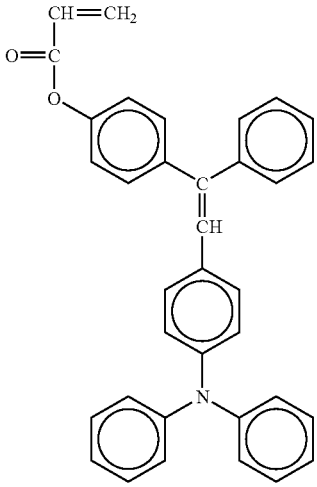
-continued
No. 112
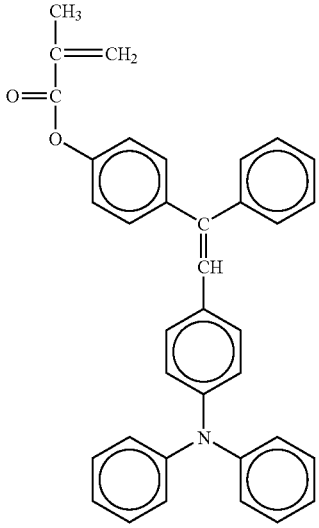
No. 113
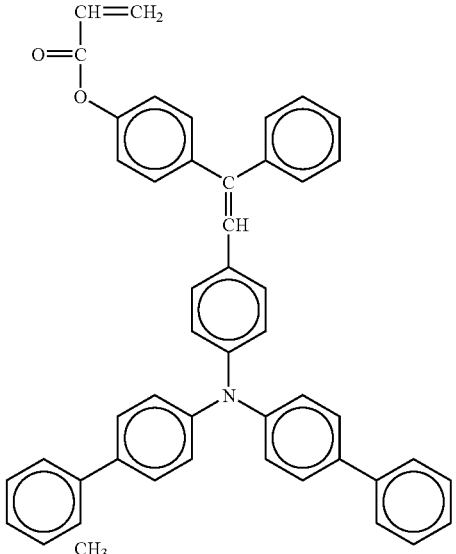
No. 114
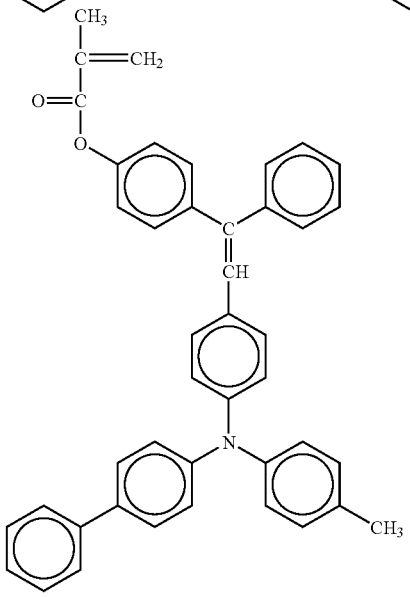

-continued
No. 115
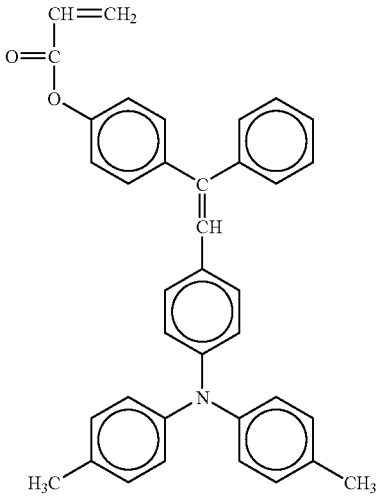
No. 116
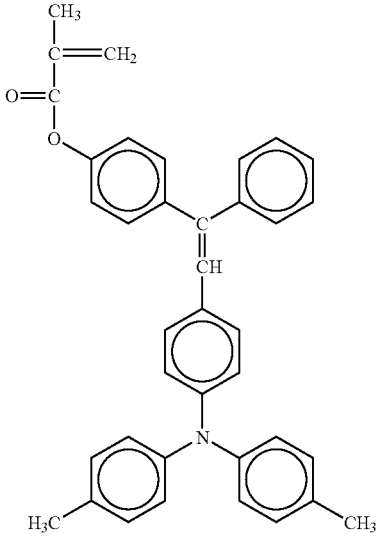
No. 117
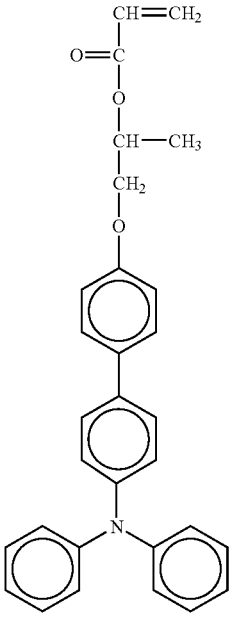
-continued
No. 118
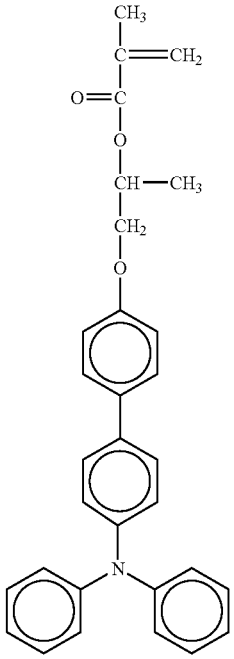
No. 119
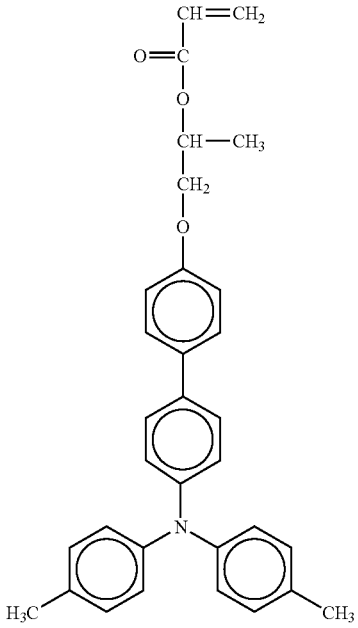

-continued
No. 120
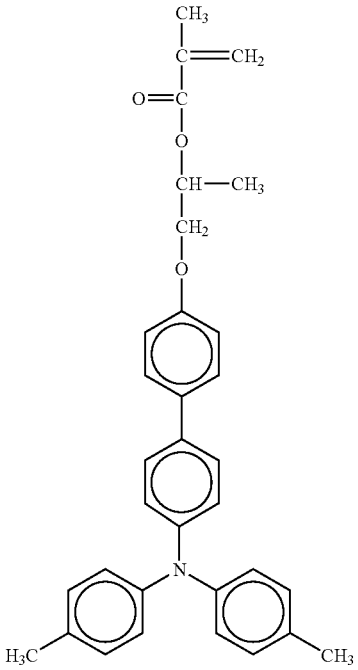
No. 121
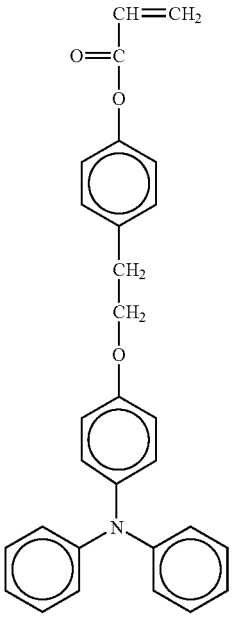
-continued
No.122
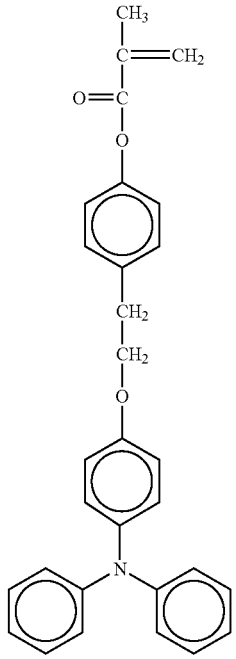
No. 123
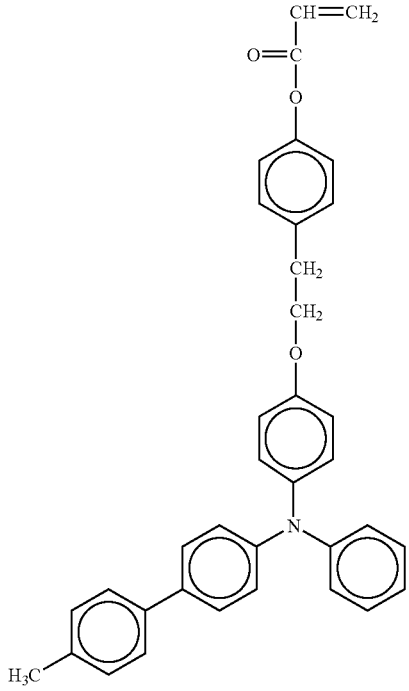

-continued
No. 124
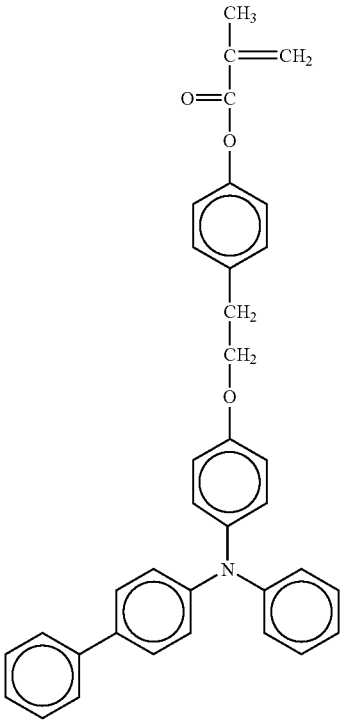
No. 125
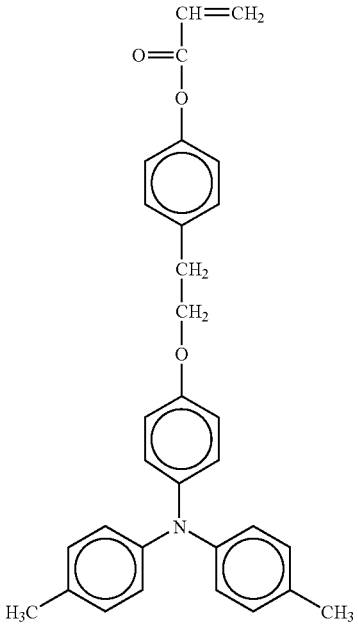
-continued
No. 126
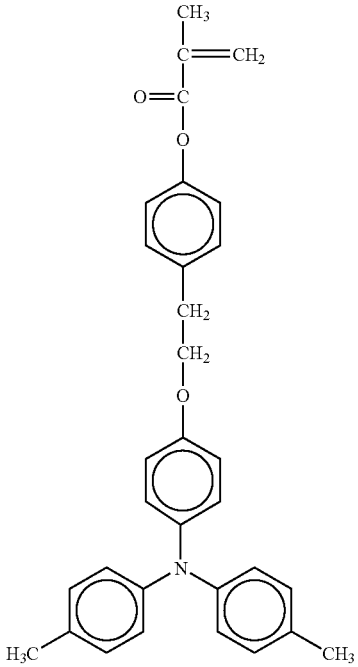
No. 127
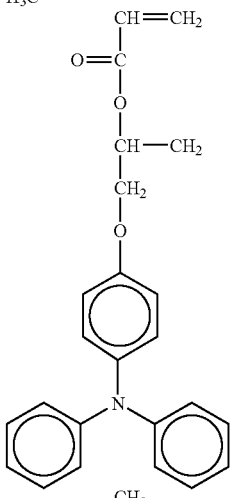
No. 128
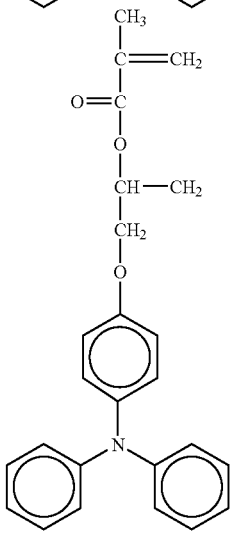

-continued
No. 129
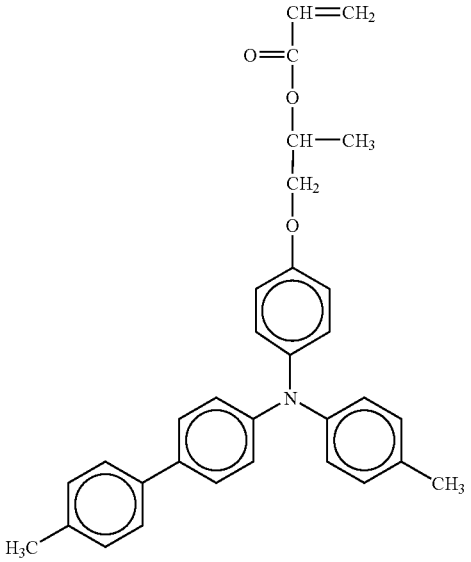
No. 130
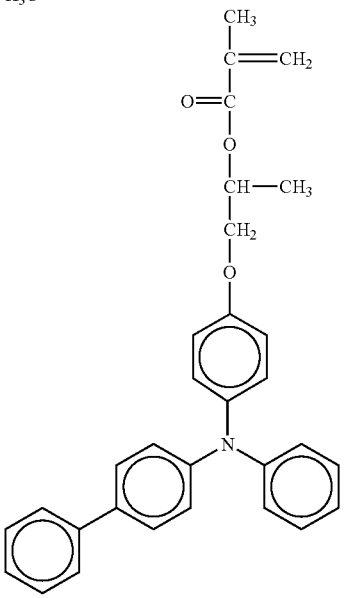
No. 131
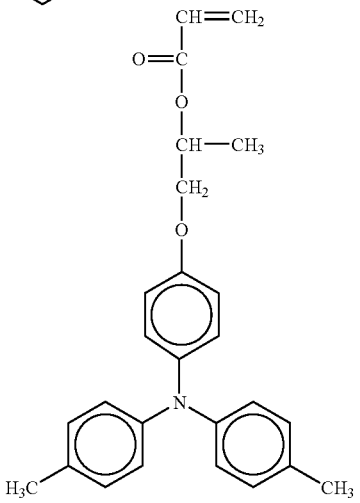
-continued
No. 132
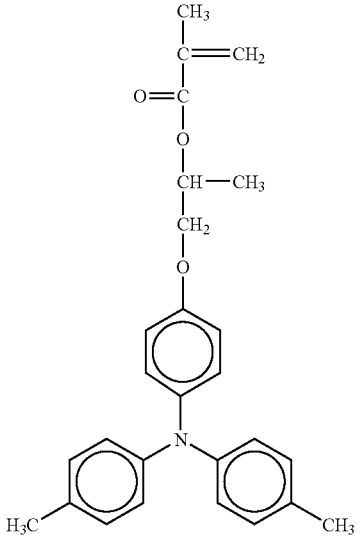
No. 133
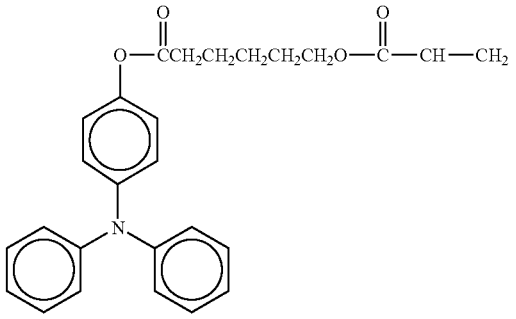
No. 134
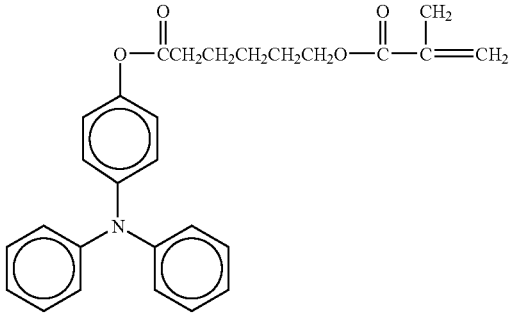
No. 135
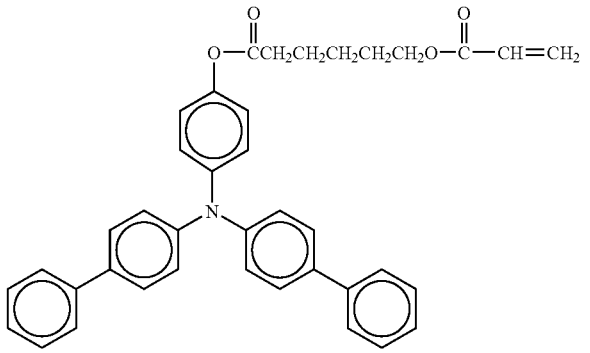

-continued
No. 136
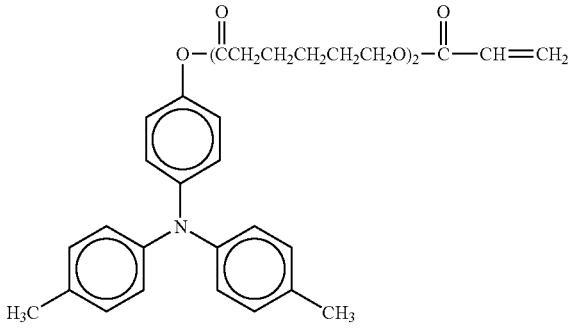
No. 137
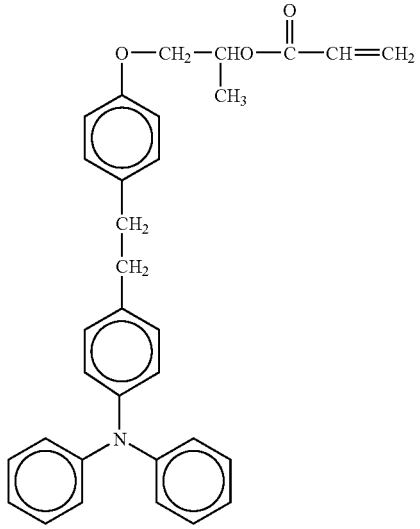
No. 138
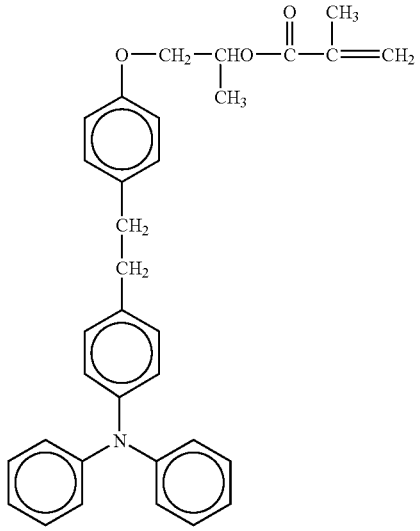
-continued
No. 139
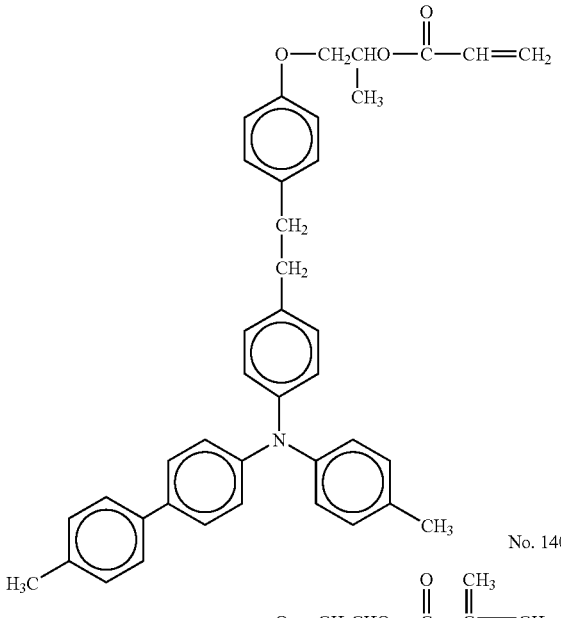
No. 140
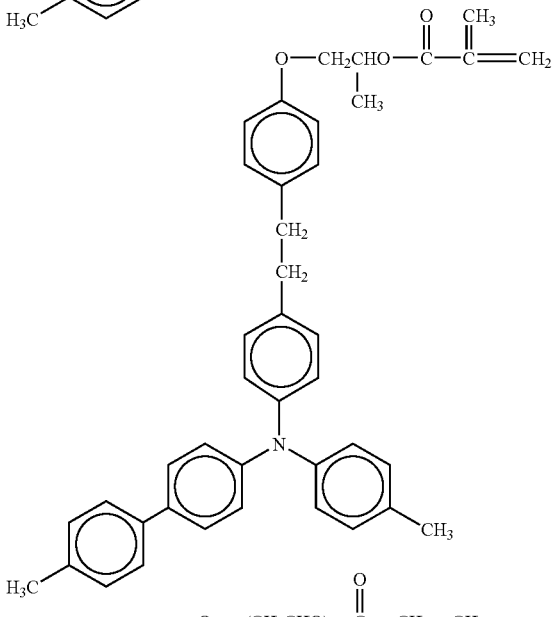
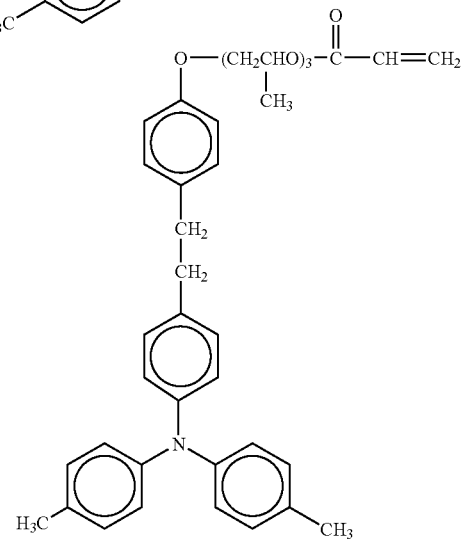

-continued
No. 142
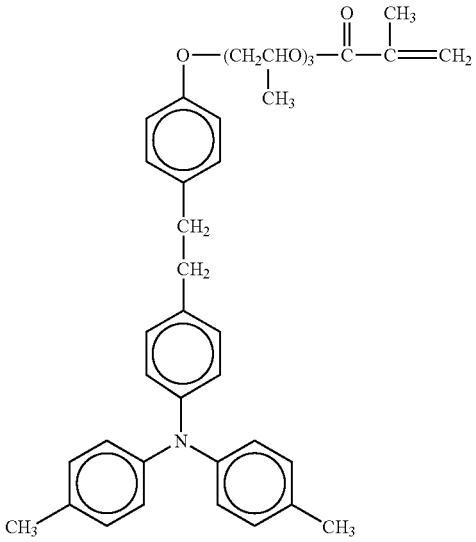
No. 143
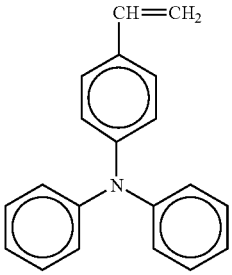
No. 144
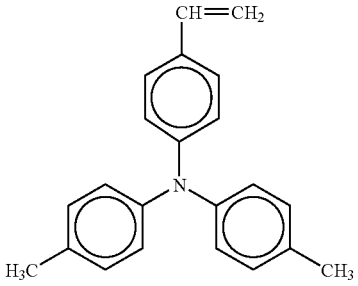
No. 145
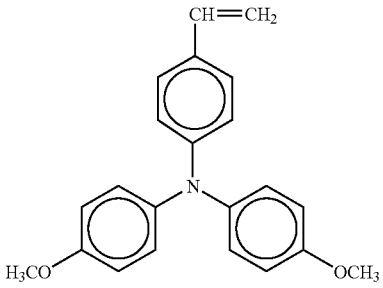
-continued
No. 146
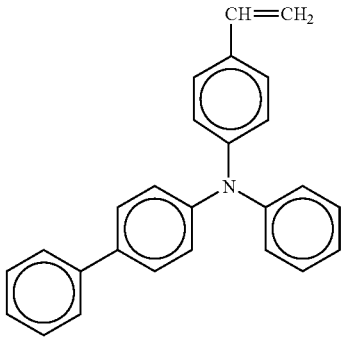
No. 147
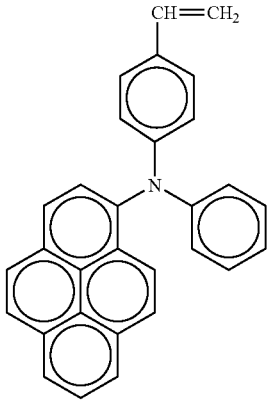
No. 148
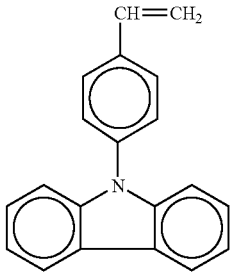
No. 149
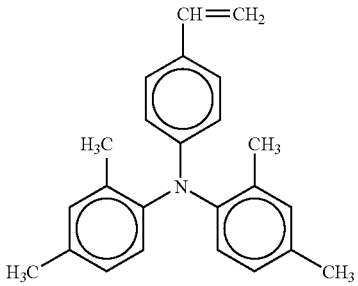
No. 150
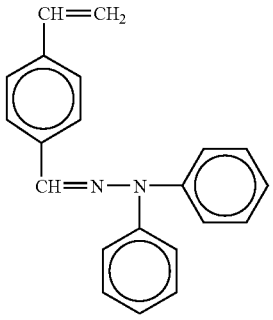

-continued
No. 151
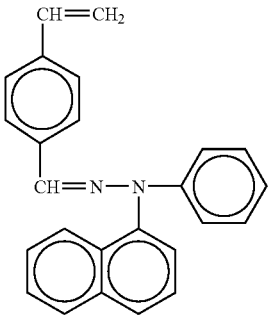
No. 152
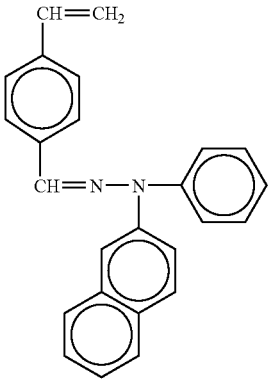
No. 153
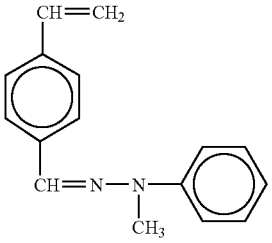
No. 154
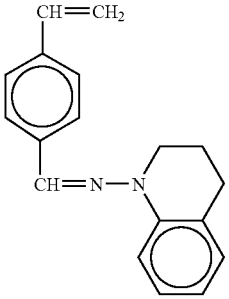
No. 155
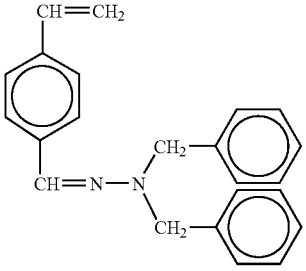
-continued
No. 156
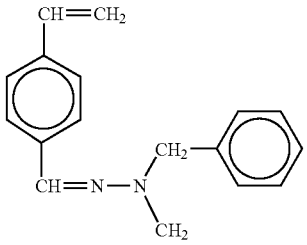
No. 157
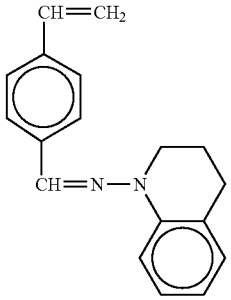
No. 158
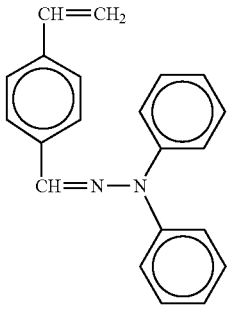
No. 159
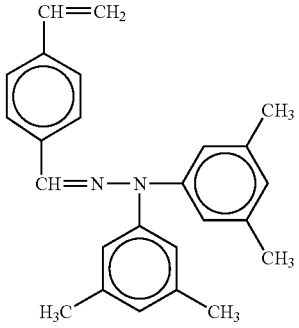
No. 160
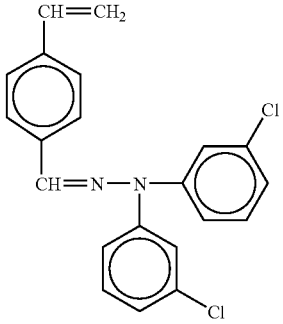
The use of the monofunctional radically polymerizable compound having a charge transporting structure is important to impart charge transportability to the crosslinked surface layer, and the added amount of the component is preferably 20% by mass to 80% by mass and more preferably 30% by mass to 70% by mass to the total content of components of the crosslinked surface layer. When the added amount of the component is less than 20% by mass, sufficient charge transportability cannot be held at the crosslinked surface layer, causing degradation of electric properties such as degradation of sensitivity and an increase in residual potential. When the added amount of the component is more than 80% by mass, the content of the radically polymerizable monomer having no charge transporting structure represented by General Formula (1) is reduced, which leads to a reduction in crosslinking bond density, consequently, high frictional resistance cannot be exerted. Since required electric properties and frictional resistance vary depending on the used process, it cannot be categorically described, however, in the light of balance of both of the properties, it is particularly preferable that the radically polymerizable compound having a monofunctional charge transporting structure is added within a range of 30% by mass to 70% by mass.

<<Polymerization Initiator>>

The surface layer is a crosslinked surface layer in which at least the radically polymerizable monomer having no charge transporting structure represented by the General Formula (1) and the monofunctional radically polymerizable compound having a charge transporting structure are cured at the same time, and to efficiently promote the crosslinking reaction, a polymerization initiator may be used in the surface layer. Examples of the polymerization initiator include thermal polymerization initiators and photopolymerization initiators.

Examples of the thermal polymerization initiator include peroxide polymerization initiators such as 2,5-dimethylhexane-2,5-dihydroperoxide, dicumylperoxide, benzoylperoxide, t-butylcumylperoxide, 2,5-dimethyl-2,5-di(peroxybenzoyl)hexine-3, di-t-butylbeloxide, t-butylhydrobeloxide, cumenehydrobeloxide and lauroylperoxide; and azo polymerization initiators such as asobisisobutylnitrile, azobiscyclohexane carbonitrile, azobisisomethyl butyrate, azobisisobutylamidine hydrochloride and 4,4'-azobis-4-cyanovalerate.

Examples of the photopolymerization initiator include acetophenone or ketal photopolymerization initiators such as diethoxyacetophenone, 2,2-dimethoxy-1,2-diphenylethane-1-one, 1-hydroxy-cyclohexyl-phenyl-ketone, 4-(2-hydroxyethoxy)phenyl-(2-hydroxy-2-propyl)ketone, 2-benzyl-2-dimethylamino-1-(4-morpholinophenyl)butanone-1, 2-hydroxy-2-methyl-1-phenylpropane-1-one, 2-methyl-2-morphorino(4-methylthiophenyl)propane-1-one and 1-phenyl-1,2-propanedion-2-(o-ethoxycarbonyl)oxime; benzoin ether photopolymerization initiators such as benzoin, benzoinmethylether, benzomethylether, benzoinisobutylether and benzoinisopropylether; benzophenone photopolymerization initiators such as benzophenone, 4-hydroxybenzophenone, o-benzoylmethyl benzoate, 2-benzoylnaphthalene, 4-benzoylbiphenyl, 4-benzoylphenylether, acrylated benzophenone and 1,4-benzoylbenzene; thioxanthone photopolymerization initiators such as 2-isopropylthioxanthone, 2-chlorothioxanthone, 2,4-dimethylthioxanthone, 2,4-diethylthioxanthone and 2,4-dichlorothioxanthone; titanocene photopolymerization initiators such as bis(cyclopentadienyl)-bis (2,3,4,5,6 pentafluorophenyl)titanium and bis(cyclopentadienyl)-bis(2,6-difluoro-3 (pyrrole-1-yl)phenyl)titanium; and other photopolymerization initiators such as ethylanthraquinone, 2,4,6-trimethylbenzoyldiphenylphosphineoxide, bis(2,4,6-trimethylbenzoyl)phenylphosphineoxide, bis(2,4-dimethoxybenzoyl)-2,4,4-trimethylpentylphosphineoxide, methylphenylglyoxyester, 9,10-phenanthrene, acridine compounds, triazine compounds and imidazole compounds. Further, a compound having a photopolymerization acceleration effect can be used alone or in combination with the above-noted photopolymerization initiators. Examples thereof include triethanolamine, methyldiethanolamine, 4-dimethylaminoethyl benzoate, (2-dimethylamino) ethyl benzoate and 4,4'-dimethylaminobenzophenone.

Each of these polymerization initiators may be used alone or in combination with two or more. The content of the polymerization initiator is preferably 0.5 parts by mass to 40 parts by mass and more preferably 1 part by mass to 20 parts by mass to 100 parts by mass of the total content of the components having radical polymerizability.

<Filler for Surface Layer>

As described above, the surface layer is a crosslinked surface layer in which at least the radically polymerizable monomer having no charge transporting structure represented by the General Formula (1) and the monofunctional radically polymerizable compound having a charge transporting structure are hardened at the same time. Besides the above-mentioned components, a filler containing a fine particle can be contained in the surface layer to enhance frictional resistance of the surface layer.

The average primary particle diameter of the fine particle is preferably 0.01 μm to 0.5 μm from the perspective of light transmittance and frictional resistance of the surface layer. When the average primary particle diameter of the fine particle is less than 0.01 μm, degradation of dispersibility and the like are caused, effect of enhancing frictional resistance cannot be sufficiently exerted, and when more than 0.5 μm, sedimentation property of the fine particle may be accelerated in the dispersion and toner filming may occur.

The higher concentration of the filler material in the surface layer is, the higher the frictional resistance is obtainable, however, when the concentration of the filler material is excessively high, the residual potential may be increased and the light transmittance when written on the surface layer may be reduced to thereby cause side-effects. Thus, the content of the filler material is generally 50% by mass or less and preferably around 30% by mass or less to the total solid content of the surface layer.

Further, the filler can be subjected to a surface treatment with at least one surface finishing agent, and it is preferable to do so in terms of dispersibility of the filler. Degradation of dispersibility of the filler causes not only an increase in residual potential but also reduction of transparency of the coated layer, occurrence of defects of the coated layer and further degradation of frictional resistance of the surface layer, and thus it may develop into major problems that could prevent ruggedization and producing of higher quality pictures. For the surface finishing agent, it is possible to use a conventionally used one, and a surface finishing agent capable of maintaining insulation of the filler is preferable.

The surface treatment amount of the filler varies depending on the average primary particle diameter of the used filler, however, it is suitably 3% by mass to 30% by mass and more preferably 5% by mass to 20% by mass to the mass content of the filler. When the surface treatment amount is less than 3% by mass, the effect of dispersing the filler cannot be obtained, and when more than 30% by mass, it may cause a remarkable increase in residual potential. The filler materials may be used alone or in combination with two or more.

<Other Additives>

The coating solution for the surface layer of the present invention can further contain various additives such as plasticizers (for improving stress relaxation and adhesion property), leveling agents and low-molecular charge transporting materials having no radical reactivity in accordance with necessity. For these additives, those known in the art can be used.

For the plasticizer, those used for typical resins such as dibutylphthalate and dioctylphthalate can be utilized. The use amount of the plasticizer is preferably 20 parts by mass or less and more preferably 10 parts by mass or less to the total solid content of the coating solution for the surface layer.

For the leveling agent, silicone oils such as dimethyl silicone oil and methylphenyl silicone oil and polymers or oligomer having a perfluoroalkyl group on the side chains thereof can be utilized. The use amount of the leveling agent is preferably 3 parts by mass or less to the total solid content of the coating solution for the surface layer.

<Forming Method of Surface Layer>

The surface layer can be formed by applying a coating solution containing at least a radically polymerizable monomer having no charge transporting structure represented by General Formula (1) and a monofunctional radically polymerizable compound having a charge transporting structure over the surface of the photosensitive layer and curing the applied coating solution.

When the radically polymerizable monomer in the coating solution used for coating is a liquid, other components may be dissolved in the radically polymerizable monomer liquid to use it for the coating, however, the radically polymerizable monomer liquid is diluted with a solvent in accordance with necessity.

The solvent used here is not particularly limited and may be suitably selected in accordance with the intended use. Examples thereof include alcohol solvents such as methanol, ethanol, propanol and butanol; ketone solvents such as acetone, methylethylketone, methylisobutylketone and cyclohexanone; ester solvents such as ethyl acetate and butyl acetate, ether solvents such as tetrahydrofuran, dioxane and propylether; halogen solvents such as dichloromethane, dichloroethane, trichloroethane and chlorobenzene; aromatic solvents such as benzene, toluene and xylene; and cellosolve solvents such as methylcellosolve, ethyl cellosolve and cellosolve acetate. Each of these solvents may be used alone or in combination with two or more.

The coating method used in forming the surface layer is not particularly limited as long as the coating method is a generally used coating method. A coating method may be suitably selected depending on the viscosity of the coating solution and the desired layer thickness of the surface layer. For example, immersion coating method, spray coating method, bead coating method and ring coating method are exemplified.

In the present invention, the coating solution is applied over the photosensitive layer surface and then energy is externally applied to thereby cure the surface layer. For the external energy used to cure the surface layer, light energy is mainly used, however, heat energy may be used in combination with light energy.

For the heat energy, gases and vapors such as air and nitrogen or various heating media, infrared radiation and electromagnetic wave can be used and the surface layer can be cured by heating the applied coating solution from the coated layer side or the substrate side. The heating temperature is preferably 100° C. to 170° C. When the heating temperature is less than 100° C., the productivity is degraded due to its slow reaction rate and it leads to a residue of unreacted material in the surface layer. In the meanwhile, the applied coating solution is heated at a temperature higher than 170° C., the layer is largely shrunk due to crosslinking reaction, defects and cracks like orange peel surface may be caused on the surface and an exfoliation may occur at the interface with the adjacent layer. When volatile components in the photosensitive layer disappear outward, it is unfavorable because desired electric properties may not be obtained. When a resin that is largely shrunk by crosslinking reaction is used, it is useful to take a method in which the resin is preliminarily cross-linked at a low temperature lower than 100° C. and then crosslinking reaction is completed at a high temperature higher than 100° C.

For the light energy, a light source such as ultrahigh pressure mercury lamp, high-pressure mercury lamp, low-pressure mercury lamp, carbon-arc lamp and xenon arc metal halide lamp may be used. It is preferable to select a light source from among these light sources in consideration of absorption properties of the radically polymerizable monomer having no charge transporting structure and the monofunctional radically polymerizable compound having a charge transporting structure to be used and further a photopolymerization initiator to be used in combination.

For the light emission illuminance, the applied coating solution is preferably exposed with an illuminance intensity of 50 mW/cm$^2$ to 2,000 mW/cm$^2$ on the basis of a wavelength of 365 nm. When illuminance intensity can be measured near the maximum emission wavelength, it is further preferable to expose the applied coating solution within the above-noted illuminance intensity range. When the illuminance intensity is low, it is unfavorable from the perspective of productivity because it takes long time to cure the surface layer. In the meanwhile, when the illuminance intensity is high, shrinkage on curing easily occur and defects and cracks like orange peel surface may be caused and an exfoliation may occur at the interface with the adjacent layer.

During UV irradiation, the temperature of the surface layer of the photoconductor is raised by influence of heat radiation generated from the light source. When the temperature of the photoconductor surface is excessively raised, it is unfavorable because curing inhibition occurs and electric properties of the electrophotographic photoconductor are degraded due to easy occurrence of shrinkage on curing on the surface layer and migration of low-molecule components contained in the adjacent layer into the surface layer. For this reason, the temperature of the photoconductor surface during UV irradiation is preferably 100° C. or less and more preferably 80° C. or less.

For the cooling method of the surface layer, an annealing agent may be included inside the photoconductor or the surface layer may be cooled through the use of gas and liquid induced in the photoconductor.

The cured surface layer may be post-heated in accordance with necessity. For example, a large amount of a residual solvent remains in the surface layer, it could be a cause of degradation of electric properties and time degradation. Thus, it is preferable to volatilize the residual solvent by post-heating.

The layer thickness of the surface layer is preferably 1 μm to 15 μm and more preferably 3 μm to 10 μm from the perspective of protection of the photosensitive layer. When the surface layer is thin, not only the photosensitive layer cannot be protected due to mechanical wear caused by a member making contact with the photosensitive layer but also the surface layer is hardly leveled when forming the surface layer due to close electric discharge from a charger, and therefore the surface of the surface layer may be like an orange peel surface. In contrast, when the surface layer is thick, it is unfavorable because the total thickness of the layers of the photoconductor is thick and reproductivity of an image is degraded due to diffusion of a charge.

<Adhesive Layer>

To prevent inter-layer exfoliation caused by defective adhesion in between the surface layer and the photosensitive layer, an adhesive layer may be provided in between both of the layers in accordance with necessity.

For the adhesive layer, the radically polymerizable monomer may be used or a non-crosslinking polymer compound may be used. For the non-crosslinking polymer compound, polyamide, polyurethane, epoxy resin, polyketone, polycarbonate, silicone resin, acrylic resin, polyvinylbutyral, polyvinylformal, polyvinylketones, polystyrene, poly-N-vinylcarbazole, polyacrylamide, polyvinylbenzal, polyester, phenoxy resin, vinyl chloride-vinyl acetate copolymer, polyvinyl acetate, polyphenylene oxide, polyvinyl pyridine, cellulose resin, casein, polyvinyl alcohol and polyvinyl pyrrolidone. The non-crosslinking polymer is not limited to the disclosed compounds. Even when any one of the radically polymerizable monomer and the non-crosslinking polymer compound is used, each of these compounds may be used alone or in combination with two or more. Further, the radically polymerizable monomer and the non-crosslinking polymer compound may be used in combination, provided that sufficient adhesion property can be obtained. Further, the charge transporting material described herein may be used alone or in combination with the above-noted compound. To improve adhesion property, additives may be used in a suitable amount.

The adhesive layer can be formed by applying a coating solution in which a compound formulated with a specific composition is dissolved or dispersed in a solvent such as tetrahydrofuran, dioxane, dichloroethane and cyclohexane over the surface of the photosensitive layer by immersion coating method, spray coating method, bead coating method or ring coating method.

The thickness of the adhesive layer is preferably 0.1 μm to 5 μm and particularly preferably 0.1 μm to 3 μm.

(Method for Producing Electrophotographic Photoconductor)

The method for producing an electrophotographic photoconductor of the present invention includes making an electrophotographic photoconductor contact with a supercritical fluid or a subcritical fluid which contains an injection material at a specific quantity thereby inject the injection material into the electrophotographic photoconductor having a photosensitive layer which contains at least a binder, a charge generating material and a charge transporting material on a conductive substrate. Further, other steps may be included in accordance with necessity.

<Injection Treatment Step>

In the injection treatment step, a supercritical fluid or a subcritical fluid containing the injection material is prepared and the supercritical fluid or the subcritical fluid containing the injection material is induced in a high-pressure cell with an electrophotographic photoconductor is fixed therein, thereby making the electrophotographic photoconductor contact with the supercritical fluid or the subcritical fluid.

By the injection treatment step, the supercritical fluid or the subcritical fluid is introduced in the photosensitive layer (or crosslinked surface layer) and the photosensitive layer (or crosslinked surface layer) is plasticized to thereby further reduce the viscosity of the photosensitive layer.

At the same time, the injection material dissolved in the supercritical fluid or the subcritical fluid is injected into the photosensitive layer (or crosslinked surface layer). Even with an electrophotographic photoconductor with a crosslinked surface layer is laminated thereon, the injection material injected into the crosslinked surface layer can relatively quickly diffuse in the crosslinked surface layer whose viscosity is lowered, and thus the injection material can be injected into not only the crosslinked surface layer but also into the deep part of the photosensitive layer which is disposed next to the crosslinked surface layer.

For a contact state of the electrophotographic photoconductor with the supercritical fluid containing the injection material to be described hereinafter, described in the present invention, the embodiment is not particularly limited as long as the electrophotographic photoconductor is physically in contact with the supercritical fluid. For example, a specific quantity of a supercritical fluid or a subcritical fluid is introduced into a high-pressure cell, the high-pressure cell is sealed, after a lapse of given hours, the supercritical fluid or the subcritical fluid is removed from the high-pressure cell, thereafter, the electrophotographic photoconductor may be taken out of the high-pressure cell or the supercritical fluid or the subcritical fluid may be continuously supplied to the high-pressure cell, discharged, after a lapse of specific hours, the electrophotographic photoconductor may be taken out of the high-pressure cell.

In the former process, the amount of the injection material introduced into the high-pressure cell is only an amount contained in the supercritical fluid or the subcritical fluid, the wax concentration gradient inside the electrophotographic photoconductor and in the supercritical fluid or the subcritical fluid is reduced with a lapse of time and the injection rate is also lowered in accordance with reduction of the concentration gradient. As a result, the former process allows for relatively simple production equipment and obtaining an electrophotographic photoconductor at low cost, although there is a shortcoming that the injection rate of the injection material into the electrophotographic photoconductor is relatively small. In the latter process, since the supercritical fluid or the subcritical fluid is supplied at a constant concentration to the electrophotographic photoconductor, the wax concentration gradient inside the electrophotographic photoconductor and in the supercritical fluid or the subcritical fluid is larger than that of the former process, and thus a desired amount of the injection material can be injected to the electrophotographic photoconductor in a short time.

However, there are shortcomings that both processes require relatively large production equipment because an apparatus for circulating the supercritical fluid or the subcritical fluid is required and an apparatus for controlling the concentration of the injection material in the supercritical fluid or the subcritical fluid is required.

In the present invention, any of the above-noted processes can be used, and it can be suitably selected in accordance with the intended use.

<Injection Material>

For the injection material, waxes and polyorganosiloxane compounds are exemplified.

<<Waxes>>

The waxes are not particularly limited as long as they are general waxes that exhibit solid property at a melting point of 40° C. or more and have a melt viscosity at a temperature 10° C. higher than the melting point of 10 Pa·s or less.

For the general waxes, it is possible to select ones among from known natural waxes, synthetic waxes and modified waxes for use.

Examples of the natural waxes include vegetable waxes such as Fisher Tropsh wax, flax wax, candelilla wax, palm wax, rice bran wax, jojoba wax, Japan wax, cotton wax and sugarcane wax; animal waxes such as beeswax, whale waxes, lanolin and ceramic waxes; mineral waxes such as ozokerite, ceresin and montan wax; and petroleum waxes such as microcrystalline wax, paraffin wax and petrolatum.

Examples of the synthetic waxes include hydrocarbon waxes such as Fisher Tropsh wax, polyethylene wax and polypropylene wax.

Examples of the modified waxes include waxes modified from mineral waxes or petroleum waxes such as montan wax derivatives, paraffin wax derivatives and microcrystalline wax derivatives; and waxes modified from animal fats and fatty oils of castor oil, 12-hydroxystearate, 12-hydroxystearate derivatives, fatty acid amide, fatty acid monovalent alcohol ester, fatty acid high-alcohol ester, fatty acid amine and waxy dialkylketone.

The waxes used for reducing gas permeability and gas adsorption ability of the electrophotographic photoconductor are not particularly limited as long as they are waxes selected from those mentioned above, however, when impurities are contained in the waxes, there may be cases where properties of the electrophotographic photoconductor are degraded. Thus, high-purity waxes are preferable. For example, paraffin wax, Fisher Tropsh wax and polyolefin wax are preferable. Of these, Fisher Tropsh wax and polyethylene wax are more preferable.

Various types of these waxes are commercially available. Specifically, for Fisher Tropsh wax, "FT-0070", "FT-100", "FT-105", "FT-0165", "FT-5165" and "FT-115" are available from NIPPON SEIRO CO., LTD.

For the polyethylene wax, HDPE of "HIGH WAX 800P", "HIGH WAX 400P", "HIGH WAX 200P" and "HIGH WAX 100P" and HIGH WAX series of "HIGH WAX 720P", "HIGH WAX 410P", "HIGH WAX 420P", "HIGH WAX 320P", "HIGH WAX 220P", "HIGH WAX 210P" and "HIGH WAX 110P" etc. are available from Mistui Chemicals, Inc. Similarly, for the polyethylene wax, SAN WAX series of "SAN WAX 171P", "SAN WAX 161P", "SAN WAX 161P" AND "SAN WAX 131P" etc. are available from Sanyo Chemical Industries, Ltd.

Depending on the melting point of the wax used here, not only gas permeability and gas adsorption ability are reduced but also water repellency and anti-slip property of the photographic photoconductor can be improved.

Generally, for the wax exhibiting water repellency, the one having a melting point of 120° C. or less is preferable, and for the wax exhibiting anti-slip property, the one having a melting point to 110° C. or less is preferable. In other words, in the case of a wax used for only reducing gas permeability and gas adsorption of the photographic photoconductor, the melting point of the wax is not particularly limited, however, when improving the water repellency and anti-slip property of the photographic photoconductor at the same time, the melting point of the wax to be used is preferably 120° C. or less and more preferably 110° C. or less.

The type of the number of waxes to be used is not limited as long as the waxes are selected from the above-noted waxes. By using one or more waxes suitably selected to reduce the gas permeability and gas adsorption property in combination with one or more waxes suitably selected to improve the water repellency and anti-slip property of the electrophotographic photoconductor, more preferable properties can be exhibited in the electrophotographic photoconductor.

<<Polyorganosiloxane>>

The polyorganosiloxane compound is not particularly limited as long as it can be obtained through a reaction such as hydrolysis and the like using at least one of organosilane and organosiloxane.

The polyorganosiloxane is called "silicone resin" and takes a solid phase or a liquid phase at room temperature depending on the molecular weight and molecular frame thereof. In the present invention, the polyorganosiloxane may be a solid or a liquid at room temperature, however, to maintain the effects of the present invention for a long time, it is preferably a solid at room temperature. Specifically, the melting point of the polyorganosiloxane is preferably 40° C. or more, and in view of the temperature in an image forming apparatus with the electrophotographic photoconductor mounted therein, it is more preferably 50° C. or more.

To make a polyorganosiloxane that is insoluble in supercritical fluids dissolved in a supercritical fluid, the polyorganosiloxane is preferably liquid in the supercritical fluid. When the temperature of the supercritical fluid is increased to a high temperature of 140° C. or more, as described above, it could have an impact on the electrophotographic photoconductor. Thus, it is preferable to treat the polyorganosiloxane at a temperature of 140° C. or less. For this reason, when the melting point of the polyorganosiloxane is 140° C. or less and more preferably 120° C. or less, the polyorganosiloxane is preferably liquid in the supercritical fluid. From this viewpoint, the melting point of the polyorganosiloxane is preferably 120° C. or less and more preferably 100° C. or less.

Generally, polyorganosiloxane can be produced by using a cyclic polyorganosiloxane, a liquid polydimethylsiloxane with both of the molecular chain ends blocked with a hydroxyl group, a liquid polydimethylsiloxane with both of the molecular chain ends blocked with an alkoxy group, a liquid polydimethylsiloxane with both of the molecular chain ends blocked with a trimethylsilyl group etc, a trifunctional trialkoxysilane and hydrolytic products thereof and reacting them.

As an alternative production method, a low-molecular cyclic siloxane, for example, the octamethylcyclotetrasiloxane is polymerized in the presence of a strongly alkaline or strongly acidic catalyst, thereby a high-molecular weight polyorganosiloxane can be obtained.

For products relating to polyorganosiloxane, various products are commercially available. Specifically, for example, silicone resins typified by TSF series and Y series are available from GE Toshiba Silicone Co. Ltd.; dimethyl silicones (SH series), various modified silicones (polyester-modified silicones, amino-modified silicones, phenyl-modified silicones, aminophenyl-modified silicones, alkyl-modified silicones, etc), silicone waxes and silicone elastomers are commercially available from DOW CORNING TORAY SILICONE CO., LTD.; and high-melting point silicone waxes and special modified silicones have already been on the market from TAKAMATS OIL & FAT CO., LTD.

<Content of Injection Material>

The content of the injection material in the supercritical fluid or the subcritical fluid is preferably 0.5 g/L or more to less than 4.0 g/L and more preferably 1.5 g/L or more to less than 4.0 g/L.

The content of the injection material in the supercritical fluid or the subcritical fluid can be determined by the following expression, i.e., dividing the mass of the wax component (g) by the inner volume (L) of a pressure-resistant cell into which the supercritical fluid is supplied.

Mass of the wax component (g)/Inner volume (L) of a pressure-resistant cell into which the supercritical fluid is supplied — Expression When the content of the injection material is less than 0.5 g/L, it is unrealistic because the injection rate of the injection material into an electrophotographic photoconductor is slow and the time required to obtain a desired electrophotographic photoconductor is extremely long.

When the content of the injection material is more than 4.0 g/L, a large amount of the injection material easily adheres on the outermost surface part of the electrophotographic photoconductor, and the surface property of the electrophotographic photoconductor may be damaged. For this reason, the upper limit of the content of the injection material is preferably set to 4.0 g/L or less.

The time to treat the injection material-containing supercritical fluid or subcritical fluid to prepare an electrophotographic photoconductor may be suitably determined depending on the injection rate of the injection material and the layer thickness of the photoconductor (when a crosslinked surface layer is formed, it depends on the layer thickness of at least any one of the crosslinked surface layer and the photosensitive layer).

To obtain the above-noted effects by injecting the injection material to the electrophotographic photoconductor using a supercritical fluid or a subcritical fluid used in the present invention, it is required that an indicator indicating gas permeability (for example, oxygen permeability and vapor permeability) or an indicator indicating gas absorption property and the like be sufficiently low. The time required to sufficiently decrease these indicators varies depending on the injection material used for the crosslinked surface layer, and thus it is preferable to determine the treatment time after a sufficient examination.

<Treatment Conditions>

Since polymer materials may be degenerated or decomposed by heat, the temperature of the supercritical fluid or the subcritical fluid is preferably 30° C. to 140° C. and more preferably 30° C. to 100° C. When the temperature of the supercritical fluid or the subcritical fluid is less than 30° C., it is often difficult to inject the injection material into the photosensitive layer due to its low solubility and diffusability of the supercritical fluid or the subcritical fluid. When the temperature is more than 140° C., it is unfavorable because the components constituting the photosensitive layer may be degenerated or decomposed and when the photoconductor is a function-separated multi-layered photoconductor, it may be a cause of exudation of the components constituting adjacent layers to the photosensitive layer.

To efficiently inject the injection material into the photosensitive layer, the injection material is preferably injected thereto under the condition of a temperature 5° C. or more higher than the melting point of the injection material. When the temperature of the supercritical fluid or the subcritical fluid is set to the temperature, the injection material is fused in the supercritical fluid or the subcritical fluid, and thus the concentration of the fluid is easily even. Also, the injection material is in a state where it is easily injected in the crosslinked surface layer and the photosensitive layer whose viscosity are lowered in the supercritical fluid or the subcritical fluid. The reason for the phenomenon is not clearly known, however, it is considered that this is because even when the concentration of the injection material in the supercritical fluid or the subcritical fluid is higher than the saturated concentration and the injection material is partly undissolved therein, it is held in a relatively even condition in the fluid, and even when the concentration of the injection material is lowered in the fluid by injecting the injection material into the photosensitive layer, the injection material that is evenly dispersed in the fluid is quickly dissolved in the fluid, and therefore the concentration of the injection material in the fluid can maintain the saturated condition.

<Supercritical Fluid/Subcritical Fluid>

Here, the supercritical fluid indicates a state exceeding a limitation or a critical point of temperature and pressure at which a gas and a liquid can coexist. A supercritical fluid has a characteristic that it has a capability of dissolving a material in a high density state than the solubility of a fluid at room temperature. This can be considered because the fluid is under a high pressure and thus the kinetic energy of the fluid is great and because the viscosity of the fluid is low. A supercritical fluid also has a notable characteristic that the supercritical fluid is capable of wide application because the solubility thereof can be controlled by adjusting the density thereof by temperature and pressure. Generally, a supercritical fluid with a density of 0.2 g/cm$^3$ or higher is often used as a solvent to chemical materials.

A supercritical fluid can quickly diffuse into a medium because it has a high kinetic energy and a low viscosity.

For this reason, it has been known that a generally used solvent hardly interpenetrate into a porous body, however, a supercritical fluid can relatively easily interpenetrate into a porous body. Further, since the thermal conductance of a supercritical fluid is greater than that of a liquid, reaction heat generated by a chemical reaction induced in the supercritical fluid can be quickly removed.

<<Medium Used as Supercritical Fluid or Subcritical Fluid>>

The supercritical fluid is not particularly limited and may be suitably selected in accordance with the intended use as long as it can exist as a noncondensable high-density fluid in a range of temperature and pressure exceeding the limitation or the critical point of temperature and pressure at which a gas and a liquid can coexist, it is not condensed even when compressed, and is a fluid being in a critical pressure or higher state.

The critical temperature and the critical pressure of the supercritical fluid are not particularly limited. Examples of the supercritical fluid include carbon monoxide, carbon dioxide, ammonia, nitrogen, water, methanol, ethanol, ethane, propane, butane, hexane, 2,3-dimethylbutane, benzene, chlorotrifluoromethane and dimethylether.

The critical temperature of the supercritical fluid is preferably −278° C. to 300° C. and particularly preferably 0° C. to 1,400° C. When a medium that is denatured by heat in a supercritical fluid is used, it is preferable to use a supercritical fluid having a low critical temperature. Examples of such a supercritical fluid include carbon dioxide (critical temperature: 31.0° C.), ethane (critical temperature: 32.2° C.), propane (critical temperature: 96.6° C.) and ammonia (critical temperature: 132.3° C.). Also, the subcritical fluid is not particularly limited and may be suitably selected in accordance with the intended use as long as it can exist as a high-pressure liquid in a range of temperature and pressure range near the critical point thereof.

Various materials that can be exemplified as supercritical fluids can also be suitably used as the subcritical fluid. In the present invention, each of these supercritical fluids and subcritical fluids described above may be used alone or in combination with two or more.

[Supercritical Carbon Dioxide]

In the present invention, when a supercritical fluid or a subcritical fluid is used to an organic material, it is particularly preferable to use a carbon dioxide as a primary medium.

Carbon dioxides are widely used in the field of food industries because carbon dioxides have advantages in that use of a carbon dioxide allows for relatively easily producing a supercritical state because it has a supercritical pressure of 7.3 MPa and a supercritical temperature of 31.0° C., the damage caused by heat on organic materials is small and the handling is easy because it is nonflammable and low toxic.

[Entrainer]

To control the solubility of the organic material in the supercritical fluid or the subcritical fluid, an organic solvent may be added as an entrainer in the supercritical fluid or the subcritical fluid.

Generally, it is preferable to select a solute in which the supercritical fluid or the subcritical fluid is intended to be dissolved, in the present invention, it is preferable to select a solvent having a high affinity for organic materials as an entrainer.

It is more preferable to select a solvent that can increase the solubility of the supercritical fluid or the subcritical fluid in a desired solute and can reduce the solubility of materials unnecessary for the electrophotographic photoconductor by addition of the entrainer.

The organic solvent used as the entrainer is not particularly limited and may be suitably selected in accordance with the intended use. Examples thereof include methanols, ethanols, acetones, ethyl acetates, propanols, ammonias, melamines, ureas, thioethylene glycols.

<Cleaning Step>

After the injection treatment step, various initial properties (surface property, charge capability, electric property, etc.) of the electrophotographic photoconductor are considered to be significantly degraded because a relatively large amount of the injection material is precipitated on the surface of the photosensitive layer. Thus, the surface of the electrophotographic photoconductor may be subjected to a cleaning treatment using the supercritical fluid or the subcritical fluid after the injection treatment step.

<Other Additives>

Besides the solvent that the effect obtained by addition of the entrainer can be expected, additives such as the charge transporting material and the antioxidant contained in the electrophotographic photoconductor may be preliminarily dissolved in the supercritical fluid or the subcritical fluid. Addition of the additives can prevent active low-molecular weight components contained in the electrophotographic photoconductor from being removed from the electrophotographic photoconductor.

<Method of Determining Moisture Content in Electrophotographic Photoconductor>

Next, a method of determining a moisture content in the electrophotographic photoconductor is described below. As described above, photoconductor properties such as charge transportability and surface resistance are degraded by adsorption and deposition of a discharge product onto the electrophotographic photoconductor. A method of directly determining a free volume of an electrophotographic photoconductor has not yet been proposed so far, however, as an indirect indicator, a gas permeability as defined in JIS K7126 and a moisture content as defined in JIS K2275 are exemplified. In the measurement of the moisture content, the measured moisture content is affected by hydrophilicity of materials constituting the electrophotographic photoconductor, it is conceivable that moisture in the atmosphere affects reduction in image density and reduction in resolution that are issues to be solved by the present invention. Thus, it is considered that there is no particular problem with the use of the moisture content as an indicator to achieve the purpose.

In the present invention, the moisture content of the electrophotographic photoconductor is used as an indicator indicating the free volume of the electrophotographic photoconductor.

As procedures of quantitative determination of the moisture content of the electrophotographic photoconductor, firstly (1) the electrophotographic photoconductor was at rest under a high-temperature and high-humidity environment, and subsequently (2) a moisture content of the electrophotographic photoconductor was determined in accordance with the Karl Fisher coulometric titration method defined in JIS K2275. The respective procedures are described in detail below.

(1) Leaving the Electrophotographic Photoconductor at Rest Under a High-Temperature and High-Humidity Environment Temperature and Humidity Environment temperature: 30° C.

humidity: 90%

Time for Leaving the Electrophotographic Photoconductor at Rest 48 hours

A chamber used to leave the electrophotographic photoconductor at rest is not particularly limited as long as it is a thermo-hygrostat chamber in which the electrophotographic photoconductor can be set under the environment. After the above-noted process, (2) a moisture content of the electrophotographic photoconductor was speedily determined as follows.

(2) Determination of Moisture Content

For the determination of a moisture content of the electrophotographic photoconductor, as described above, the "Karl Fisher coulometric titration method" defined in JIS K2275 was used. The device, the reagent used in the quantitation and quantitation conditions are described below.

Device:

Karl Fisher moisture meter Model CA-06 (manufactured by Mitsubishi Chemical Corporation)

Moisture vaporizer Model VA-100 (manufactured by Mitsubishi Chemical Corporation)

Reagent:

anolyte—AQUAMICRON AX (manufactured by Mitsubishi Chemical Corporation)

cathode—AQUAMICRON CXU (manufactured by Mitsubishi Chemical Corporation)

Titration Conditions:

a measurement mode—ppm quantitation mode a Delay Time Ocec

SENS 0.3

Gain 3 temperature of vaporizer: 150° C.

The moisture content of a sample of the electrophotographic photoconductor was determined using the device under the above-noted conditions and a moisture content per unit volume ($\mu g/mm^3$) of the sample was calculated from the preliminarily measured volume of the sample that had been placed in the moisture evaporator. Moisture content of the sample was repeatedly measured five times and the average value thereof was regarded as the moisture content of the electrophotographic photoconductor of the present invention.

The moisture content of the electrophotographic photoconductor is preferably 3.0 $\mu g/mm^3$ or less and is more preferably 2.5 $\mu g/mm^3$. When the moisture content of the electrophotographic photoconductor is higher than 3.0 $\mu g/mm^3$, it is unfavorable because an electric discharge product easily interpenetrate into the crosslinked surface layer, the atmospheric moisture is easily taken thereinto and thus the electric resistance and the electric properties of the electrophotographic photoconductor are easily degraded.

When a photoconductor is formed using an organic material as with the electrophotographic photoconductor of the present invention and the molecular orientation is in an ideal condition, it is conceivable that the moisture content of the photoconductor is a value extremely close to zero. In this case, it is conceivable that the electric properties of the photoconductor are hardly affected by an electric discharge product.

<Titration Method of Injection Material in Photosensitive Layer>

Next, a method of quantitating the injection material contained in the photosensitive layer will be described below.

There have been known the following quantitation methods of known components in bulk. Specifically, quantitative elemental analysis by using an XPS (X-ray photoemission spectroscopy) analyzer, an EDX (energy dispersive X-ray analyzer), or a WDX (wavelength-dispersive X-ray spectroscopy) analyzer; when the known component is stained with a reagent, a quantitation method using the amount stained with the reagent; and when a chart that can be obtained by the FT-IR/ATR method has a peak that allows for separating the known component from components constituting the bulk, a quantitation method using the peak area ratio are known.

The polyorganosiloxane used in the present invention contains an extremely large amount of Si element and the binder does not often contain Si element. Therefore, when the photosensitive layer is a resin layer containing a polyorganosiloxane in the binder, the Si element content measured by XPS can be regarded as a polyorganosiloxane content.

Since the polyorganosiloxane contains an extremely large amount of Si element, the amount of the polyorganosiloxane injected into the photosensitive layer can be determined by determining the Si mass ratio by XPS method.

Specifically, when a compound containing an Si element is contained as the constituent of a photosensitive layer, the content of the Si contained in the photosensitive layer is preliminarily determined and the content of the Si of the photosensitive layer to which a polyorganosiloxane is injected is determined, and the injected amount of the polyorganosiloxane can be estimated from the difference therebetween.

Here, examples of a method of measuring the concentration of polyorganosiloxane in the depth direction of the photosensitive layer include a method in which the Si content is determined from a cross-sectional structure of the photosensitive layer cut by microtory or freeze-crushing process using an XPS analyzer a method in which a photosensitive layer is cut from the photoconductor surface in an oblique direction thereof, in the cut surface, the Si content of the photosensitive layer in the depth direction thereof is determined to thereby obtain information on polyorganosiloxane concentration.

However, the former method is not suitable for obtaining information on polyorganosiloxane concentration in the depth direction of the photosensitive layer because there is a limitation of resolution of XPS analyzers. In contrast, the latter method makes it possible to obtain correct information on the polyorganosiloxane concentration in the depth direction of the photosensitive layer irrespective of the resolution of XPS analyzers.

Figure 5:
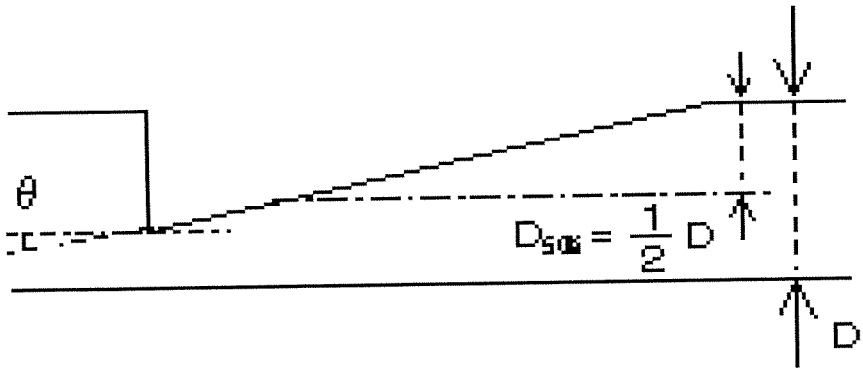
FIG. 5 is a view showing a method of measuring a content of the injection material in the electrophotographic photoconductor of the present invention in the depth direction of the photosensitive layer.

Accordingly, in the present invention, as shown in FIG. 5, a method is employed in which a photosensitive layer is cut from the surface thereof in an oblique direction, in the cut surface, an Si content in a specific area in the depth direction of the photosensitive layer (for example, in an area from the surface of the photosensitive layer to 50% of the thickness of the photosensitive layer) is determined to thereby obtain information on polyorganosiloxane concentration of the photosensitive layer.

The "Si content in an area from the surface of the photosensitive layer to 50% of the thickness of the photosensitive layer" is, for example, as shown in FIG. 5, an area of the cut surface to be measured from the surface of the photosensitive layer to 50% of the depth ($D_{50\%}$) of the thickness (D) of the photosensitive layer. The cutting angle (θ) can be suitably set to meet the resolution of the used XPS analyzer.

<<Cutting Conditions and XPS Measurement Conditions>>

Here, the cutting conditions and XPS measurement conditions are described below.

An analytical curve is necessary in quantitative determination of concentration of a component using an XPS analyzer. To obtain the analytical curve, it is preferable that a bulk and a homogenous film are obtained and then an analytical curve is obtained after determining the Si content of the bulk and the homogenous film, however, as described above, the resin used in an electrophotographic photoconductor, in general, is poorly soluble in polyorganosiloxane and it is difficult to obtain a homogenous film. For this reason, it is quite difficult to prepare an analytical curve, coupled with the fact that the measurement depth is shallow.

The area to be measured using an XPS analyzer is several ten micrometers, and it is assumed that a microphase separation arises in a two-component mixture that the two components are poorly soluble as described in the present invention, however, it is conceivable that the size of the area to be measured is much larger than the microphase-separating structure. Therefore, the measured area can be regarded as a resin film having locally less measurement variations provided that the measured area is in the same plane surface and having an even composition distribution. Under such conditions, the polyorganosiloxane concentration and the Si content in an area measured by an XPS analyzer can be regarded as a linear relation, and thus in the present invention, when the content of Si element in a photosensitive layer to which a polyorganosiloxane is not injected and the Si content in the polyorganosiloxane are respectively defined as the former having a polyorganosiloxane concentration of 0% by mass and the latter having a polyorganosiloxane concentration of 100% by mass, and it is also regarded that the relation of the Si content to the polyorganosiloxane concentration obtained in between 0% by mass to 100% by mass of the polyorganosiloxane concentration can be obtained by complementing the data using a linear spectral estimation technique.

[Cutting Conditions]

cut width: 1,000 μm cutting angle (θ): 2.9 degrees (tan θ=0.05)

[XPS Measurement Conditions]

measurement device: a scanning-type X-ray photoelectron spectrometer, QUANTUM 2000, manufactured by Philips Electronics N.V.

X-ray source: Alka analyzed area: 50 μm

<Measurement Method of Melting Point of Injection Material>

In the present invention, the melting point of the injection material was measured in the following procedures according to the softening point measurement method described in JIS-K7196-1991.

Firstly, a material to be examined (polyorganosiloxane, wax, photosensitive layer, etc.) was formed to be a film having a thickness of 5 μm on a glass substrate under a normal temperature and normal humidity condition. The film forming method is not particularly limited, however, a method is generally used in which a coating solution in which a material to be examined is dissolved in a solvent is prepared and the coating solution is applied over a surface of a substrate by a bar-coating method to thereby form a film. Subsequently, the specimen or the sample piece was set in a thermal mechanical analyzer (TMA8310, manufactured by Rigaku Denki Co., Ltd.), a penetration temperature of the specimen was measured under a temperature increase condition of 10° C./min from 25° C. to 250° C., and a melting point of the specimen was calculated from the read penetration temperature.

(Image-Forming Apparatus)

Next, the image forming apparatus and the process cartridge used for image forming apparatus will be described in detail with reference to the drawings.

The image forming apparatus of the present invention is an apparatus using a photoconductor having the crosslinked surface layer, the image forming apparatus is used to carry out steps of at least charging the photoconductor, exposing an image, developing the image, transferring the toner image onto an image-bearing member, fixing the toner image on a recording material and cleaning the photoconductor surface. It depends on the case, however, an image forming apparatus that directly transfers a latent electrostatic image onto an image transferer and develops the transferred image does not necessarily have the above-noted processes relating to a photoconductor.

Figure 6:
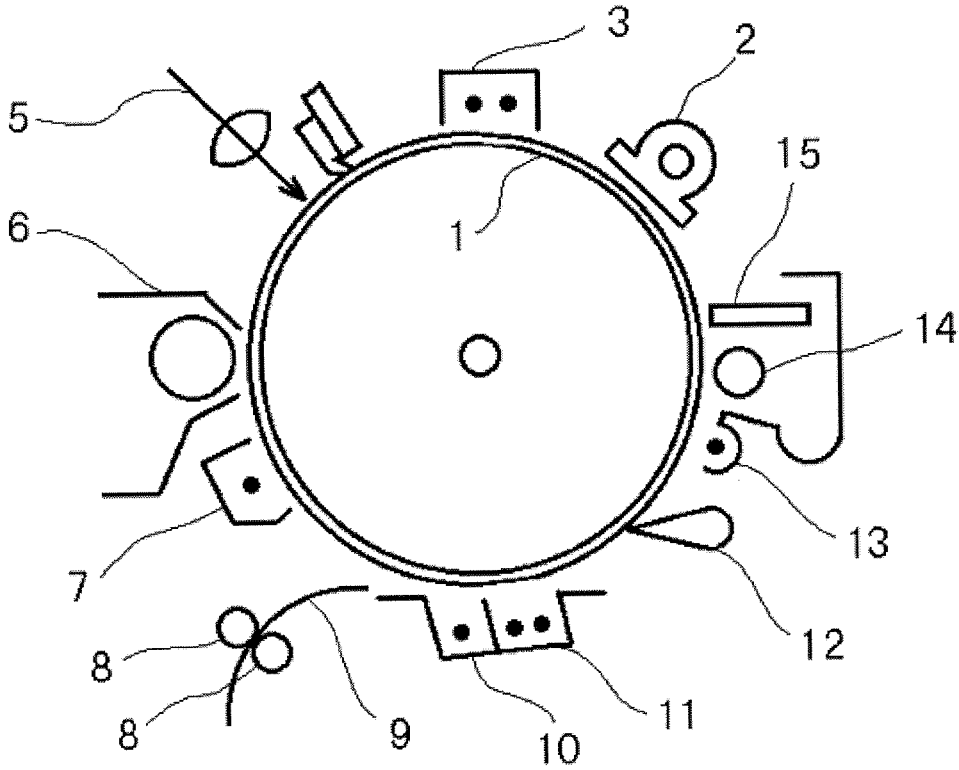
FIG. 6 is a schematic view exemplarily showing a structure of the image forming apparatus of the present invention.

FIG. 6 is a schematic view exemplarily showing a structure of the image forming apparatus of the present invention.

As shown in FIG. 6, the image forming apparatus of the present invention is equipped with at least an electrophotographic photoconductor 1, a charge-eliminating lamp 2, a charger 3, an image exposing unit 5, a developing unit 6, a transfer charger 10 and a cleaning unit.

The charger 3 is a charging unit configured to averagely charge the electrophotographic photoconductor surface. For the charging unit, a scorotron device, a scorotron device, a solid discharge device, a needle electron device, a roller-charging device, a conductive brush device and the like are used and conventional charging methods can be used.

The image exposing unit 5 is an exposing unit to form a latent electrostatic image on the evenly charged electrophotographic photoconductor 1. For a light source for the image exposing unit 5, general light-emitting materials such as fluorescent lamp, tungsten lamp, mercury lamp, light-emitting diode (LED), semiconductor laser (LD) and electroluminescence (EL) can be used. To irradiate a target with only a light beam having a desired wavelength, various filters such as sharp-cut filter, band-pass filter, near-infrared cut filter, dichroic filter, interference filter and conversion filter for color temperature can also be used.

The developing unit 6 is a developing unit to visualize the latent electrostatic image formed on the electrophotographic photoconductor 1. For a developing method using the developing unit 6, there are one-component developing method using a dry-process toner, two-component developing method and wet-process developing method using a wet toner. For example, when a positive (negative) charge is applied to the electrophotographic photoconductor 1 to expose an image on the electrophotographic photoconductor, a positive (negative) latent electrostatic image is formed on the surface of the electrophotographic photoconductor 1. When the positive (negative) latent electrostatic image is developed using a toner with negative (positive) polarity (a fine particle can be detected by an electroscope), a positive image can be obtained, and when the positive (negative) latent electrostatic image is developed with a positive (negative) polarity, a negative image can be obtained.

The transfer charger 10 is a transferring unit configured to transfer a toner image visualized on the electrophotographic photoconductor 1 onto a transfer sheet 9. Here, a pre-transfer charger 7 can be used to more efficiently transfer the toner image. For the transferring unit, transfer charger 10, electrostatically transferring method using a bias roller, mechanical transfer method such as adhesion transfer method and pressure transfer method and magnetic transfer method can be utilized. For the electrostatically transferring method, the charging unit can be utilized.

Further, as units to separate the transfer sheet 9 from the electrophotographic photoconductor 1, a separation charger 11 and a separation blade 12 are used. For the other separation methods, separation by electrostatically adsorbing and inducing power, separation at side ends of a belt, conveyance with a grip end and separation using a curvature are usable. For a separation charger 11, the charging unit 3 can be utilized.

The cleaning unit is a unit configured to clean the surface of the electrophotographic photoconductor 1 by removing a residual toner remaining on the electrophotographic photoconductor 1 after transferring. For example, a fur brush 14 and a cleaning blade 15 are used for the cleaning unit. Further, to more efficiently clean the electrophotographic photoconductor surface, a pre-cleaning charger 13 may be used. For the other cleaning units, web method and magnetic brush method are exemplified, each of these methods may be used alone or two or more may be used at the same time.

Further, for the purpose of removing a latent image formed on the electrophotographic photoconductor surface, a charge eliminating unit is used in accordance with necessity. For the charge eliminating unit, a charge eliminating lamp 2 and a charge-eliminating charger are used, and the exposure light source and the charging unit can be utilized, respectively.

Resist rollers 8 are combined in a pair and the pair of rollers is a unit configured to send the transfer sheet 9 fed out from a tray in synchronized timing with the image formation on the electrophotographic photoconductor 1.

Besides, conventional units can be used for processes such as reading a document that is not proximately positioned to the electrophotographic photoconductor 1, paper sheet feeding, fixing, paper ejection and the like.

The present invention also provides an image forming process and an image forming apparatus, using an electrophotographic photoconductor according to the present invention for the above-noted image forming unit.

(Process Cartridge)

The image forming unit described above may be incorporated into copiers, facsimiles and printers in a fixed manner.

Figure 7:
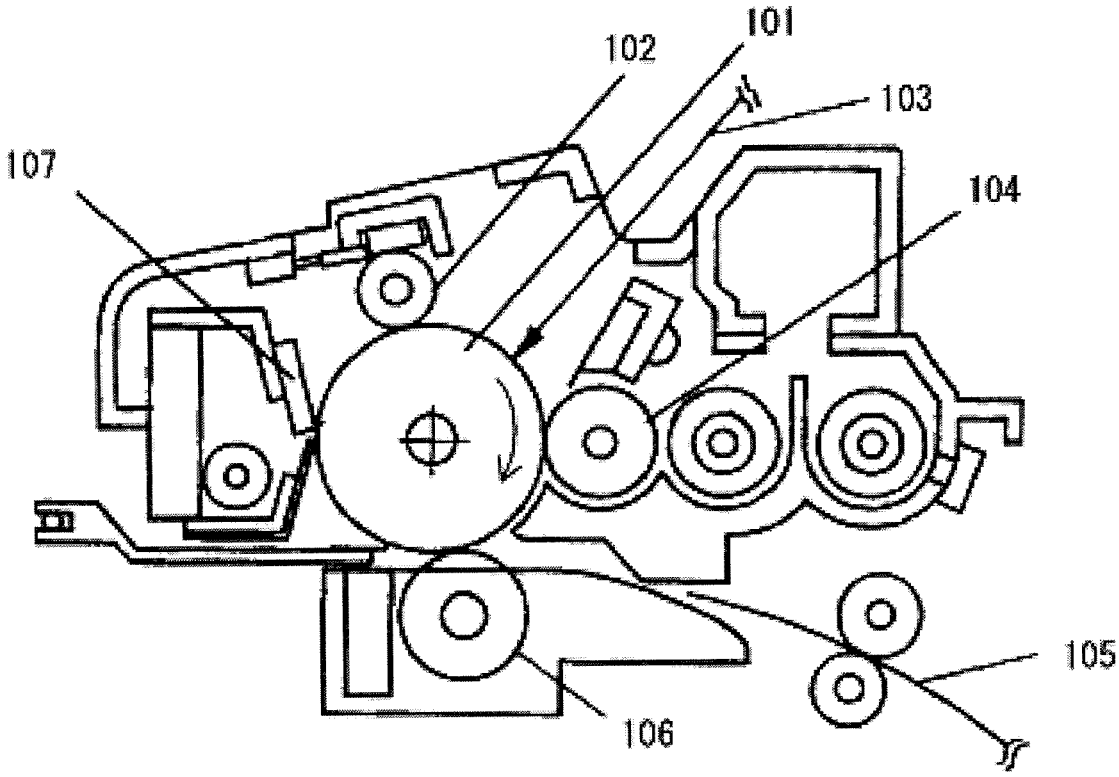
FIG. 7 is a schematic view exemplarily showing a structure of the process cartridge of the present invention.

The process cartridge is, as shown in FIG. 7, a device or a component that incorporates a photoconductor 1 and is equipped with at least one selected from a charging unit 102, an exposing unit 103, a developing unit 104, a transferring unit 106, a cleaning unit 107 and a charge eliminating unit (not shown) and is detachably mounted to the body of an image forming apparatus.

As shown in FIG. 7, in the image forming process using the process cartridge, while the photoconductor 1 is rotated in the direction indicated by the arrow, a latent electrostatic image corresponding to an exposed image is formed on the surface of the photoconductor 1 by a charging step using the charging unit 102 and by an exposing step using the exposing unit 103, the latent electrostatic image is developed by the developing unit 104 using a toner to form a toner image, and the developed toner image is transferred onto an image transferer 105 by the transferring unit 106 and then printed out. Subsequently, the photoconductor surface after the image transfer is cleaned by the cleaning unit 107, further charge-eliminated by the charge eliminating unit (not shown), and the operation is repeated again.

The present invention can provide an electrophotographic photoconductor that can solve the conventional problems and is capable of reducing latent electrostatic image stability defects caused by adhesion/adsorption of an electric discharge product formed by a charger in an image forming process, and reducing degradation of charge transportability and cleaning defects caused when removing a residual toner.

Further, the present invention can provide an image forming process, an image forming apparatus and a process cartridge used for the image forming apparatus each of which allows for high-speed printing and full-color printing or both of the printing techniques and down-sizing of a device resulting from smaller diameter photoconductor, keeping its cleaning ability for a long time and achieving high-quality images.

EXAMPLES

Hereinafter, the present invention will be further described in detail referring to specific Examples and Comparative Examples, however, the present invention is not limited to the disclosed Examples.

Example 1

Over the surface of an aluminum cylinder having a diameter (ϕ) of 30 mm serving as a conductive substrate, an undercoat layer, a charge generating layer coating solution and a charge transporting layer coating solution each containing the following composition were applied sequentially and the applied coating solution were dried to thereby form an undercoat layer having a thickness of 3.5 μm, a charge generating layer having a thickness of 0.2 μm and a charge transporting layer having a thickness of 18 μm on the conductive substrate.

[Composition of Undercoat Layer Coating Solution]

Alkyl resin . . . 6 parts by mass (BECKOZOLE1307-60-EL, manufactured by Dainippon Ink and Chemicals, Inc.)

Melamine resin . . . 4 parts by mass (SUPER BECKAMINE G-821-60, manufactured by Dainippon Ink and Chemicals, Inc.)

Titanium oxide . . . 40 parts by mass

Methylethylketone . . . 50 parts by mass

[Composition of Charge Generating Layer Coating Solution]

Bisazo pigment represented by the following Structural Formula (A) . . . 2.5 parts by mass Polyvinylbutyral . . . 0.5 parts by mass (XYHL, manufactured by UCC Co., Ltd.)

Cyclohexanone . . . 200 parts by mass

Methylethylketone . . . 80 parts by mass

Structural Formula (A)

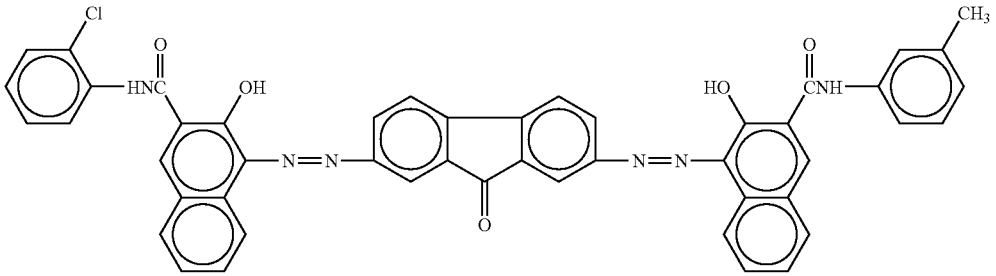

[Composition of Charge Transporting Layer Coating Solution]

Bisphenol Z polycarbonate . . . 10 parts by mass (PANLIGHT TS-2050, manufactured by Teijin Chemicals, Ltd.)

Low-molecular charge transporting material represented by the following Structural Formula (B) . . . 7 parts by mass Tetrahydrofuran . . . 100 parts by mass 1% silicone oil-containing tetrahydrofuran solution (KF50-100CS, manufactured by Shin-Etsu Chemical Co., Ltd.) . . . 1 part by mass Structural Formula (B)

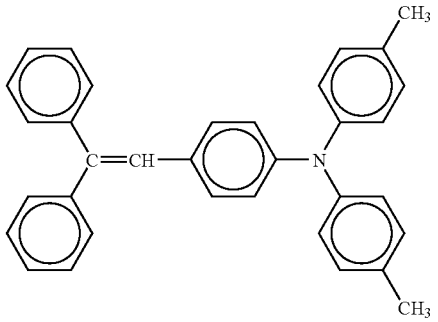

Next, into the electrophotographic photoconductor obtained by the above-noted method an injection material (hereinafter, may be referred to as "wax component") was injected using a supercritical fluid. In Example 1, a carbon dioxide was used as the supercritical fluid. First, 0.7 g (content: 1.0 g/L) of a highly pure paraffin wax (HNP-5, (melting point: 62° C.) manufactured by NIPPON SEIRO CO., LTD.), as the wax component, was weighed and put in a pressure-resistant cell with an inner volume of 700 mL. Then the electrophotographic photoconductor was also placed in the pressure-resistant cell and then the pressure-resistant cell was sealed.

Next, carbon dioxide was supplied to the pressure-resistant cell, the pressure and the temperature of the pressure-resistant cell was adjusted to 30 MPa and 80° C. using a pressurization pump and a temperature regulator. After the temperature and the pressure were stabilized, the pressure-resistant cell was sealed and left intact for 1 hour. After leaving the pressure-resistant cell at rest, the pressure of the pressure-resistant cell was reduced to 10 MPa while maintaining the temperature to 80° C. and a wax component that had not been injected to the electrophotographic photoconductor was removed from the pressure-resistant cell by flowing carbon dioxide at a flow rate of 8 L/min for 30 minutes using the pressurizing pump and a back pressure valve while maintaining the pressure constant. After the removing treatment, the temperature and the pressure were gradually reduced to the ambient atmosphere to thereby prepare an electrophotographic photoconductor of the present invention.

Example 2

An electrophotographic photoconductor was prepared in the same manner as in Example 1 except that the wax component used in Example 1 was changed to a highly pure paraffin wax (HNP-51, manufactured by NIPPON SEIRO CO., LTD. (melting point: 77° C.)) and the treatment temperature using supercritical carbon dioxide was changed to 100° C.

Example 3

An electrophotographic photoconductor was prepared in the same manner as in Example 2 except that the wax component used in Example 2 was changed to a Fisher-Tropsh wax (FT-5165, manufactured by NIPPON SEIRO CO., LTD. (melting point: 72° C.)).

Example 4

An electrophotographic photoconductor was prepared in the same manner as in Example 1 except that the wax component used in Example 1 was changed to a Fisher-Tropsh wax (FT-105, manufactured by NIPPON SEIRO CO., LTD. (melting point: 104° C.)) and the treatment temperature using supercritical carbon dioxide was changed to 120° C.

Example 5

An electrophotographic photoconductor was prepared in the same manner as in Example 4 except that the wax component used in Example 4 was changed to a polyethylene wax (HIGH WAX P110, manufactured by Mitsui Chemicals, Inc. (melting point: 109° C.)).

Example 6

An electrophotographic photoconductor was prepared in the same manner as in Example 4 except that the wax component used in Example 4 was changed to a polyethylene wax (SAN WAX 165, manufactured by Mitsui Chemicals, Inc. (melting point: 104° C.)).

Example 7

Over the surface of an electrophotographic photoconductor having a conductive substrate, an undercoat layer, a charge generating layer and a charge transporting layer, which had been prepared by the same method as described in Example 1 but had not yet been injected with a supercritical fluid, a surface layer coating solution containing the following composition was applied. The applied coating solution was irradiated with a UV lamp system (metal halide lamp, manufactured by Ushio Denki K.K.) under the condition of an illuminance of 450 mW/cm$^2$ and an irradiation time of 90 seconds while rotating the photoconductor drum to crosslink a surface layer, thereby a surface hardened having a thickness of 5 μm was obtained. Thereafter, the surface hardened layer was dried at 130° C. for 30 minutes, thereby preparing an electrophotographic photoconductor having a conductive substrate, an undercoat layer, a charge generating layer, a charge transporting layer and a surface layer.

[Composition of Surface Layer Coating Solution]

Compound having a charge transporting structure represented by the following Structural Formula (C) 95 parts by mass Radically polymerizable compound having no charge transporting structure represented by the following Structural Formula (D) . . . 95 parts by mass Photopolymerization initiator . . . 10 parts by mass 2-hydroxy-1{4-[4-(2-hydroxy-2-methyl-propionyl)-benzyl]-phenyl}-2-methyl-propane-1-one (IRGACURE 127, manufactured by Chiba Specialty Chemicals K.K.)

Tetrahydrofuran . . . 1,200 parts by mass

Structural Formula (C)

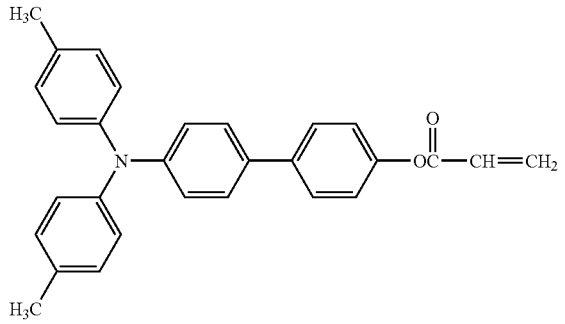

Structural Formula(D)

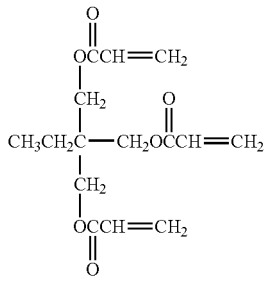

The thus obtained electrophotographic photoconductor having a conductive substrate, an undercoat layer, a charge generating layer, a charge transporting layer and a crosslinked surface layer was subjected to an injection treatment using a supercritical fluid in the same manner as in Example 1 to thereby prepare an electrophotographic photoconductor.

Example 8

An electrophotographic photoconductor was prepared in the same manner as in Example 1 except that the wax component used in Example 7 was changed to a highly pure paraffin wax (HNP-51, manufactured by NIPPON SEIRO CO., LTD. (melting point: 77° C.)) and the treatment temperature using supercritical carbon dioxide was changed to 100° C.

Example 9

An electrophotographic photoconductor was prepared in the same manner as in Example 8 except that the wax component used in Example 8 was changed to a Fisher-Tropsh wax (FT-5165, manufactured by NIPPON SEIRO CO., LTD. (melting point: 72° C.)).

Example 10

An electrophotographic photoconductor was prepared in the same manner as in Example 7 except that the wax component used in Example 7 was changed to a Fisher-Tropsh wax (FT-105, manufactured by NIPPON SEIRO CO., LTD. (melting point: 104° C.)) and the treatment temperature using supercritical carbon dioxide was changed to 120° C.

Example 11

An electrophotographic photoconductor was prepared in the same manner as in Example 10 except that the wax component used in Example 10 was changed to a polyethylene wax (HIGH WAX P110, manufactured by Mitsui Chemicals, Inc. (melting point: 109° C.)).

Example 12

An electrophotographic photoconductor was prepared in the same manner as in Example 10 except that the wax component used in Example 10 was changed to a polyethylene wax (SAN WAX 165, manufactured by Sanyo Chemical Industries, Ltd. (melting point: 104° C.)).

Examples 13 to 15

Electrophotographic photoconductors of Examples 13 to 15 were respectively prepared in the same manner as in Examples 2, 3 and 5 except that the amount of the wax component weighed and put in the supercritical carbon dioxide in Examples 2, 3 and 5 was changed to 2.1 g.

Examples 16 to 18

Electrophotographic photoconductors of Examples 16 to 18 were respectively prepared in the same manner as in Examples 8, 9 and 11 except that the amount of the wax component weighed and put in the supercritical carbon dioxide in Examples 8, 9 and 11 was changed to 2.1 g.

Examples 19 to 21

Electrophotographic photoconductors of Examples 19 to 21 were respectively prepared in the same manner as in Examples 8, 9 and 11 except that the temperature of the supercritical carbon dioxide used in Examples 8, 9 and 11 was changed to 50° C.

Examples 22 to 24

Electrophotographic photoconductors of Examples 22 to 24 were respectively prepared in the same manner as in Examples 8, 9 and 11 except that the temperature of the supercritical carbon dioxide used in Examples 8, 9 and 11 was changed to 150° C.

Example 25

An electrophotographic photoconductor was prepared in the same manner as in Example 2 except that the wax component used in Example 2 was changed to a polypropylene wax (VISCOL 666-P, manufactured by Sanyo Chemical Industries, Ltd. (melting point: 142° C.)).

Example 26

An electrophotographic photoconductor was prepared in the same manner as in Example 25 except that the temperature of the supercritical carbon dioxide used in Example 25 was changed to 150° C.

Example 27

An electrophotographic photoconductor was prepared in the same manner as in Example 16 except that the wax component used in Example 16 was changed to a polypropylene wax (VISCOL 666-P, manufactured by Sanyo Chemical Industries, Ltd. (melting point: 142° C.)).

Example 28

An electrophotographic photoconductor was prepared in the same manner as in Example 27 except that the temperature of the supercritical carbon dioxide used in Example 27 was changed to 150° C.

Example 29

An electrophotographic photoconductor was prepared in the same manner as in Example 11 except that the compound represented by Structural Formula (C) used in Example 11 was changed to a compound represented by the following Structural Formula (E).

Structural Formula (E)

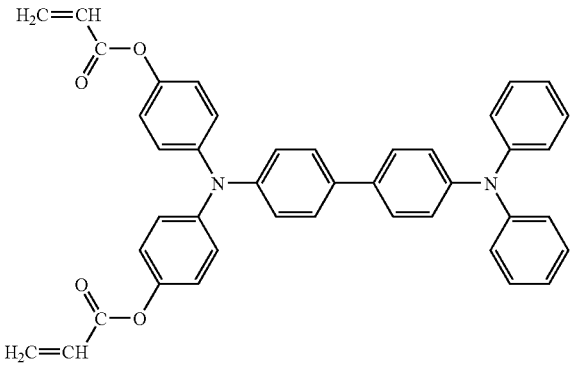

Example 30

An electrophotographic photoconductor was prepared in the same manner as in Example 11 except that the compound represented by Structural Formula (C) used in Example 11 was changed to a compound represented by the following Structural Formula (F).

Structural Formula (F)

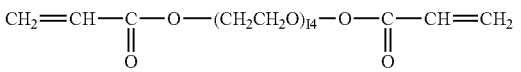

Example 31

An electrophotographic photoconductor was prepared in the same manner as in Example 11 except that the radically polymerizable compound having no charge transporting structure represented by Structural Formula (D) used in Example 11 was changed to a compound represented by the following Structural Formula (G).

Structural Formula (G)

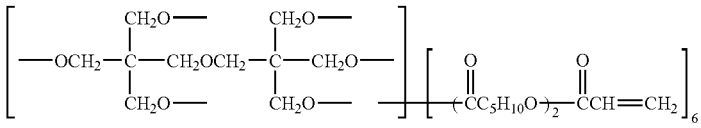

Example 32

An electrophotographic photoconductor was prepared in the same manner as in Example 11 except that for the radically polymerizable compound having no charge transporting structure, a radically polymerizable compound having no charge transporting structure represented by Structural Formula (D) and a radically polymerizable compound having no charge transporting structure represented by Structural Formula (G) were mixed and used at a mass ratio of 5:5.

Example 33

Over the surface of an aluminum cylinder having a diameter (ϕ) of 30 mm, a photosensitive layer coating solution containing the following composition was applied and the applied coating solution was dried to thereby a single layer photoconductor having a thickness of 22 μm.

[Composition of Photosensitive Layer Coating Solution]

Bisazo pigment represented by Structural Formula (A) . . . 1.0 part by mass

Naphthalenetetracarboxylate diimide derivative represented by the following Structural Formula (H) . . . 25.0 parts by mass Triarylamine compound represented by the following Structural Formula (I) . . . 25.0 parts by mass Bisphenol Z polycarbonate . . . 50.0 parts by mass Tetrahydrofuran . . . 800 parts by mass 1% silicone oil-containing tetrahydrofuran solution (KF50-100CS, manufactured by Shin-Etsu Chemical Co., Ltd.) . . . 1 part by mass Structural Formula (H)

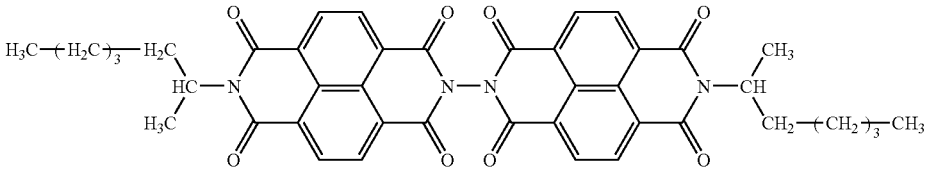

Structural Formula (I)

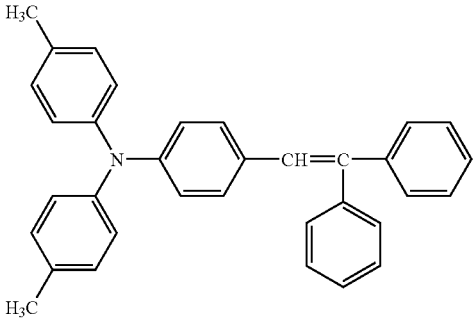

Next, an electrophotographic photoconductor having a conductive substrate, a photosensitive layer and a surface layer was formed by forming the surface layer on a single layer photoconductor in the same manner as in Example 9. Thereafter, the electrophotographic photoconductor was subjected to an injection treatment using the supercritical fluid under the same conditions as used in Example 9 to thereby prepare an electrophotographic photoconductor.

Example 34

An electrophotographic photoconductor having a conductive substrate, a photosensitive layer and a surface layer was formed in the same manner as in Example 33 and then the electrophotographic photoconductor was subjected to an injection treatment using the supercritical fluid under the same conditions as used in Example 11 to thereby prepare an electrophotographic photoconductor.

Example 35

An electrophotographic photoconductor was prepared in the same manner as in Example 1 except that the material put in the supercritical fluid in Example 1 was changed to a polyorganosiloxane (2503 COSMETIC WAX, manufactured by DOW CORNING TORAY SILICONE CO., LTD. (melting point: 32° C.)) and the temperature of the supercritical fluid was changed to 40° C.

Example 36

An electrophotographic photoconductor was prepared in the same manner as in Example 35 except that the temperature of the supercritical carbon dioxide used in Example 35 was changed to 80° C.

Example 37

An electrophotographic photoconductor was prepared in the same manner as in Example 35 except that the temperature of the supercritical carbon dioxide used in Example 35 was changed to 130° C.

Examples 38 to 40

Electrophotographic photoconductors of Examples 38 to 40 were respectively prepared in the same manner as in Examples 35 to 37 except that the polyorganosiloxane used in Examples 35 to 37 was changed to a wax, AMS-C30 WAX (manufactured by DOW CORNING TORAY SILICONE CO., LTD. (melting point: 70° C.)).

Examples 41 to 43

Electrophotographic photoconductors of Examples 41 to 43 were respectively prepared in the same manner as in Examples 35 to 37 except that the polyorganosiloxane used in Examples 35 to 37 was changed to a wax, 2-8178 GALLANT (manufactured by DOW CORNING TORAY SILICONE CO., LTD. (melting point: 97° C.)).

Examples 44 to 46

Electrophotographic photoconductors of Examples 44 to 46 were respectively prepared in the same manner as in Examples 35 to 37 except that the amount of the polyorganosiloxane weighed and put in the supercritical carbon dioxide in Examples 35 to 37 was changed to 2.1 g.

Examples 47 to 48

Electrophotographic photoconductors of Examples 47 to 48 were respectively prepared in the same manner as in Examples 39 to 40 except that the amount of the polyorganosiloxane weighed and put in the supercritical carbon dioxide in Examples 39 to 40 was changed to 2.1 g.

Example 49

An electrophotographic photoconductor was prepared in the same manner as in Example 43 except that the amount of the polyorganosiloxane weighed and put in the supercritical carbon dioxide in Example 43 was changed to 2.1 g.

Examples 50 to 52

Electrophotographic photoconductors of Examples 50 to 52 were respectively prepared in the same manner as in Examples 35, 38 and 41 except that the temperature of the supercritical carbon dioxide used in Examples 35, 38 and 41 was changed to 150° C.

Example 53

An electrophotographic photoconductor was prepared in the same manner as in Example 7 except that the material put in the supercritical fluid in Example 7 was changed to a polyorganosiloxane (2503 COSMETIC WAX, manufactured by DOW CORNING TORAY SILICONE CO., LTD. (melting point: 32° C.)) and the temperature of the supercritical fluid was changed to 40° C.

Example 54

An electrophotographic photoconductor was prepared in the same manner as in Example 53 except that the temperature of the supercritical carbon dioxide was changed to 80° C.

Example 55

An electrophotographic photoconductor was prepared in the same manner as in Example 53 except that the temperature of the supercritical carbon dioxide was changed to 130° C.

Examples 56 and 57

Electrophotographic photoconductors of Examples 56 and 57 were respectively prepared in the same manner as in Examples 54 and 55 except that the polyorganosiloxane used in Examples 54 and 55 was changed to a wax, AMS-C30 WAX (manufactured by DOW CORNING TORAY SILICONE CO., LTD. (melting point: 70° C.)).

Example 58

An electrophotographic photoconductors was prepared in the same manner as in Example 55 except that the polyorganosiloxane used in Example 55 was changed to a wax, 2-8178 GALLANT (manufactured by DOW CORNING TORAY SILICONE CO., LTD. (melting point: 97° C.)).

Example 59

An electrophotographic photoconductor having a conductive substrate, a photosensitive layer and a surface layer was formed in the same manner as in Example 33 and then the electrophotographic photoconductor was subjected to an injection treatment using the supercritical fluid under the same conditions as used in Example 39 to thereby prepare an electrophotographic photoconductor.

Example 60

An electrophotographic photoconductor having a conductive substrate, a photosensitive layer and a surface layer was formed in the same manner as in Example 33 and then the electrophotographic photoconductor was subjected to an injection treatment using the supercritical fluid under the same conditions as used in Example 43 to thereby prepare an electrophotographic photoconductor.

Comparative Example 1

An electrophotographic photoconductor of Comparative Example 1 was prepared by forming an undercoat layer, a charge generating layer and a charge transporting layer in this order on a conductive substrate in the same manner as in Example 1 without subjecting it to an injection treatment using the supercritical fluid.

Comparative Example 2

An electrophotographic photoconductor having a conductive substrate, an undercoat layer, a charge generating layer, a charge transporting layer and a surface layer that could be obtained before subjecting it to an injection treatment using the supercritical carbon dioxide in Example 7 was regarded as an electrophotographic photoconductor of Comparative Example 2.

Comparative Examples 3 to 6

Electrophotographic photoconductors each having a conductive substrate, an undercoat layer, a charge generating layer, a charge transporting layer and a surface layer that could be obtained before subjecting them to an injection treatment using the supercritical carbon dioxide in Examples 29 to 32 were regarded as electrophotographic photoconductors of Comparative Examples 3 to 6.

Comparative Example 7

An electrophotographic photoconductor having a conductive substrate, a photosensitive layer and a surface layer that could be obtained before subjecting it to an injection treatment using the supercritical carbon dioxide was regarded as an electrophotographic photoconductor of Comparative Example 7.

Comparative Example 8

An electrophotographic photoconductor was prepared in the same manner as in Example 1 except that the surface layer coating solution used in Example 7 was changed to the following coating solution and no injection treatment was carried out.

[Composition of Surface Layer Coating Solution]

Compound having a charge transporting structure represented by Structural Formula (C) . . . 95 parts by mass Radically polymerizable compound having no charge transporting structure represented by Structural Formula (D) . . . 95 parts by mass Photopolymerization initiator used in Example 7 . . . 10 parts by mass Polyethylene wax HIGH WAX P110 . . . 25 parts by mass Tetrahydrofuran . . . 1,200 parts by mass Comparative Examples 9 to 11

Electrophotographic photoconductors of Comparative Examples 9 to 11 were prepared in the same manner as in Examples 2, 3 and 5 except that the amount of the wax component weighed and put in the supercritical carbon dioxide in Examples 2, 3 and 5 was changed to 0.10 g.

Comparative Examples 12 to 14

Electrophotographic photoconductors of Comparative Examples 12 to 14 were prepared in the same manner as in Examples 8, 9 and 11 except that the amount of the wax component weighed and put in the supercritical carbon dioxide in Examples 8, 9 and 11 was changed to 0.10 g.

Comparative Examples 15 to 17

Electrophotographic photoconductors of Comparative Examples 15 to 17 were prepared in the same manner as in Examples 8, 9 and 11 except that the amount of the wax component weighed and put in the supercritical carbon dioxide in Examples 8, 9 and 11 was changed to 3.5 g.

Comparative Example 18

An electrophotographic photoconductor was prepared in the same manner as in Example 11 except that the wax component used in Example 11 was changed to a montan wax (LICOWAX OP, manufactured by Clariant Japan K.K. (melting point: 100° C.)).

Comparative Example 19

An electrophotographic photoconductor was prepared in the same manner as in Example 8 except that the wax component used in Example 8 was changed to a montan wax (LICOWAX E, manufactured by Clariant Japan K.K. (melting point: 80° C.)).

Comparative Example 20

An electrophotographic photoconductor of Comparative Example 20 was prepared in the same manner as in Example 1 except that the composition of the charge transporting layer coating solution used in Example 1 was changed to the following composition and no injection treatment was carried out.

[Composition of Charge Transporting Layer Coating Solution]

Bisphenol Z polycarbonate . . . 10 parts by mass (PANLIGHT TS-2050, manufactured by Teijin Chemicals, Ltd.)

Low-molecular charge transporting material represented by Structural Formula (B) . . . 7 parts by mass Tetrahydrofuran . . . 100 parts by mass 0.1% silicone oil-containing tetrahydrofuran solution (KF50-100CS, manufactured by Shin-Etsu Chemical Co., Ltd.) . . . 1 part by mass 2503 COSMETIC WAX . . . 0.3 parts by mass (silicone resin manufactured by DOW CORNING TORAY SILICONE CO., LTD. (melting point: 32° C.)) . . . 0.3 parts by mass Comparative Example 21

An electrophotographic photoconductor was prepared in the same manner as in Comparative Example 20 except that the polyorganosiloxane used in the charge transporting layer coating solution in Comparative Example 20 was changed to a polyorganosiloxane (AMS-C30 WAX, manufactured by DOW CORNING TORAY SILICONE CO., LTD. (melting point: 70° C.)).

Comparative Example 22

An electrophotographic photoconductor was prepared in the same manner as in Comparative Example 20 except that the polyorganosiloxane used in the charge transporting layer coating solution in Comparative Example 20 was changed to a polyorganosiloxane (2-8178 GALLANT, manufactured by DOW CORNING TORAY SILICONE CO., LTD. (melting point: 97° C.)).

Comparative Example 23

An electrophotographic photoconductor of Comparative Example 23 was prepared in the same manner as in Example 1 except that the electrophotographic photoconductor was subjected to an injection treatment without adding an injection material into the supercritical fluid.

Comparative Examples 24 to 29

Electrophotographic photoconductors of Comparative Examples 24 to 29 were prepared in the same manner as in Examples 35 to 37, 39 to 40 and 43 except that the added amount of the polyorganosiloxane to the supercritical fluid in Examples 35 to 37, 39 to 40 and 43 was changed to 0.1 g/L.

<Concentration of Polyorganosiloxane in Electrophotographic Photoconductor>

Each of the electrophotographic photoconductors obtained in Examples 35 to 60 and Comparative Examples 1 to 7 and 20 to 29 was cut from the surface thereof in an oblique direction as shown in FIG. 5 and the concentration of polyorganosiloxane in an area from the surface of each of the electrophotographic photoconductors to 50% of the thickness of the photosensitive layer was determined by the above-noted method. Table 1 shows the measurement results.

TABLE 1

| | Detected amount of siloxane (% by mass) |
|---|---|
| Ex. 35 | 4.2 |
| Ex. 36 | 4.7 |
| Ex. 37 | 5 |
| Ex. 38 | 3.3 |
| Ex. 39 | 3.7 |
| Ex. 40 | 4 |
| Ex. 41 | 3.1 |
| Ex. 42 | 3.3 |
| Ex. 43 | 3.5 |
| Ex. 44 | 4.6 |
| Ex. 45 | 5.2 |
| Ex. 46 | 5.7 |
| Ex. 47 | 3.9 |

TABLE 1-continued

| | Detected amount of siloxane (% by mass) |
|---|---|
| Ex. 48 | 4.5 |
| Ex. 49 | 3.7 |
| Ex. 50 | 5.2 |
| Ex. 51 | 4.1 |
| Ex. 52 | 3.6 |
| Ex. 53 | 3.9 |
| Ex. 54 | 4.2 |
| Ex. 55 | 4.5 |
| Ex. 56 | 3.7 |
| Ex. 57 | 4.2 |
| Ex. 58 | 4.1 |
| Ex. 59 | 3.9 |
| Ex. 60 | 4.1 |
| Compara. Ex. 1 | 0 |
| Compara. Ex. 2 | 0 |
| Compara. Ex. 3 | 0 |
| Compara. Ex. 4 | 0 |
| Compara. Ex. 5 | 0 |
| Compara. Ex. 6 | 0 |
| Compara. Ex. 7 | 0 |
| Compara. Ex. 20 | 0 |
| Compara. Ex. 21 | 0 |
| Compara. Ex. 22 | 0 |
| Compara. Ex. 23 | 0 |
| Compara. Ex. 24 | less than 1.0 |
| Compara. Ex. 25 | less than 1.0 |
| Compara. Ex. 26 | less than 1.0 |
| Compara. Ex. 27 | less than 1.0 |
| Compara. Ex. 28 | less than 1.0 |
| Compara. Ex. 29 | less than 1.0 |

It turned out that a relatively large amount of polyorganosiloxane was injected into the inside of the electrophotographic photoconductors prepared in Examples 35 to 60.

In contrast, in the electrophotographic photoconductors prepared in Comparative Examples 1 to 7, no polyorganosiloxane was detected inside the photosensitive layers.

The results demonstrated that polyorganosiloxane was not injected into the electrophotographic photoconductors that had not yet been subjected to an injection treatment using the supercritical fluid as described in the Comparative Examples 1 to 7 and polyorganosiloxane was virtually injected into the inside of the electrophotographic photoconductors of Examples 35 to 60 by the injection treatment.

The electrophotographic photoconductors prepared in Comparative Examples 20 to 22 are those using a charge transporting layer coating solution in which polyorganosiloxane had been added, however, there was little polyorganosiloxane detected inside the respective photosensitive layers. This is conceivable because a large amount of polyorganosiloxane was unevenly distributed on the surface of the respective photosensitive layers.

For the electrophotographic photoconductors of Comparative Examples 24 to 29, a slightly amount of polyorganosiloxane was detected inside the respective photosensitive layers, however, it was impossible to accurately determine the concentration of polyorganosiloxane in each of the photosensitive layer obtained in Comparative Examples 24 to 29 because the measured values varied widely.

In the electrophotographic photoconductors obtained in Examples 38 and 41 to 42, the injected amount of polyorganosiloxane was small, however, polyorganosiloxane was detected in the inside of the electrophotographic photoconductors.

<Moisture Content of Electrophotographic Photoconductor>

Moisture contents of the electrophotographic photoconductors obtained in Examples 1 to 34 and Comparative Examples 1 to 19 were measured using the Karl Fisher moisture meter under the measurement conditions described above. The layer thickness of samples used for the measurement of moisture content was previously measured and then respectively cut out into 30 mm×20 mm. The cut samples were left intact in a thermo-hygrostat chamber for 48 hours and then used. Thereafter, moisture contents ($\mu g/mm^3$) of the respective electrophotographic photoconductors were calculated from each film volume based on the measurement results. Table 2 shows the calculation results.

TABLE 2

| | Moisture content ($\mu g/mm^3$) |
|---|---|
| Ex. 1 | 0.6 |
| Ex. 2 | 0.9 |
| Ex. 3 | 0.7 |
| Ex. 4 | 0.8 |
| Ex. 5 | 1.1 |
| Ex. 6 | 1 |
| Ex. 7 | 0.8 |
| Ex. 8 | 1.2 |
| Ex. 9 | 0.8 |
| Ex. 10 | 1.4 |
| Ex. 11 | 1.6 |
| Ex. 12 | 1.5 |
| Ex. 13 | 0.3 |
| Ex. 14 | 0.4 |
| Ex. 15 | 0.3 |
| Ex. 16 | 0.9 |
| Ex. 17 | 0.8 |
| Ex. 18 | 1.1 |
| Ex. 19 | 1.9 |
| Ex. 20 | 2 |
| Ex. 21 | 2.3 |
| Ex. 22 | 0.9 |
| Ex. 23 | 1.3 |
| Ex. 24 | 1.5 |
| Ex. 25 | 2.5 |
| Ex. 26 | 2.1 |
| Ex. 27 | 2.7 |
| Ex. 28 | 2.9 |
| Ex. 29 | 1.8 |
| Ex. 30 | 1.5 |
| Ex. 31 | 1.2 |
| Ex. 32 | 1.5 |
| Ex. 33 | 0.9 |
| Ex. 34 | 1.2 |
| Compara. Ex. 1 | 3.8 |
| Compara. Ex. 2 | 5.8 |
| Compara. Ex. 3 | 6.2 |
| Compara. Ex. 4 | 5.1 |
| Compara. Ex. 5 | 5.5 |
| Compara. Ex. 6 | 5.3 |
| Compara. Ex. 7 | 4.1 |
| Compara. Ex. 8 | 4.2 |
| Compara. Ex. 9 | 3.3 |
| Compara. Ex. 10 | 3.5 |
| Compara. Ex. 11 | 3.5 |
| Compara. Ex. 12 | 3.9 |
| Compara. Ex. 13 | 3.7 |
| Compara. Ex. 14 | 4.5 |
| Compara. Ex. 15 | —(*1) |
| Compara. Ex. 16 | —(*1) |
| Compara. Ex. 17 | —(*1) |
| Compara. Ex. 18 | 2.1 |
| Compara. Ex. 19 | 1.6 |

(*1)Moisture content was not measured because the surface of the electrophotographic photoconductor was significantly rough after the injection treatment.

As shown in Table 2, the moisture content results of the electrophotographic photoconductors prepared in Examples 1 to 6, 13 to 15 or Examples 7 to 12 and 16 to 18 as contrasted with the moisture content results of the electrophotographic photoconductors prepared in Comparative Examples 1 to 7 into which no wax had not been injected verified that the moisture content was drastically reduced by a treatment using the supercritical fluid described in the present invention. This is conceivable because a wax was injected to the respective surface layers and photosensitive layers by subjecting a treatment using the supercritical fluid and the gas permeability of these layers was reduced.

The electrophotographic photoconductors prepared in Examples 19 to 21 into which the wax component had been injected at a temperature lower than the melting point of the injected wax had a relatively high moisture content, however, the moisture contents thereof were virtually reduced to about the half of the moisture content of the electrophotographic photoconductor of Comparative Example 2 of which an injection treatment of a wax component using the supercritical fluid had not been carried out. Thus, effect of the injection of the wax component is recognized.

In the electrophotographic photoconductors prepared in Examples 22 to 24 of which the temperature condition was set at 150° C., convexoconcaves or irregularities were observed on the surfaces thereof, although the moisture contents thereof were significantly reduced.

The electrophotographic photoconductors of Examples 16 to 17 using a wax having a relatively high melting point had less reduction in moisture content as compared to the electrophotographic photoconductors of Examples 7 to 12, however, it can safely be said that the wax component was injected to the respective photosensitive layers of the electrophotographic photoconductors of Examples 16 to 17 in comparison with the electrophotographic photoconductor of Comparative Example 2 of which an injection treatment of a wax component using the supercritical fluid had not been carried out.

Further, for the electrophotographic photoconductors of Examples 29 to 32 of which the radically polymerizable compound having no charge transporting structure or the radically polymerizable compound having a charge transporting structure had been replaced, the moisture content was very low, and thus it is conceivable that the wax component was injected into the electrophotographic photoconductors as compared to the electrophotographic photoconductors of Comparative Examples 3 to 6.

In the meanwhile, the electrophotographic photoconductors of Comparative Examples 9 to 14 using a low wax content at the time of an injection treatment using the supercritical fluid had a low moisture content as compared to the electrophotographic photoconductors of Comparative Examples 1 to 2 of which an injection treatment of a wax component using the supercritical fluid had not been carried out. Thus, it is conceivable that the wax component was injected into the electrophotographic photoconductors of Comparative Examples 9 to 14, however, it is deemed that the electrophotographic photoconductors had a higher moisture content and a lower injected wax content than the electrophotographic photoconductors of Examples 1 to 12.

For the electrophotographic photoconductors of Comparative Examples 15 to 17 using a very high wax content at the time of an injection treatment using the supercritical fluid, a visual check confirmed that the electrophotographic photoconductors had convexoconcaves or irregularities on their surfaces under the injection treatment conditions and had, in places, white spots that seemed wax deposition. For this reason, the moisture content of the electrophotographic photoconductors of Comparative Examples 15 to 17 were not evaluated using the moisture meter.

In the electrophotographic photoconductors of Comparative Examples 18 to 19, a significant reduction in moisture content was recognized, just like the electrophotographic photoconductors of Examples 7 to 12.

<Evaluation of Output Image after Subjecting Photoconductor to $No_x$ Gas Exposure Test>

The electrophotographic photoconductors having a surface layer (Examples 7 to 12, 16 to 24, 27 to 32, 53 to 58 and Comparative Examples 2, 8, 12 to 19) were exposed in a nitric oxide atmosphere under the following conditions. Two hours later upon completion of the exposure, a half-tone image was output using an image forming apparatus and reduction in resolution was evaluated based on the following evaluation criteria. As the image forming apparatus, a machine remodeled from IPSIO COLOR CX900 manufactured by Ricoh Company Ltd. was used. In the remodeling, a lubricant bar was removed from a process cartridge to preliminarily remodel the copier so as not to supply a lubricant from outside. For a toner, IPSIO TONER type 9800 was used. For paper sheet used in the test using the image forming apparatus, MYPAPER (A 4 size) manufactured by NBS Ricoh Company Ltd. was used. Table 3 shows the evaluation results.

<Exposure Conditions>

Nitric oxide: NO and $NO_2$
Atmosphere gas: room air
Concentration of nitric oxide: NO 40 ppm/$NO_2$ 10 ppm
Exposure time: 48 hours

[Evaluation Criteria]

Evaluation Ranks

5: A reduction in resolution was hardly observed.
4: The resolution was slightly reduced.
3: The resolution was reduced.
2: Part of dots could not be formed.
1: Dots could not be formed as a whole.

TABLE 3

| | Reduction in resolution |
|---|---|
| Ex. 7 | 5 |
| Ex. 8 | 5 |
| Ex. 9 | 5 |
| Ex. 10 | 5 |
| Ex. 11 | 5 |
| Ex. 12 | 5 |
| Ex. 16 | 5 |
| Ex. 17 | 5 |
| Ex. 18 | 5 |
| Ex. 19 | 4 |
| Ex. 20 | 4 |
| Ex. 21 | 4 |
| Ex. 22 | 5 |
| Ex. 23 | 5 |
| Ex. 24 | 5 |
| Ex. 27 | 4 |
| Ex. 28 | 4 |
| Ex. 29 | 5 |
| Ex. 30 | 5 |
| Ex. 31 | 5 |
| Ex. 32 | 5 |
| Ex. 53 | 5 |
| Ex. 54 | 5 |
| Ex. 55 | 5 |
| Ex. 56 | 5 |
| Ex. 57 | 5 |
| Ex. 58 | 5 |
| Compara. Ex. 2 | 2 |
| Compara. Ex. 8 | 3 |
| Compara. Ex. 12 | 2 |
| Compara. Ex. 13 | 2 |

TABLE 3-continued

| | Reduction in resolution |
|---|---|
| Compara. Ex. 14 | 2 |
| Compara. Ex. 15 | —(*1) |
| Compara. Ex. 16 | —(*1) |
| Compara. Ex. 17 | —(*1) |
| Compara. Ex. 18 | 4(*2) |
| Compara. Ex. 19 | 4(*2) |

(*1)Moisture content was not measured because the surface of the electrophotographic photoconductor was significantly rough after the injection treatment.
(*2)A reduction in image density occurred from the initial stage As shown in Table 3, in comparison with the electrophotographic photoconductors of which an injection treatment of a wax component using the supercritical fluid had not been carried out, a reduction in resolution was hardly observed in the electrophotographic photoconductors obtained in the Examples of the present invention to a greater or lesser extent.

In the meanwhile, the electrophotographic photoconductor of Comparative Example 8 was an electrophotographic photoconductor having the same layer configuration as that of Example 11, but had a different result from the result of Example 11, i.e., a reduction in resolution was confirmed. However, as compared with the electrophotographic photoconductor of Comparative Example 2 of which an injection treatment of a wax component using the supercritical fluid had not been carried out, the reduction in resolution was slightly prevented. It is conceivable that the result shows that a crosslinked surface layer prepared by preliminarily adding a wax cannot supplement a free volume formed when being crosslinked, although the crosslinked surface layer has some gas permeability and shows improvement in gas adsorption.

Similarly, in the electrophotographic photoconductors of Comparative Examples 12 to 14, a reduction in resolution was observed as well. Further, in the electrophotographic photoconductors of Comparative Examples 18 to 19, a large reduction in resolution was not observed, however, a phenomenon that the halftone output image density before the gas exposure test had been weak or faint was confirmed.

<Evaluation of Cleaning Ability Based on Running Test>

The electrophotographic photoconductors having no surface layer prepared in Examples and Comparative Examples and the electrophotographic photoconductors each having a surface layer were respectively subjected to a running test using 50,000 sheets and 100,000 sheets in the following manner.

<<Running Test/Evaluation Method>>

Figure 8:
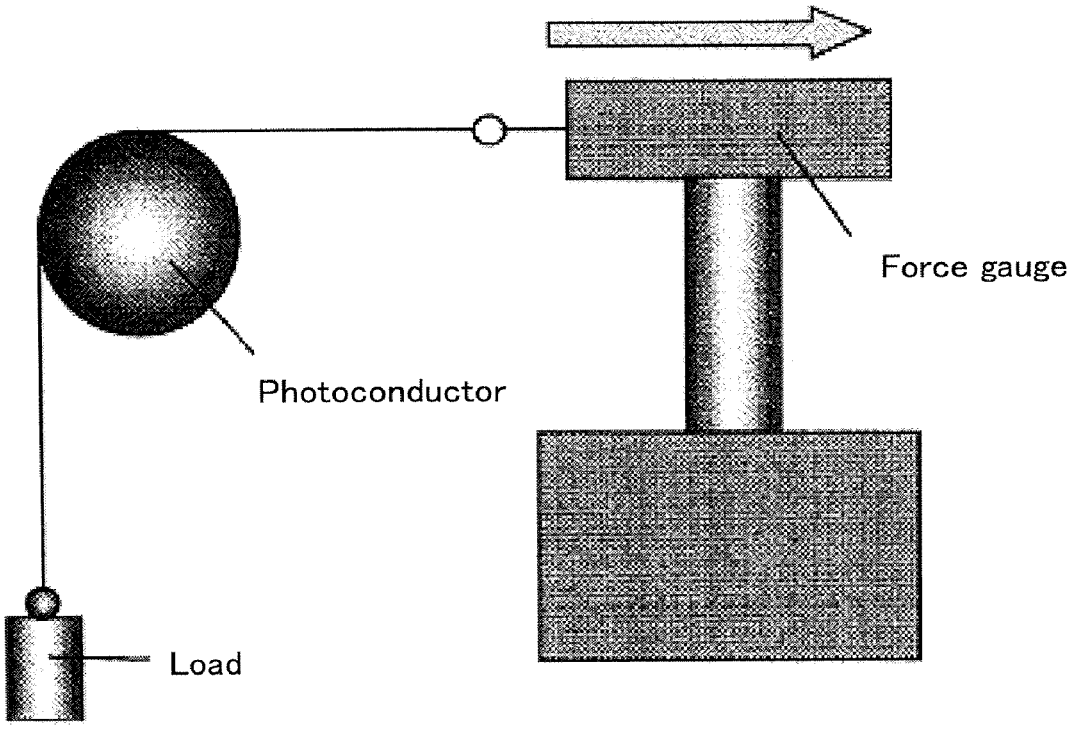
FIG. 8 is a schematic view of an measuring device to measure a frictional coefficient of the surface of the electrophotographic photoconductor of the present invention.

As an image forming apparatus used for the running test, the same image forming apparatus used for the evaluation of the nitric oxide exposure test (the remodeled machine of IPSIO COLOR CX900 manufactured by Ricoh Company Ltd.) was used. The electric potential of the photoconductor surface at the start was set to −650V to evaluate a change in frictional coefficient of the photoconductor surface and a change in electric potential in the machine. For an image used in paper-passing test, a test chart having a 5% image-area ratio was used. The frictional coefficient of the photoconductor surface was measured by the Euler belt method using a device shown in FIG. 8. A PPC paper sheet (Type 6200 manufactured by Ricoh Company Ltd.) that had been cut out into strip shape of 3 cm in width was made contact with a part of one fourth of the outer circumference of the photoconductor surface so that the paper pressing direction of the paper sheet was along the longitudinal direction thereof, a load of 100 g was given to one end (lower end) of a cord and the other end of the cord was connected to a force gauge. While keeping the condition, the force gauge was moved at a constant speed, the force (peak value) at the time when the paper sheet began to move was read by the force gauge. Using the measured forth, the static frictional coefficient was calculated based on the following equation.

$$\mu s=2/\pi\cdot\ln(F/W)$$

μs: static frictional coefficient

F: value read by the force gauge

W: load (100 g)

[Electrophotographic Photoconductor Having No Surface Layer]

The electrophotographic photoconductors obtained in Examples 2 to 3, 5, 13 to 15, 26, 35 to 52 and Comparative Examples 1, 9 to 11, 20, 23 to 29 were used for the running test using 50,000 sheets in the remodeled machine. Table 4-A and 4-B show the frictional coefficient results and the results of the respective photoconductor surfaces when the cleaning condition thereof was visually checked.

As compared to the results obtained from the electrophotographic photoconductors of which an injection treatment using a polyorganosiloxane or a wax had not been carried out, the frictional coefficient of the electrophotographic photoconductors obtained in Examples was slightly increased, however, the frictional coefficient results showed that the variation was low. In contrast, the electrophotographic photoconductor sample of Comparative Example 20 of which a polyorganosiloxane had been directly added to the coating solution had a frictional coefficient similarly to the frictional coefficients of the electrophotographic photoconductors of samples of Examples in the initial stage, however, the sample of Comparative Example 20 had a substantial increase in frictional coefficient and had a value near the frictional coefficient of the electrophotographic photoconductor of Comparative Example 1 when 20,000 paper sheets were passed through on the sample, and it was found that the sample could not maintain the low frictional coefficient in the initial stage. The electrophotographic photoconductor of Comparative Example 23 prepared by subjecting it to a treatment using only a supercritical fluid without adding a wax and a polyorganosiloxane had a very high frictional coefficient from the initial stage. The electrophotographic photoconductors of Comparative Examples 9 to 11 and 24 to 29 respectively had a relatively low frictional coefficient in the initial stage, just as in the case with the sample of Comparative Example 20, but had a drastic increase in frictional coefficient when 50,000 sheets were passed through on the sample, and did not show a stably low frictional coefficient for a long time.

The cleaning ability of the electrophotographic photoconductors correlates with the frictional coefficients at the time when 50,000 sheets were passed through on the samples. For the electrophotographic photoconductors prepared in Examples, no cleaning defects occurred until the completion of paper-passing 50,000 sheets. In contrast, for the electrophotographic photoconductors of Comparative Examples 1, 11 and 23, cleaning defects occurred at the time when 20,000 sheets were passed through thereon, in particular for the electrophotographic photoconductor of Comparative Example 23, a blade flip occurred after 25,000 or more sheets were passed through on the photoconductor. For this reason, the paper-passing test for the electrophotographic photoconductor of Comparative Example 23 was discontinued. For the other electrophotographic photoconductors prepared in the Comparative Examples, cleaning defects occurred at the time when 50,000 sheets were passed through the respective photoconductors, although no cleaning defects occurred at the time when 20,000 sheets were printed out.

With respect to electric potential in the machine, the electrophotographic photoconductors obtained in Examples had a slightly higher electric potential after exposing than that of the electrophotographic photoconductor of Comparative Example 1. In particular, it was recognized that the electrophotographic photoconductors obtained in Examples 16 to 18 respectively had a higher electric potential than those of the other electrophotographic photoconductors prepared in the Examples. It is conceivable that because of the high temperature of the supercritical fluid and changes such as outflow of constituents of the charge transporting layer are caused, however, the electrophotographic photoconductors of Examples 16 to 18 did not cause image defects.

TABLE 4-A

| | Frictional coefficient | | | |
|---|---|---|---|---|
| | In initial stage | After printing 20,000 sheets | After printing 50,000 sheets | Cleaning ability (after printing 50,000 sheets) |
| Ex. 2 | 0.12 | 0.2 | 0.21 | No defects occurred |
| Ex. 3 | 0.15 | 0.18 | 0.21 | No defects occurred |
| Ex. 5 | 0.17 | 0.21 | 0.23 | No defects occurred |
| Ex. 13 | 0.23 | 0.31 | 0.33 | No defects occurred |
| Ex. 14 | 0.25 | 0.3 | 0.35 | No defects occurred |
| Ex. 15 | 0.25 | 0.33 | 0.35 | No defects occurred |
| Ex. 26 | 0.32 | 0.35 | 0.36 | No defects occurred |
| Ex. 35 | 0.15 | 0.18 | 0.21 | No defects occurred |
| Ex. 36 | 0.13 | 0.15 | 0.19 | No defects occurred |
| Ex. 37 | 0.13 | 0.17 | 0.22 | No defects occurred |
| Ex. 38 | 0.19 | 0.22 | 0.24 | No defects occurred |
| Ex. 39 | 0.18 | 0.21 | 0.22 | No defects occurred |
| Ex. 40 | 0.18 | 0.23 | 0.22 | No defects occurred |
| Ex. 41 | 0.22 | 0.23 | 0.25 | No defects occurred |
| Ex. 42 | 0.21 | 0.24 | 0.22 | No defects occurred |
| Ex. 43 | 0.21 | 0.25 | 0.26 | No defects occurred |
| Ex. 44 | 0.13 | 0.16 | 0.18 | No defects occurred |
| Ex. 45 | 0.15 | 0.16 | 0.19 | No defects occurred |
| Ex. 46 | 0.13 | 0.16 | 0.21 | No defects occurred |
| Ex. 47 | 0.16 | 0.19 | 0.23 | No defects occurred |
| Ex. 48 | 0.17 | 0.18 | 0.22 | No defects occurred |
| Ex. 49 | 0.19 | 0.21 | 0.23 | No defects occurred |
| Ex. 50 | 0.13 | 0.15 | 0.16 | No defects occurred |
| Ex. 51 | 0.15 | 0.18 | 0.19 | No defects occurred |
| Ex. 52 | 0.15 | 0.16 | 0.21 | No defects occurred |

TABLE 4-B

| | Frictional coefficient | | | |
|---|---|---|---|---|
| | In initial stage | After printing 20,000 sheets | After printing 50,000 sheets | Cleaning ability (after printing 50,000 sheets) |
| Compara. Ex. 1 | 0.3 | 0.51 | 0.56 | Defects occurred after 20,000 sheets were printed |
| Compara. Ex. 9 | 0.26 | 0.47 | 0.52 | Defects occurred after 50,000 sheets were printed |
| Compara. Ex. 10 | 0.23 | 0.45 | 0.49 | Defects occurred after 50,000 sheets were printed |
| Compara. Ex. 11 | 0.27 | 0.51 | 0.55 | Defects occurred after 20,000 sheets were printed |

TABLE 4-B-continued

| | Frictional coefficient | | | Cleaning ability |
|---|---|---|---|---|
| | In initial stage | After printing 20,000 sheets | After printing 50,000 sheets | (after printing 50,000 sheets) |
| Compara. Ex. 20 | 0.15 | 0.48 | 0.55 | Defects occurred after 50,000 sheets were printed |
| Compara. Ex. 23 | 0.46 | 0.55 | — | Defects occurred after 20,000 sheets were printed (because of a blade inversion, the test was finished when 25,000 sheets were printed) |
| Compara. Ex. 24 | 0.23 | 0.35 | 0.5 | Defects occurred after 50,000 sheets were printed |
| Compara. Ex. 25 | 0.22 | 0.33 | 0.48 | Defects occurred after 50,000 sheets were printed |
| Compara. Ex. 26 | 0.19 | 0.29 | 0.48 | Defects occurred after 50,000 sheets were printed |
| Compara. Ex. 27 | 0.24 | 0.34 | 0.53 | Defects occurred after 50,000 sheets were printed |
| Compara. Ex. 28 | 0.23 | 0.35 | 0.53 | Defects occurred after 50,000 sheets were printed |
| Compara. Ex. 29 | 0.25 | 0.33 | 0.51 | Defects occurred after 50,000 sheets were printed |

TABLE 5-A

| | Potential after charging | | | Potential after exposing | | |
|---|---|---|---|---|---|---|
| | In initial stage | After printing 20,000 sheets | After printing 50,000 sheets | in initial stage | After printing 20,000 sheets | After printing 50,000 sheets |
| Ex. 2 | −645 | −635 | −625 | −70 | −80 | −90 |
| Ex. 3 | −645 | −635 | −620 | −85 | −90 | −100 |
| Ex. 5 | −655 | −640 | −630 | −65 | −75 | −90 |
| Ex. 13 | −655 | −640 | −620 | −80 | −95 | −105 |
| Ex. 14 | −650 | −635 | −620 | −85 | −95 | −110 |
| Ex. 15 | −655 | −635 | −625 | −65 | −80 | −100 |
| Ex. 26 | −645 | −635 | −620 | −95 | −110 | −130 |
| Ex. 35 | −645 | −630 | −625 | −65 | −80 | −90 |
| Ex. 36 | −650 | −635 | −625 | −70 | −90 | −95 |
| Ex. 37 | −650 | −625 | −625 | −65 | −85 | −100 |
| Ex. 38 | −645 | −630 | −625 | −55 | −80 | −95 |
| Ex. 39 | −650 | −630 | −625 | −55 | −70 | −90 |
| Ex. 40 | −655 | −625 | −625 | −60 | −75 | −95 |
| Ex. 41 | −650 | −635 | −625 | −55 | −75 | −90 |
| Ex. 42 | −650 | −635 | −625 | −60 | −80 | −95 |
| Ex. 43 | −655 | −625 | −625 | −60 | −75 | −95 |
| Ex. 44 | −645 | −635 | −625 | −70 | −90 | −105 |
| Ex. 45 | −650 | −640 | −625 | −70 | −85 | −100 |
| Ex. 46 | −650 | −635 | −625 | −65 | −85 | −95 |
| Ex. 47 | −655 | −635 | −625 | −60 | −80 | −95 |
| Ex. 48 | −655 | −635 | −625 | −60 | −75 | −95 |
| Ex. 49 | −650 | −625 | −625 | −65 | −85 | −100 |
| Ex. 50 | −655 | −620 | −625 | −85 | −105 | −125 |
| Ex. 51 | −650 | −615 | −625 | −80 | −100 | −120 |
| Ex. 52 | −660 | −615 | −625 | −90 | −110 | −125 |

TABLE 5-B

| | Potential after charging | | | Potential after exposing | | |
|---|---|---|---|---|---|---|
| | In initial stage | After printing 20,000 sheets | After printing 50,000 sheets | in initial stage | After printing 20,000 sheets | After printing 50,000 sheets |
| Compara. Ex. 1 | −650 | −640 | −625 | −50 | −65 | −70 |
| Compara. Ex. 9 | −650 | −635 | −625 | −60 | −70 | −85 |
| Compara. Ex. 10 | −650 | −640 | −630 | −55 | −75 | −90 |
| Compara. Ex. 11 | −655 | −635 | −630 | −60 | −75 | −80 |
| Compara. Ex. 20 | −645 | −640 | −625 | −70 | −75 | −85 |
| Compara. Ex. 23 | −650 | −640 | −625 | −80 | −85 | −105 |
| Compara. Ex. 24 | −645 | −640 | −625 | −55 | −75 | −80 |
| Compara. Ex. 25 | −655 | −640 | −625 | −50 | −70 | −75 |
| Compara. Ex. 26 | −655 | −640 | −625 | −55 | −75 | −75 |
| Compara. Ex. 27 | −645 | −640 | −625 | −60 | −80 | −80 |
| Compara. Ex. 28 | −650 | −640 | −625 | −55 | −75 | −80 |
| Compara. Ex. 29 | −660 | −640 | −625 | −45 | −75 | −75 |

[Electrophotographic Photoconductor Having a Crosslinked Surface Layer]

The electrophotographic photoconductors obtained in Examples 7 to 12, 16 to 24, 27 to 32 and 53 to 58 and Comparative Examples 2, 8, 12 to 14 and 18 to 19 were subjected to a running test using 100,000 sheets in the image forming apparatus. Tables 6-A, 6-B and 7 show the evaluation results. Tables 6-A and 6B also show the results of the respective photoconductor surfaces when the cleaning condition thereof was visually checked.

The evaluation results of frictional coefficient and cleaning ability showed that all the electrophotographic photoconductors of Examples 7 to 12, 16 to 24, 29 to 32 and 53 to 58 exhibited a remarkably low frictional coefficient from the initial stage and maintained the low frictional coefficient level even after the paper-passing test using 100,000 sheets.

The electrophotographic photoconductors of Examples 27 and 28 respectively had a slightly lower frictional coefficient than that of the electrophotographic photoconductor of Comparative Example of which an injection treatment had not been carried out, however, they had little decrease in frictional coefficient as compared to the other electrophotographic photoconductors prepared in the Examples. With respect to cleaning ability, little cleaning defects occurred in the electrophotographic photoconductor of Example 27, however, no conspicuous cleaning defects occurred in the other electrophotographic photoconductors of the Examples, showing favorable results.

In the meanwhile, the electrophotographic photoconductor of Comparative Example 2 of which an injection treatment had not been carried out had high frictional coefficient from the initial stage and abnormal noise occurred in between the blade and the photoconductor at the point of the completion of paper-passing of 20,000 sheets and the paper-passing test was given up. At this point in time, ten or more cleaning defects were observed on the photoconductor of Comparative Example 2. Further, a frictional coefficient of the photoconductor of Comparative Example 2 was measured at this point in time and a drastic increase in frictional coefficient was recognized. It can be presumed that abnormal noise occurred in the paper-passing test because of the increased frictional coefficient in between the blade and the photoconductor.

The electrophotographic photoconductor of Comparative Example 8 that had been prepared preliminarily adding a wax had a relatively low frictional coefficient in the initial stage, however, the same phenomenon as in the case with the photoconductor of Comparative Example 1 was recognized when 50,000 sheets were passed through thereon.

In the electrophotographic photoconductors of Comparative Examples 12 to 14, several cleaning defects were observed on the respective photoconductor surfaces after the paper-passing test of 100,000 sheets, although no abnormal noise occurred through the paper-passing test.

The electrophotographic photoconductors of Comparative Examples 18 to 19 respectively had a sufficiently low frictional coefficient in the initial stage, however, as shown in Table 6-B, the electric potentials after exposing were extremely high when the initial electric potentials were measured and the output image density thereof was severely low as compared to those of the other electrophotographic photoconductors. For this reason, the paper-passing test for the electrophotographic photoconductors was discontinued.

On changes in electric potential in the machine, in the electrophotographic photoconductors prepared in the Examples, a drastic change was not observed until the completion of the paper-passing test of 100,000 sheets.

The electrophotographic photoconductors of Examples 7 to 8, 16, 19 and 22 using a paraffin wax tended to have a slightly high electric potential after exposing as compared to the electrophotographic photoconductors using a synthetic wax (olefin wax, Fisher-Tropsh wax) bud did not cause degradation of output image quality in the paper-passing test.

Further, in the electrophotographic photoconductors of Comparative Examples 2, 8 and 12 to 14, a drastic change in electric potential was not also recognized through the paper-passing test of 100,000 sheets. The electrophotographic photoconductors of Comparative Examples 18 to 19 respectively had a high electric potential after exposing from the initial stage and a phenomenon that the output image density was extremely faint. For this reason, the paper-passing test for the electrophotographic photoconductors of Comparative Examples 18 to 19 was given up.

TABLE 6-A

| | Frictional coefficient | | Cleaning ability |
|---|---|---|---|
| | In initial stage | After printing 100,000 sheets | (After printing 100,000 sheets) |
| Ex. 7 | 0.12 | 0.21 | No defects occurred |
| Ex. 8 | 0.14 | 0.24 | No defects occurred |
| Ex. 9 | 0.14 | 0.24 | No defects occurred |
| Ex. 10 | 0.12 | 0.22 | No defects occurred |
| Ex. 11 | 0.15 | 0.25 | No defects occurred |
| Ex. 12 | 0.18 | 0.25 | No defects occurred |
| Ex. 16 | 0.11 | 0.19 | No defects occurred |
| Ex. 17 | 0.13 | 0.19 | No defects occurred |
| Ex. 18 | 0.16 | 0.23 | No defects occurred |
| Ex. 19 | 0.21 | 0.35 | No defects occurred |
| Ex. 20 | 0.24 | 0.34 | No defects occurred |
| Ex. 21 | 0.23 | 0.35 | No defects occurred |
| Ex. 22 | 0.13 | 0.18 | No defects occurred |
| Ex. 23 | 0.13 | 0.19 | No defects occurred |
| Ex. 24 | 0.16 | 0.25 | No defects occurred |
| Ex. 27 | 0.35 | 0.42 | Little defects occurred |
| Ex. 28 | 0.38 | 0.45 | No defects occurred |

TABLE 6-A-continued

| | Frictional coefficient | | Cleaning ability |
|---|---|---|---|
| | In initial stage | After printing 100,000 sheets | (After printing 100,000 sheets) |
| Ex. 29 | 0.16 | 0.23 | No defects occurred |
| Ex. 30 | 0.14 | 0.23 | No defects occurred |
| Ex. 31 | 0.16 | 0.25 | No defects occurred |
| Ex. 32 | 0.18 | 0.24 | No defects occurred |
| Ex. 53 | 0.11 | 0.18 | No defects occurred |
| Ex. 54 | 0.1 | 0.16 | No defects occurred |
| Ex. 55 | 0.1 | 0.15 | No defects occurred |
| Ex. 56 | 0.12 | 0.13 | No defects occurred |
| Ex. 57 | 0.13 | 0.13 | No defects occurred |
| Ex. 58 | 0.15 | 0.19 | No defects occurred |

TABLE 6-B

| | Frictional coefficient | | Cleaning ability |
|---|---|---|---|
| | In initial stage | After printing 100,000 sheets | (After printing 100,000 sheets) |
| Compara. Ex. 2 | 0.42 | 0.58 (after printing 20,000 sheets) | Defects occurred The defects occurred in between a blade and the photoconductor after printing 20,000 sheets. |
| Compara. Ex. 8 | 0.33 | 0.53 (after printing 50,000 sheets) | Defects occurred The defects occurred in between a blade and the photoconductor after printing 50,000 sheets. |
| Compara. Ex. 12 | 0.29 | 0.41 | Defects occurred |
| Compara. Ex. 13 | 0.25 | 0.44 | Defects occurred |
| Compara. Ex. 14 | 0.28 | 0.43 | Defects occurred |
| Compara. Ex. 18 | 0.17 | — | Had a severely high electric potential after charging from the initial stage |
| Compara. Ex. 19 | 0.13 | — | Had a severely high electric potential after charging from the initial stage |

TABLE 7-A

| | Electric potential after charging | | Electric potential after exposing | |
|---|---|---|---|---|
| | In initial stage | After printing 100,000 sheets | In initial stage | After printing 100,000 sheets |
| Ex. 7 | −645 | −635 | −145 | −165 |
| Ex. 8 | −650 | −630 | −140 | −165 |
| Ex. 9 | −650 | −635 | −135 | −145 |
| Ex. 10 | −650 | −635 | −135 | −140 |
| Ex. 11 | −645 | −625 | −130 | −140 |
| Ex. 12 | −650 | −630 | −135 | −145 |
| Ex. 16 | −645 | −630 | −150 | −170 |
| Ex. 17 | −650 | −635 | −140 | −150 |
| Ex. 18 | −655 | −640 | −130 | −145 |
| Ex. 19 | −645 | −630 | −130 | −145 |
| Ex. 20 | −655 | −635 | −120 | −130 |
| Ex. 21 | −650 | −635 | −120 | −130 |
| Ex. 22 | −665 | −615 | −155 | −190 |
| Ex. 23 | −670 | −625 | −150 | −180 |
| Ex. 24 | −665 | −615 | −155 | −175 |
| Ex. 27 | −655 | −635 | −125 | −135 |

TABLE 7-A-continued

| | Electric potential after charging | | Electric potential after exposing | |
|---|---|---|---|---|
| | In initial stage | After printing 100,000 sheets | In initial stage | After printing 100,000 sheets |
| Ex. 28 | −650 | −625 | −130 | −135 |
| Ex. 29 | −660 | −635 | −135 | −145 |
| Ex. 30 | −645 | −640 | −140 | −145 |
| Ex. 31 | −645 | −630 | −130 | −145 |
| Ex. 32 | −655 | −635 | −130 | −140 |
| Ex. 53 | −650 | −630 | −115 | −125 |
| Ex. 54 | −655 | −630 | −125 | −140 |
| Ex. 55 | −655 | −625 | −125 | −135 |
| Ex. 56 | −650 | −625 | −110 | −125 |
| Ex. 57 | −645 | −620 | −125 | −140 |
| Ex. 58 | −650 | −620 | −130 | −150 |
| Compara. Ex. 2 | −645 | −640 | −115 | −125 |
| Compara. Ex. 8 | −655 | −640 | −125 | −130 |
| Compara. Ex. 12 | −650 | −640 | −135 | −150 |
| Compara. Ex. 13 | −645 | −640 | −130 | −140 |
| Compara. Ex. 14 | −655 | −640 | −130 | −140 |
| Compara. Ex. 18 | −690 | — | −270 | — |
| Compara. Ex. 19 | −705 | — | −310 | — |

The results of the electrophotographic photoconductors of Examples and Comparative Examples exemplified that the method for producing an electrophotographic photoconductor of the present invention and the electrophotographic photoconductor produced by the method allow for obtaining favorable cleaning ability and stable electric properties without substantially causing occurrence of image defects even after a running of an image forming apparatus using 50,000 sheets when the electrophotographic photoconductor has no surface layer, and even after a running of an image forming apparatus using 100,000 sheets when the electrophotographic photoconductor has a surface layer.

The electrophotographic photoconductor of the present invention allows for reducing gas permeability of the electrophotographic photoconductor for a long time and keeping the surface energy low for a long time, and thus the electrophotographic photoconductor of the present invention is suitably used for image forming apparatuses and process cartridges that achieve improvements in resolution, improvements in mobility and reductions in residual potential.

What is claimed is:

1. A method for producing an electrophotographic photoconductor, comprising:

making an electrophotographic photoconductor contact with a supercritical fluid or a subcritical fluid which contains an injection material composed of at least any one of one wax selected from paraffin waxes, Fisher-Tropsh waxes and polyolefin waxes and a polyorganosiloxane compound at 0.5 g/L to less than 4.0 g/L to thereby inject the injection material into the electrophotographic photoconductor, wherein the electrophotographic photoconductor comprises a conductive substrate, and a photosensitive layer containing a binder, a charge generating material and a charge transporting material and being formed on the substrate.

2. The method for producing an electrophotographic photoconductor according to claim 1, wherein the supercritical fluid or the subcritical fluid is carbon dioxide.

3. The method for producing an electrophotographic photoconductor according to claim 2, wherein the temperature of the supercritical fluid or the subcritical fluid is 5° C. or more higher than the melting point of the injection material.

4. The method for producing an electrophotographic photoconductor according to claim 3, wherein the temperature of the supercritical fluid or the subcritical fluid is 140° C. or less.

5. The method for producing an electrophotographic photoconductor according to claim 1, wherein the melting point of the injection material is 40° C. to 120° C.

6. The method for producing an electrophotographic photoconductor according to claim 1, wherein the wax contained in the injection material is at least any one of a Fisher Tropsh wax and a polyethylene wax.

* * * * *